US010239314B2

(12) United States Patent
Fujisawa et al.

(10) Patent No.: US 10,239,314 B2
(45) Date of Patent: Mar. 26, 2019

(54) HEAD UNIT

(71) Applicant: SEIKO EPSON CORPORATION, Tokyo (JP)

(72) Inventors: Kazuhito Fujisawa, Minowa-machi (JP); Ryota Furukawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/362,015

(22) Filed: Nov. 28, 2016

(65) Prior Publication Data

US 2017/0182773 A1 Jun. 29, 2017

(30) Foreign Application Priority Data

Dec. 25, 2015 (JP) ..... 2015-252879

(51) Int. Cl.
*B41J 2/14* (2006.01)
*B41J 2/045* (2006.01)

(52) U.S. Cl.
CPC ..... *B41J 2/14201* (2013.01); *B41J 2/0451* (2013.01); *B41J 2/04541* (2013.01); *B41J 2/04581* (2013.01); *B41J 2/04593* (2013.01); *B41J 2/14233* (2013.01); *B41J 2002/14354* (2013.01); *B41J 2002/14491* (2013.01)

(58) Field of Classification Search
CPC ..... B41J 2/14; B41J 2/14233; B41J 2/0451; B41J 2/04541; B41J 2/04581; B41J 2/04593; B41J 2002/14491
See application file for complete search history.

(56) References Cited

U.S. PATENT DOCUMENTS

| | | | | |
|---|---|---|---|---|
| 5,376,854 | A | 12/1994 | Oouchi | |
| 2004/0227782 | A1 | 11/2004 | Shinkawa et al. | |
| 2006/0256157 | A1* | 11/2006 | Kim | B41J 2/2139 347/47 |
| 2007/0115507 | A1* | 5/2007 | Vladislav | B41J 2/2139 358/3.13 |
| 2012/0007910 | A1 | 1/2012 | Lee | |
| 2015/0054876 | A1 | 2/2015 | Nakazawa et al. | |

FOREIGN PATENT DOCUMENTS

| | | | |
|---|---|---|---|
| JP | 04-286657 | A | 10/1992 |
| JP | 2006-256254 | A | 9/2006 |
| JP | 2007-136257 | A | 6/2007 |
| JP | 2010-228360 | A | 10/2010 |
| JP | 2015-039856 | A | 3/2015 |
| KR | 10-2004-0077568 | A | 9/2004 |
| KR | 10-2007-0054322 | A | 5/2007 |
| KR | 10-2012-0005227 | A | 1/2012 |

* cited by examiner

*Primary Examiner* — Lamson Nguyen

(57) ABSTRACT

A head unit includes a discharge section, a determination circuit, and a discharge limitation circuit. The discharge section is equipped with a piezoelectric element that is configured to be displaced in accordance with changes in potential of a drive signal when the drive signal is supplied. The discharge section is configured to discharge a liquid in accordance with displacement of the piezoelectric element. The determination circuit is configured to determine whether or not the piezoelectric element has a predetermined power storage capability. The discharge limitation circuit is configured to stop supply of the drive signal to the piezoelectric element and limit discharging of liquid from the discharge section when a result of determination is negative.

14 Claims, 31 Drawing Sheets

| Terminal Name (CN1) | Signal Name |
|---|---|
| ZN1-1 | GND |
| ZN1-2 | Tsig |
| ZN1-3 | GND |
| ZN1-4 | VBS-2 |
| ZN1-5 | Com-2 |
| ZN1-6 | VBS-1 |
| ZN1-7 | Com-1 |
| ZN1-8 | VDD |
| ZN1-9 | CH |
| ZN1-10 | GND |
| ZN1-11 | CL |
| ZN1-12 | GND |
| ZN1-13 | SI1-1 |
| ZN1-14 | GND |

| Terminal Name (CN2) | Signal Name |
|---|---|
| ZN2-14 | GND |
| ZN2-13 | GND |
| ZN2-12 | GND |
| ZN2-11 | Com-2 |
| ZN2-10 | VBS-2 |
| ZN2-9 | Com-1 |
| ZN2-8 | VBS-1 |
| ZN2-7 | VHV |
| ZN2-6 | LAT |
| ZN2-5 | SI2-2 |
| ZN2-4 | GND |
| ZN2-3 | SI1-2 |
| ZN2-2 | GND |
| ZN2-1 | SI2-1 |

| Terminal Name (CN3) | Signal Name |
|---|---|
| ZN3-1 | SI1-3 |
| ZN3-2 | GND |
| ZN3-3 | SI2-3 |
| ZN3-4 | GND |
| ZN3-5 | HT |
| ZN3-6 | NCH |
| ZN3-7 | VDD |
| ZN3-8 | VBS-4 |
| ZN3-9 | Com-4 |
| ZN3-10 | VBS-3 |
| ZN3-11 | Com-3 |
| ZN3-12 | GND |
| ZN3-13 | GND |
| ZN3-14 | GND |

| Terminal Name (CN4) | Signal Name |
|---|---|
| ZN4-14 | GND |
| ZN4-13 | SI2-4 |
| ZN4-12 | GND |
| ZN4-11 | SI1-4 |
| ZN4-10 | GND |
| ZN4-9 | XH |
| ZN4-8 | GND |
| ZN4-7 | Com-4 |
| ZN4-6 | VBS-4 |
| ZN4-5 | Com-3 |
| ZN4-4 | VBS-3 |
| ZN4-3 | GND |
| ZN4-2 | NSA |
| ZN4-1 | GND |

Fig. 8

| Md | Sd[m] | Content of Designation in Sd[m] | SLa[m] | | |
|---|---|---|---|---|---|
| | | | TA1 | TA2 | TA3 |
| 1 (Diagnostic Process) | (1,1) | To Be Diagnosed | H | L | H |
| | (0,0) | Not To Be Diagnosed | H | H | H |

Fig. 14A

| Md | Sd[m] | Content of Designation in Sd[m] | SLa[m] | |
|---|---|---|---|---|
| | | | Tu1 | Tu2 |
| 2 (Printing Process) | (1, 1) | Large Dot | H | H |
| | (1, 0) | Medium Dot | H | L |
| | (0, 1) | Small Dot | L | H |
| | (0, 0) | Non-Recording | L | L |

Fig. 14B

| Md | Sd[m] | Content of Designation in Sd[m] | SLs[m] | |
|---|---|---|---|---|
| | | | TS | Other than TS |
| 1 (Printing Process) | (1, 1) | To Be Diagnosed | H | L |
| | (0, 0) | Not To Be Diagnosed | L | L |

Fig. 14C

| Md | Sd[m] | SP | Content of Designation in Sd[m] | SLa[m] | | | | |
|---|---|---|---|---|---|---|---|---|
| | | | | Tu1 | TAu2 | TSS1 | TSS2 | TSS3 |
| 2 (Normal) | (1, 1) | 0 (Print) | Large Dot | H | H | - | - | - |
| | (1, 0) | | Medium Dot | H | L | - | - | - |
| | (0, 1) | | Small Dot | L | H | - | - | - |
| | (0, 0) | | Non-Recording | L | L | - | - | - |
| | (1, 1) | 1 (Inspection) | To Be Diagnosed | - | - | H | L | H |
| | (0, 0) | | Not To Be Diagnosed | - | - | L | L | L |

Fig. 19A

| Md | Sd[m] | SP | Content of Designation in Sd[m] | SLs[m] | | | | |
|---|---|---|---|---|---|---|---|---|
| | | | | Tu1 | TAu2 | TSS1 | TSS2 | TSS3 |
| 2 (Normal) | - | 0 | - | L | L | - | - | - |
| | (1, 1) | 1 (Inspection) | To Be Diagnosed | - | - | L | H | L |
| | (0, 0) | | Not To Be Diagnosed | - | - | L | L | L |

Fig. 19B

| Info-S | Info-T (NTc COMPARISON CONTENT) | Stt |
|---|---|---|
| 1 | NTc < Tth1 | 2: ABNORMAL DISCHARGE (BUBBLES) |
| | Tth1 ≤ NTc ≤ Tth2 | 1: NORMAL |
| | Tth2 < NTc ≤ Tth3 | 3: ABNORMAL DISCHARGE (FOREIGN MATTER) |
| | Tth3 < NTc | 4: ABNORMAL DISCHARGE (THICKENING) |
| 0 | N/A | 5: ABNORMAL DISCHARGE |

Fig. 21

HEAD UNIT

CROSS-REFERENCE TO RELATED APPLICATIONS

This application claims priority to Japanese Patent Application No. 2015-252879 filed on Dec. 25, 2015. The entire disclosure of Japanese Patent Application No. 2015-252879 is hereby incorporated herein by reference.

BACKGROUND

Technical Field

The present invention relates to a head unit of a liquid discharge device.

Related Art

A liquid discharge device such as an inkjet printer executes a printing process in which piezoelectric elements provided to discharge sections of a head unit are driven by a drive signal, causing a liquid such as ink with which cavities (pressure chambers) of the discharge sections are filled to be thereby discharged from nozzles of the discharge sections, to form an image on a recording medium. In such a liquid discharge device, the occurrence of a malfunction in a discharge section, such as a failure of a piezoelectric element, may in some instances result in abnormal discharge whereby the liquid can no longer be properly discharged from the discharge section. When abnormal discharge occurs, a dot to be formed on the recording medium by the liquid discharged from the discharge section can no longer be formed correctly, and the quality of the image formed by the printing process is adversely affected.

In order to reduce the possibility of the printing process being executed in a state where abnormal discharge occurs, JP-A 2010-228360 proposes the technique of detecting the potentials of electrodes of the piezoelectric elements when the piezoelectric elements are charged or discharged, and determining whether or not the piezoelectric elements can be correctly driven (this determination being called a "drive determination" hereinbelow) on the basis of the detected information.

However, with the technique disclosed in JP-A 2010-228360, the drive determination is made in a circuit provided to the exterior of the head unit. Therefore, when the information detected from the piezoelectric elements such as the potentials of the piezoelectric elements is being transmitted to the circuit in order to perform the drive determination, there may in some instances be noise that is mixed into the detected information, adversely affecting the accuracy of the drive determination.

SUMMARY

The present invention has been made in view of the aforementioned circumstances, and one of the problems addressed thereby is providing a technique for accurately determining whether or not a piezoelectric element can be driven.

In order to solve the problem above, a head unit according to one aspect of the present invention includes a discharge section, a determination circuit, and a discharge limitation circuit. The discharge section includes a piezoelectric element that is configured to be displaced in accordance with changes in potential of a drive signal when the drive signal is supplied. The discharge section is configured to discharge a liquid in accordance with displacement of the piezoelectric element. The determination circuit is configured to determine whether or not the piezoelectric element has a predetermined power storage capability. The discharge limitation circuit is configured to stop supply of the drive signal to the piezoelectric element and limit discharging of liquid from the discharge section when a result of determination is negative.

According to the aspect of the present invention, the determination circuit is provided to the head unit, and therefore the extent to which noise is mixed into the information detected from the piezoelectric element is minimized in comparison to when the determination circuit is provided to the exterior of the head unit. It is therefore possible to accurately determine whether or not the piezoelectric element has the predetermined power storage capability.

Moreover, according to the aspect of the invention, the supply of the drive signal to the piezoelectric element is stopped by the discharge limitation circuit provided to the head unit. That is to say, the head unit as in the aspect of performs, in a self-contained manner within the head unit, both the execution of the determination and the stopping of the driving of the piezoelectric element in accordance with the determination result. It is therefore possible to more reliably and rapidly stop the driving of the piezoelectric element in comparison to when the function for stopping the driving of the piezoelectric element is assigned to the exterior of the head unit. This makes it possible to prevent a deterioration in image quality caused by use of a defective piezoelectric element to execute the printing process, and furthermore makes it possible to suppress any decrease in safety associated with when a defective piezoelectric element is driven.

The above-described head unit may be characterized in that a first designation signal, a second designation signal, a third designation signal, and an instruction signal that is for instructing execution of the determination are supplied. The determination circuit is configured to execute the determination in a determination period during which the first designation signal is high-level, the second designation signal is low-level, the third designation signal is high-level, and the instruction signal is being supplied.

According to this aspect, the determination is executed in a determination period that is specified by the combination of four signals, composed of the first designation signal, the second designation signal, the third designation signal, and the instruction signal. It is therefore possible to reduce the probability of occurrence of a malfunction where the determination is started at a timing for which the determination is not scheduled, in comparison to when the determination period is specified by, for example, one signal.

The above-described head unit may be characterized in the discharge limitation circuit includes a first switch electrically connected between a first wiring to which the drive signal is supplied and the piezoelectric element, and when the result of the determination is negative, the first switch is turned off after an end of the determination period and when the first designation signal falls from high-level to low-level, the second designation signal rises from low-level to high-level, and the third designation signal falls from high-level to low-level.

According to this aspect, if the determination result is negative, then the first switch is turned off and the supply of the drive signal to the piezoelectric element is stopped. Therefore, stopping the driving of the piezoelectric element when the piezoelectric element cannot be driven correctly makes it possible to prevent a deterioration in image quality caused by use of a defective piezoelectric element to execute the printing process, and furthermore makes it possible to prevent any decrease in safety associated with when a defective piezoelectric element is driven.

The above-described head unit may be characterized by being provided with a second wiring and a second switch electrically connected between the piezoelectric element and the second wiring, and in that: the first switch is configured to turn on in a preparation period during which a preparation signal is supplied within a period during which the first designation signal is high-level, the second designation signal is low-level, and the third designation signal is high-level, and until the determination period is started, and the first switch is configured to turn off at the end of the determination period after an end of the preparation period, the second switch is configured to turn on at least from a start of the preparation period until the end of the determination period, the drive signal is configured to set to a predetermined potential at least from the start of the preparation period until the end of the determination period, and the determination circuit is configured to determine that the piezoelectric element has the predetermined power storage capability when, at a predetermined timing within the determination period, a difference in potential between a potential of the first wiring and a potential of the second wiring is a predetermined difference in potential or below According to this aspect, the potential of the drive signal, which is a potential that needs to be held by the piezoelectric element, is detected from the first wiring, and the potential that is actually held by the piezoelectric element is detected from the second wiring. It is therefore possible to determine whether or not the piezoelectric element has the power storage capability that is required in order to be driven correctly.

The above-described head unit may be characterized in that the determination circuit includes an output node, a third switch at which one end is electrically connected to the first wiring, a first transistor of which a gate is electrically connected to the second wiring and which is electrically connected between another end of the third switch and the output node, and a second transistor of which a gate is electrically connected to the second wiring and which is electrically connected between the output node and a first power feeder line set to a first reference potential, and the third switch is on during the determination period.

According to this aspect, the third switch is on during the determination period, and either a source or drain of the first transistor is connected to the first wiring. Therefore, during the determination period, the first transistor is on if the difference in potential between the potential of the first wiring and the potential of the second wiring surpasses a threshold potential of the first transistor, and the second transistor is on if the difference in potential between the potential of the second wiring and the potential of the first power feeder line surpasses a threshold potential of the second transistor. Accordingly, it is possible to assess the degree of closeness between the potential of the second wiring, which is substantially the same potential as the potential that is actually held by the piezoelectric element, and the potential of the first wiring which is substantially the same potential as the potential of the drive signal, which is the potential that needs to be held by the piezoelectric element. This makes it possible to determine whether or not the piezoelectric element has the power storage capability that is required in order to be driven correctly.

The head unit may be characterized in that the second transistor is configured to be on when the difference in potential between the potential of the first wiring and the potential of the second wiring is a predetermined difference in potential or below.

According to this aspect, the difference in potential between the potential of the second wiring and the potential of the first power feeder line surpasses the threshold potential of the second transistor when the difference in potential between the potential of the first wiring and the potential of the second wiring is a predetermined difference in potential or below. It is therefore possible to determine whether or not the piezoelectric element has the predetermined power storage capability, by whether the second transistor is on or off.

The above-described head unit may be characterized in that the piezoelectric element includes a first electrode electrically connected to the first switch, and a second electrode electrically connected to a second power feeder line set to a second reference potential, and a difference in potential between the second reference potential and the first reference potential is smaller than a difference in potential between the predetermined potential and the first reference potential According to this aspect, the second reference potential is a potential that is closer to the first reference potential than the predetermined potential, and therefore it becomes possible for the determination circuit to accurately determine whether or not there is a leakage path of a current between the electrodes of the piezoelectric element.

The above-described head unit may be characterized in that: the first designation signal is configured to designate discharging or non-discharging of the liquid from the discharge section when the result of the determination is affirmative and the liquid is configured to be discharged from the discharge section, when the result of the determination is affirmative and the liquid is configured to be discharged from the discharge section, the second determination signal is configured to be low-level, and thereby configured to designate turning on the first switch between the piezoelectric element and the first wiring to which the drive signal is supplied, and the third designation signal is configured to specify a period of time for discharging the liquid from the discharge section when the result of the determination is affirmative and the liquid is configured to be discharged from the discharge section.

According to this aspect, the first designation signal, the second designation signal, and the third designation signal are used to specify the determination period when the determination is executed, and the first designation and second designation and the third designation signal are used for a different purpose than specifying the determination period when the result of the determination is affirmative. It therefore becomes possible to cut down on the number of signals for controlling the head unit and possible to simplify the control and configuration of the head unit control circuitry in comparison to when the first designation signal, the second designation signal, and the third designation signal are not used for any purpose other than specifying the determination period.

Furthermore, a head unit according to another aspect of the present invention includes a discharge section and the discharge section. The discharge section includes a piezoelectric element that is configured to be displaced in accordance with changes in potential of a drive signal when the drive signal is supplied, and the discharge section is configured to discharge a liquid in accordance with displacement of the piezoelectric element. The diagnostic circuit is configured to diagnose a power storage capability of the piezoelectric element, and stop supply of the drive signal to the piezoelectric element and limit discharging of liquid from the discharge section when a result of diagnosis is a predetermined result.

According to the another aspect of the present invention, the diagnostic circuit is provided to the head unit, and therefore the extent to which noise is mixed into the information detected from the piezoelectric element is minimized in comparison to when the diagnostic circuit is provided to the exterior of the head unit. It is therefore possible to accurately diagnose the power storage capability of the piezoelectric element.

Moreover, according to the another aspect of the present invention, the supply of the drive signal to the piezoelectric element is stopped by the diagnostic circuit provided to the head unit. That is to say, the head unit as in the invention of the present application performs, in a self-contained manner within the head unit, both the diagnosis of the power storage capability of the piezoelectric element and the stopping of the driving of the piezoelectric element in accordance with the diagnostic result. It is therefore possible to more reliably and rapidly stop the driving of the piezoelectric element in comparison to when the function for stopping the driving of the piezoelectric element is assigned to the exterior of the head unit. This makes it possible to prevent a deterioration in image quality caused by use of a defective piezoelectric element to execute the printing process, and furthermore makes it possible to suppress any decrease in safety associated with when a defective piezoelectric element is driven.

The above-described head unit may be characterized in that: a first designation signal, a second designation signal, a third designation signal, and a diagnostic control signal are supplied, and the diagnostic circuit is configured to execute the diagnosis in accordance with the diagnostic control signal in a diagnostic period during which the first designation signal is high-level, the second designation signal is low-level, and the third designation signal is high-level.

According to this aspect, the diagnosis is executed in accordance with the diagnostic control signal in a diagnostic period that is specified by the combination of the first designation signal, the second designation signal, and the third designation signal. It is therefore possible to reduce the probability of occurrence of a malfunction where the diagnosis is started at a timing for which the diagnosis is not scheduled, in comparison to when the diagnostic period is specified by one signal.

The above-described head unit may be characterized in that the diagnostic circuit includes a first switch electrically connected between a first wiring to which the drive signal is supplied and the piezoelectric element, and a state of being turned to off after an end of the diagnostic period is maintained when the result of the diagnosis is the predetermined result.

According to this aspect, if the result of the diagnosis is the predetermined result, then the first switch is turned off and the supply of the drive signal to the piezoelectric element is stopped. It is therefore possible to prevent a deterioration in image quality caused by use of a piezoelectric element to execute the printing process when that piezoelectric element cannot be driven correctly, and furthermore it is possible to minimize any decrease in safety associated with when a defective piezoelectric element is driven.

The above-described head unit may be characterized in that the diagnostic circuit includes a second switch electrically connected between the piezoelectric element and a second wiring, and the piezoelectric element is diagnosed as having the predetermined power storage capability when a difference in potential between a potential of the first wiring and a potential of the second wiring is a predetermined difference in potential or below at a predetermined timing in a period during which the second switch is on within the diagnostic period.

According to this aspect, the potential of the drive signal which is a potential that needs to be held by the piezoelectric element is detected from the first wiring, and the potential that is actually held by the piezoelectric element is detected from the second wiring. It is therefore possible to diagnose the power storage capability of the piezoelectric element.

BRIEF DESCRIPTION OF THE DRAWINGS

Referring now to the attached drawings which form a part of this original disclosure:

FIG. 8 is a descriptive view for describing signals inputted and outputted to/from terminals ZN;

FIG. 14A is a descriptive view illustrating decoding content of a decoder DCa;

FIG. 14B is a descriptive view illustrating decoding content of a decoder DCa;

FIG. 14C is a descriptive view illustrating decoding content of a decoder DCs;

FIG. 19A is a descriptive view illustrating decoding content of a decoder DCa2;

FIG. 19B is a descriptive view illustrating decoding content of a decoder DCs2;

FIG. 21 is a descriptive view for describing an inspection result signal Stt;

DETAILED DESCRIPTION OF EXEMPLARY EMBODIMENTS

Modes for carrying out the present invention shall be described hereinbelow, with reference to the accompanying drawings. The dimensions and relative scales of each of the parts in each of the drawings may differ, where appropriate, from the actual ones. The embodiments described hereinbelow are best modes for carrying out the invention, and therefore a variety of technically preferable limitations have been applied, but the scope of the present invention is not to be limited by these embodiments except where it is specifically stated in the following description that the present invention is to be limited.

A. First Embodiment

The present embodiment describes the liquid discharge device by using the illustrative example of an inkjet printer for discharging ink (an example of a "liquid") to form an image on recording paper P (an example of a "medium").

1. Summary of the Inkjet Printer

Figure 1:
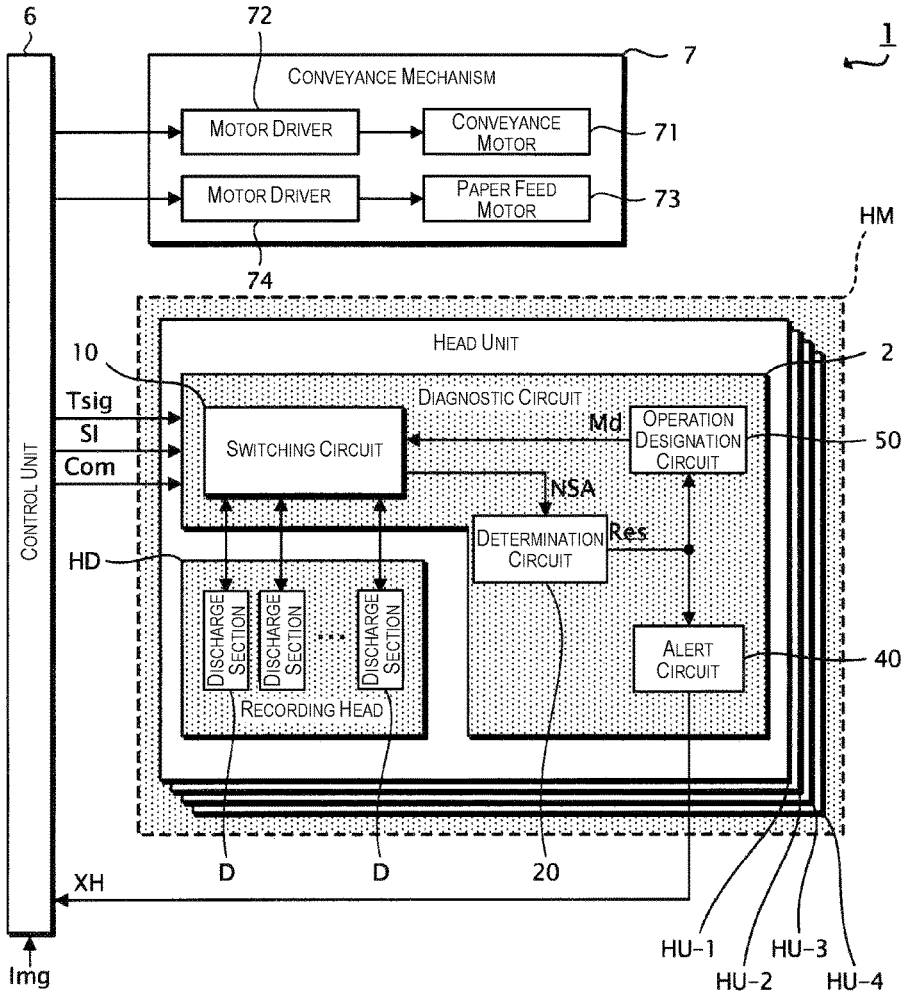
FIG. 1 is a block diagram illustrating the configuration of an inkjet printer 1 as in a first embodiment of the present invention.
Figure 2:
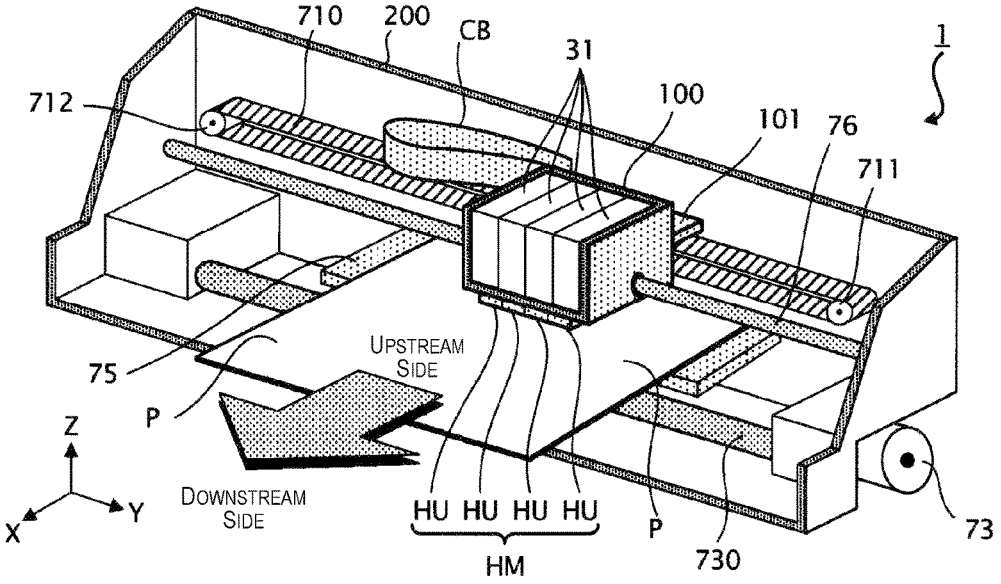
FIG. 2 is a perspective view illustrating a schematic internal structure of the inkjet printer 1.

The configuration of the inkjet printer 1 as in the present embodiment shall now be described with reference to FIGS. 1 and 2. Herein, FIG. 1 is a functional block diagram illustrating an example of the configuration of the inkjet printer 1 as in the present embodiment. FIG. 2 is a perspective view illustrating an example of a schematic internal structure of the inkjet printer 1.

Printing data Img indicating an image to be formed by the inkjet printer 1 and information indicating a number of printed copies of the image to be formed by the inkjet printer 1 are supplied to the inkjet printer 1 from a host computer (not shown) such as a personal computer or a digital camera. The inkjet printer 1 executes a printing process for forming, on the recording paper P, the image indicated by the printing data Img that is supplied from the host computer.

As illustrated by way of example in FIG. 1, the inkjet printer 1 is provided with a head module HM equipped with a plurality of discharge sections D for discharging the ink, a conveyance mechanism 7 for changing the relative position of the recording paper P relative to the head module HM, and a control unit 6 (an example of a "head unit control circuit") for controlling the operation of each of the parts of the inkjet printer 1. The head module HM is provided with four head units HU. Then, each of the head units HU is provided with a recording head HD equipped with a number M of discharge sections D.

The present embodiment envisions a case where the inkjet printer 1 is a serial printer. Specifically, the inkjet printer 1 executes the printing process by discharging ink from the discharge sections D while conveying the recording paper P in a subscanning direction and moving the head module HM in a main scanning direction. The following, as illustrated in FIG. 2, envisions a case where a +Y direction and a −Y direction (the +Y direction and the −Y direction are hereinbelow collectively called a "Y-axis direction") are the main scanning direction, and a +X direction and a −X direction (the +X direction and the −X direction are hereinbelow collectively called a "X-axis direction") are the subscanning direction.

As illustrated by way of example in FIG. 2, the inkjet printer 1 as in the present embodiment is provided with a housing 200 and a carriage 100 that is capable of reciprocating motion in the Y-axis direction through the inside of the housing 200 and is loaded with the head module HM.

When the printing process is being executed, the conveyance mechanism 7 moves the carriage 100 reciprocatingly in the Y-axis direction and conveys the recording paper P in the +X direction, thereby changing the relative position of the recording paper P relative to the head module HM and making it possible for the ink to make impact on the entirety of the recording paper P.

Specifically, the conveyance mechanism 7, as illustrated in FIG. 1, is equipped with a conveyance motor 71 serving as a drive source for reciprocatingly moving the carriage 100 in the Y-axis direction, a motor driver 72 for driving the conveyance motor 71, a paper feed motor 73 serving as a drive source for conveying the recording paper P in the +X direction, and a motor driver 74 for driving the paper feed motor 73. Furthermore, the conveyance mechanism 7, as illustrated in FIG. 2, is equipped with a carriage guide shaft 76 extending in the Y-axis direction, and a timing belt 710 which is looped over a pulley 711 that is driven to rotate by the conveyance motor 71 and a freely-rotating pulley 712, and which extends in the Y-axis direction. The carriage 100 is supported by the carriage guide shaft 76 so as to allow reciprocating motion in the Y-axis direction, and is fixed to a predetermined place on the timing belt 710 via a fixing tool 101. Therefore, by using the conveyance motor 71 to rotatingly drive the pulley 711, the conveyance mechanism 7 is able to move the carriage 100 and the head module HM loaded onto the carriage 100 in the Y-axis direction along the carriage guide shaft 76.

As illustrated in FIG. 2, the conveyance mechanism 7 is also provided with a platen 75 provided on the underside (−Z direction) of the carriage 100, a paper feed roller (not shown) for rotating in accordance with the driving of the paper feed motor 73 and feeding out the recording paper P one sheet at a time over the platen 75, and a paper discharge roller 730 for rotating in accordance with the driving of the paper feed motor 73 and conveying the recording paper P that is on the platen 75 toward a paper exit. Therefore, as illustrated in FIG. 2, the conveyance mechanism 7 is able to convey the recording paper P from the +X direction (upstream side) toward the −X direction (downstream side) over the platen 75.

In the present embodiment, as illustrated by way of example in FIG. 2, four ink cartridges 31 are stored in the carriage 100 of the inkjet printer 1. More specifically, the present embodiment envisions a case where four ink cartridges 31 with a one-to-one correspondence to four colors of ink, which are cyan, magenta, yellow, and black (CMYK), are stored in the carriage 100.

FIG. 2 merely represents an example, however, and the ink cartridges 31 may also be provided to the exterior of the carriage 100.

The control unit 6 is equipped with a storage unit 60 for storing various information such as a control program for the inkjet printer 1 and the printing data Img supplied from the host computer, a central processing unit (CPU), and a variety of other circuits CC (see FIG. 6, described below). The control unit 6 may, however, be provided with a programmable logic device such as a field-programmable gate array (FPGA) instead of the CPU.

Though not shown in FIG. 2, the control unit 6 is provided to the exterior of the carriage 100. As illustrated by way of example in FIG. 2, the control unit 6 and the head module HM are electrically connected by cables CB (an example of a "connection cable"). Though not shown in FIG. 2, the control unit 6 and the head module HM are electrically connected by four cables CB1 to CB4 (see FIG. 6) in the present embodiment. In the present embodiment, a flexible flat cable is employed for each of the cables CB.

With the CPU acting in accordance with the control program stored in the storage unit 60, the control unit 6 thereby controls the operation of each of the parts of the inkjet printer 1. For example, the control unit 6 controls the operation of the head module HM and the conveyance mechanism 7 so as to execute the printing process for forming the image corresponding to the printing data Img on the recording paper P.

A summary of the operation of the control unit 6 when the printing process is being executed shall now be described.

When the printing process is to be executed, the CPU of the control unit 6 first stores, in the storage unit 60, the printing data Img supplied from the host computer.

Then, the control unit 6 generates a variety of signals, such as a printing signal SI and a drive signal Com for controlling the operation of each of the head units HU, on the basis of the variety of data stored in the storage unit 60, such as the printing data Img. Herein, the drive signal Com is an analog signal for driving each of the discharge sections D. Therefore, the variety of circuits CC with which the control unit 6 as in the present embodiment is equipped includes a digital-to-analog (DIA) converter circuit; at this D/A converter circuit, the digital drive signal generated by the CPU of the control unit 6 is converted to the analog drive signal Com. The printing signal SI is a digital signal for designating a mode of driving of each of the discharge sections D in the printing process. Specifically, the printing signal SI designates a mode of driving of each of the discharge sections D by designating whether or not to supply the drive signal Com to each of the discharge sections D in the printing process. Herein, designating a mode of driving of a discharge section D signifies, for example, designating whether or not ink is to be discharged from that discharge section D when the discharge section D is driven, or also designating an amount of ink to be discharged from that discharge section D when the discharge section D is driven. A more detailed description will follow, but the printing signal SI is responsible for more than designating the mode of driving of the discharge sections D in the printing process.

The control unit 6 generates a signal for controlling the operation of the conveyance mechanism 7 and controls the conveyance mechanism 7 so as to change the relative position of the recording paper P relative to the head module HM on the basis of the printing signal SI and the various data stored in the storage unit 60.

In this manner, the control unit 6 uses the printing signal SI and other signals to control the operation of the head module HM and the conveyance mechanism 7. Thus, the control unit 6 controls each of the parts of the inkjet printer 1 so as to adjust whether or not ink is to be discharged from the discharge sections D, the amount of ink discharged, the timing at which the ink is discharged, and the like, and execute the printing process for forming the image corresponding to the printing data Img on the recording paper P.

The inkjet printer 1 as in the present embodiment executes a diagnostic process, in addition to the printing process. Herein, the diagnostic process refers to a process for diagnosing the capability of the discharge sections D to discharge ink. The control unit 6 controls the operation of each of the parts of the inkjet printer 1 so as to execute the diagnostic process at a timing that is after the powering-on of the inkjet printer 1 but before the printing process is executed.

A more detailed description shall follow, but the diagnostic process is a process that comprises a discharge capability determination process (called simply a "determination process" hereinbelow) for determining whether or not the discharge sections D have a predetermined discharge capability, a determination preparation process that is a process for preparing for the determination process, and a determination result response process that is a post hoc process following the determination process, such as informing the control unit 6 about the determination result in the determination process.

The control unit 6 uses the printing signal SI to designate a discharge section D that is subject to diagnosis of the capability of discharging the ink. In other words, the printing signal designates a discharge section D to be subjected to diagnosis in the diagnostic process.

A more detailed description shall follow, but the process from when the inkjet printer 1 is powered on until when the diagnostic process is started is called the startup process. That is to say, the inkjet printer 1 as in the present embodiment first executes the startup process after being powered on, then executes the diagnostic process after executing the startup process, then executes the printing process, in accordance with a request from a user of the inkjet printer 1, after executing the diagnostic process.

The description returns now to FIG. 1. As illustrated in FIG. 1, each of the head units HU is provided with a recording head HD equipped with a number M of discharge sections D (in the present embodiment, M is a natural number satisfying $2 \leq M$). Hereinbelow, in order to differentiate between the respective M discharge sections D of each of the head units HU, the discharge sections may in some instances be called a first stage, a second stage, . . . , an M-th stage, in this order. Also, hereinbelow, the discharge section D of an m-th stage may in some instances be called a discharge section D[m] (where the variable m is a natural number satisfying $1 \leq m \leq M$). Moreover, hereinbelow, where a constituent element, signal, or the like of the inkjet printer 1 is one that corresponds to a stage m of the discharge section D[m], then the reference signal used to designate that constituent element, signal, or the like is expressed with the suffix [m], which indicates that the constituent element, signal, or the like corresponds to the stage m.

In the present embodiment, there are four head units HU and four ink cartridges 31 provided, so as to have a one-to-one correspondence. Each of the discharge sections D receives a supply of ink from the ink cartridge 31 corresponding to the head unit HU to which that discharge section D belongs. This makes it possible for the discharge sections D to be filled with the supplied ink in the interior and discharge the ink from a nozzle N. In other words, the total of 4M discharge sections D with which the head module HM is equipped are able to discharge four colors of ink (CMYK) as a whole. Therefore, the inkjet printer 1 is able to print a full-color image with the four colors of ink (CMYK).

Hereinbelow, where it is necessary to differentiate between the four head units HU, the head units are called HU-1 to HU-4, as illustrated in FIG. 1. The present embodiment envisions a case where, as an example, the head unit HU-1 corresponds to the ink cartridge 31 that is filled with black ink, the head unit HU-2 corresponds to the ink cartridge 31 that is filled with cyan ink, the head unit HU-3 corresponds to the ink cartridge 31 that is filled with magenta ink, and the head unit HU-4 corresponds to the ink cartridge 31 that is filled with yellow ink. Moreover, hereinbelow, to indicate any arbitrary one of the head units HU-1 to HU-4, the expression "head unit HU-1" may be used (where q is a natural number satisfying $1 \leq q \leq 4$).

As illustrated in FIG. 1, in addition to the recording head HD equipped with the M discharge sections D, each of the head units HU is provided with: a switching circuit 10 for switching between supplying and not supplying, to each of the discharge sections D, the drive signal Com outputted from the control unit 6; a determination circuit 20 for executing the determination process for determining whether or not the discharge sections D have a predetermined discharge capability on the basis of a detection signal NSA detected from the discharge sections D, and outputting a determination result signal Res indicate of the result of the determination in the determination process; an alert circuit 40 for outputting an alert signal Xh for alerting the control unit 6 about the result of the determination if the result of the determination in the determination circuit 20 is negative; and an operation designation circuit 50 for outputting an operational mode designation signal Md for designating an operational mode of the switching circuit 10, in accordance with the result of the determination in the determination circuit 20.

The above-described diagnostic process is executed by the switching circuit 10, the determination circuit 20, the alert circuit 40, and the operation designation circuit 50. Accordingly, hereinbelow, the name "diagnostic circuit 2" may in some instances be given to the switching circuit 10, the determination circuit 20, the alert circuit 40, and the operation designation circuit 50, which are constituent elements for executing the diagnostic process.

However, the head units HU may also be configured so as not to be provided with the alert circuit 40. That is to say, the diagnostic circuits 2 may be configured so as not to be provided with the alert circuit 40. In other words, the diagnostic circuits 2 need only be provided at least with the switching circuit 10, the determination circuit 20, and the operation designation circuit 50.

The switching circuit 10 switches between supplying and not supplying, to each of the discharge sections D, the drive signal Com outputted from the control unit 6, on the basis of a variety of signals such as the printing signal SI and a diagnostic control signal Tsig. A more detailed description shall follow, but the diagnostic control signal Tsig is a digital signal that is generated by the control unit 6 and is for controlling the execution of the diagnostic process.

The switching circuit 10 also switches between supplying and not supplying, to the determination circuit 20, the detection signal NSA outputted from the discharge sections D, on the basis of a variety of signal such as the printing signal SI and the diagnostic control signal Tsig. A more detailed description shall follow, but the detection signal NSA is a signal representative of the potential of an electrode of a piezoelectric element PZ with which the discharge sections D are equipped (see FIG. 3).

2. Summary of the Recording Heads and Discharge Sections

The recording heads HD and the discharge sections D provided to the recording heads HD shall now be described with reference to FIGS. 3 and 4.

Figure 3:
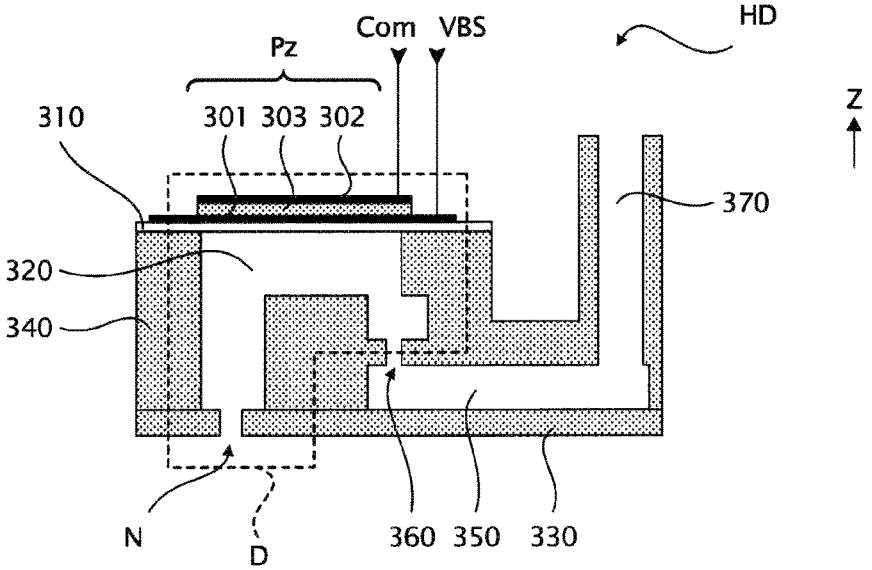
FIG. 3 is a schematic cross-sectional view of a recording head HD.

FIG. 3 illustrates one example of a schematic partial cross-sectional view of a recording head HD. FIG. 3, for convenience of illustration, shows one discharge section D of the M discharge sections D of each of the recording heads HD, a reservoir 350 communicating with the one discharge section D via an ink supply opening 360, and an ink intake opening 370 for supplying the ink to the reservoir 350 from the ink cartridge 31.

As illustrated in FIG. 3, the discharge section D is provided with a piezoelectric element PZ, a cavity 320 (an example of a "pressure chamber") of which the interior is filled with ink, a nozzle N communicating with the cavity 320, and a diaphragm 310. The drive signal Com is supplied to the piezoelectric element PZ and the piezoelectric element PZ is driven by the drive signal Com, whereby the discharge section D discharges the ink inside the cavity 320 out from the nozzle N. The cavity 320 is a space demarcated by a cavity plate 340, a nozzle plate 330 on which the nozzle N is formed, and the diaphragm 310. The cavity 320 communicates with the reservoir 350 via the ink supply opening 360. The reservoir 350 communicates with one ink cartridge 31 via the ink intake opening 370.

In the present embodiment, for example, a unimorph (monomorph) type such as is illustrated in FIG. 3 is employed as the piezoelectric element PZ. The piezoelectric element PZ is not limited to being of the unimorph type, however, and a bimorph type, laminated type, or the like may be used.

The piezoelectric element PZ has an upper electrode 302 (an example of a "first electrode"), a lower electrode 301 (an example of a "second electrode"), and a piezoelectric body 303 provided to between the lower electrode 301 and the upper electrode 302. The lower electrode 301 is electrically connected to a power feeder line Hb (see FIG. 9) that is set to a potential VBS, and the drive signal Com is supplied to the upper electrode 302, whereby, when a voltage is applied to between the lower electrode 301 and the upper electrode 302, the piezoelectric element PZ is displaced in the +Z direction or −Z direction (the +Z direction and the −Z direction are hereinbelow collectively called the "Z-axis direction") in accordance with the voltage applied, thus causing the piezoelectric element PZ to vibrate.

The diaphragm 310 is installed on an upper surface opening of the cavity plate 340. The lower electrode 301 is bonded to the diaphragm 310. For this reason, when the piezoelectric element PZ vibrates due to the drive signal Com, the diaphragm 310 also vibrates. Thus, the vibration of the diaphragm 310 causes the volume of the cavity 320 (and the pressure within the cavity 320) to change, and the ink with which the cavity 320 is filled is discharged out from the nozzle N. If the discharging of the ink has caused there to be a reduced amount of ink inside the cavity 320, then ink is supplied from the reservoir 350. Ink is also supplied to the reservoir 350 from the ink cartridge 31 via the ink intake opening 370.

Figure 4:
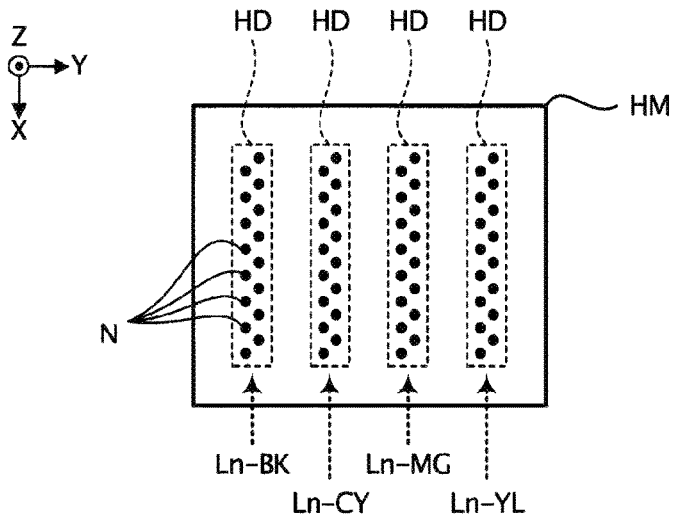
FIG. 4 is a plan view illustrating an example of an arrangement of nozzles N in a head module HM.

FIG. 4 is a descriptive view for describing the four recording heads HD with which the head module HM is equipped and an example of the installation of a total of 4M nozzles N provided to these four recording heads HD when the inkjet printer 1 is seen in plan view from the +Z direction or the −Z direction.

As illustrated in FIG. 4, a plurality of nozzle lines Ln are provided to each of the recording heads HD provided to the head module HM. Herein, a nozzle line Ln refers to a plurality of nozzles N provided so as to extend in the form of a column in a predetermined direction. The present embodiment envisions a case where each of the nozzle lines Ln is configured so as to arrange M nozzles N so as to extend in the form of a column in the X-axis direction. However, in addition to a mode where the constituent elements of a column are strictly lined up over a straight line, the present description assumes the term "column" to also include modes where the constituent elements of a column are lined up with a predetermined width therebetween. The present embodiment also envisions a case where the M nozzles N belonging to each of the nozzle lines Ln have a staggered arrangement so that in each of the nozzle lines Ln, the positions of even-numbered nozzles N and odd-numbered nozzles N, counting from the +X side, in the Y-axis direction are different.

However, the nozzle lines Ln illustrated in FIG. 4 represent an example; the M nozzles N belonging to each of the nozzle lines Ln may be arranged rectilinearly, and each of the nozzle lines Ln may extend in a direction different from the X-axis direction.

Hereinbelow, as illustrated in FIG. 4, the four nozzle lines Ln provided to the head module HM are called nozzle lines Ln-BK, Ln-CY, Ln-MG, and Ln-YL. Herein, the nozzle line Ln-BK is a nozzle line Ln in which the nozzles N of the discharge sections D for discharging the black ink are arrayed, the nozzle line Ln-CY is a nozzle line Ln in which the nozzles N of the discharge sections D for discharging the cyan ink are arrayed, the nozzle line Ln-MG is a nozzle line Ln in which the nozzles N of the discharge sections D for discharging the magenta ink are arrayed, and the nozzle line Ln-YL is a nozzle line Ln in which the nozzles N of the discharge sections D for discharging the yellow ink are arrayed.

The present embodiment illustrates, by way of example, a case where the number of nozzle lines Ln provided to each of the recording heads HD is "1", but two or more nozzle lines Ln may also be provided to each of the recording heads HD.

Figure 5:
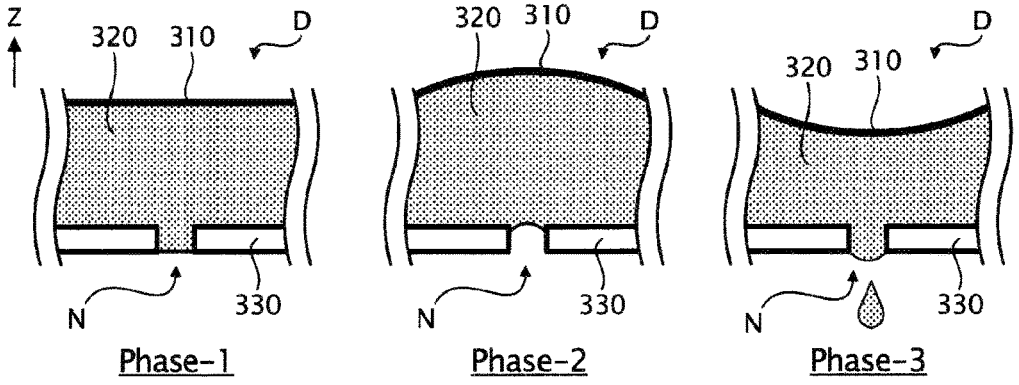
FIG. 5 is a descriptive view illustrating changes in the cross-sectional shape of a discharge section D when a drive signal Com is supplied.

Next, the operation of discharging ink from the discharge sections D shall be described, with reference to FIG. 5.

FIG. 5 is a descriptive view for describing the operation of discharging ink from a discharge section D. As illustrated in FIG. 5, the control unit 6 alters the potential of the drive signal Com supplied to the piezoelectric element PZ provided to the discharge section D, for example, in a Phase 1 state, thereby producing a distortion such that the piezoelectric element PZ is displaced in the +Z direction, and causing the diaphragm 310 of the discharge section D to deflect toward the +Z direction. This, as per the Phase 2 state illustrated in FIG. 5, causes an expansion of the volume of the cavity 320 of the discharge section D as compared to the Phase 1 state. Then, the control unit 6 alters the potential indicated by the drive signal Com, for example, in the Phase 2 state, thereby producing a distortion such that the piezoelectric element PZ is displaced in the −Z direction, and causing the diaphragm 310 of the discharge section D to deflect toward the −Z direction. This, as per the Phase 3 state illustrated in FIG. 5, causes rapidly shrinkage of the volume of the cavity 320, and some of the ink that fills the cavity 320 is discharged as an ink droplet from the nozzle N communicating with the cavity 320.

3. Connections Between the Control Unit and Head Units

The connections between the control unit 6 and the head module HM shall now be described, with reference to FIGS. 6 to 8.

Figure 6:
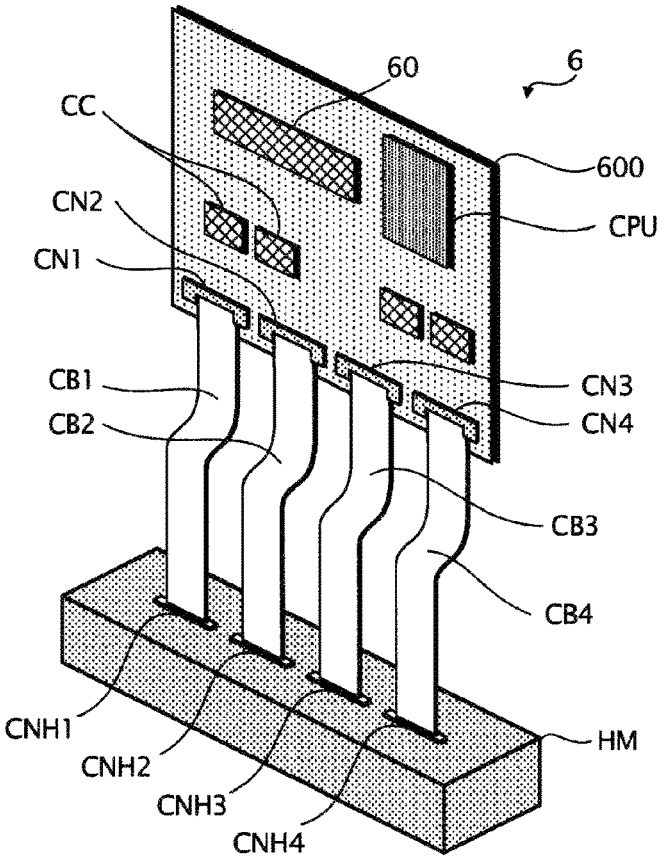
FIG. 6 is a descriptive view for describing connections between a control unit 6 and the head module HM.

FIG. 6 is a descriptive view for describing an example of the connections between the control unit 6 and the head module HM.

As illustrated in FIG. 6, the control unit 6 comprises a substrate 600 and a variety of constituent elements provided to the substrate 600, such as the CPU, the storage unit 60, the variety of other circuits CC, and four connectors CN (CN1 to CN4). As described above, the control unit 6 is provided to the exterior of the carriage 100, and is electrically connected by the four cables CB (CB1 to CB4) to the head module HM that is loaded onto the carriage 100. Specifically, a connector CNk of the control unit 6 and a connector CNHk of the head module HM are electrically connected by a cable CBk (where k is a natural number satisfying $1 \leq k \leq 4$).

Figure 7:
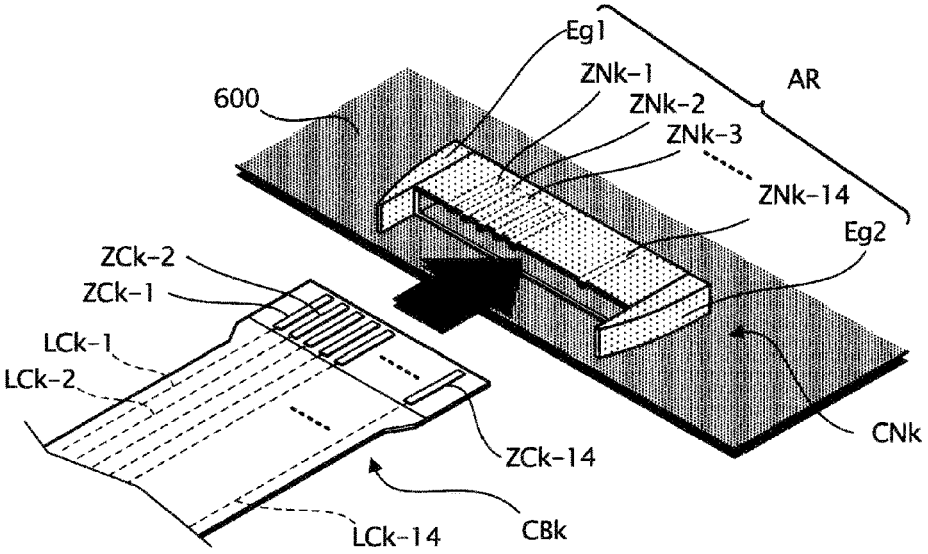
FIG. 7 is a descriptive view for describing a connector CN and a cable CB.

FIG. 7 is a descriptive view for describing the structure of the connectors CN and the structure of the cables CB. Of the four connectors CN1 to CN4 and four cables CB1 to CB4 provided to the inkjet printer 1, FIG. 7 illustrates one connector CNk and the one cable CBk connected to the one connector CNk.

As illustrated in FIG. 7, the connector CNk is provided with at least 14 terminals ZNk-1 to ZNk-14 arrayed between one end Eg1 and another end Eg2 at a terminal array section AR. Also, as illustrated in FIG. 7, the cable CBk comprises at least 14 wirings LCk-1 to LCk-14. When the cable CBk is connected to the connector CNk, the 14 terminals ZNk-1 to ZNk-14 and the 14 wirings LCk-1 to LCk-14 are respectively electrically connected, respectively via terminals ZCk-1 to ZCk-14 of the cable CBk. Specifically, a terminal ZNk-j of the connector CNk and a wiring LCk-j of the cable CBk are electrically connected via a terminal ZCk-j of the cable CBk (where j is a natural number satisfying $1 \leq j \leq 14$). A signal outputted from the terminal ZNk-j will be transmitted to the head module HM via the wiring LCk-j.

FIG. 8 is a drawing illustrating an example of signals inputted/outputted to/from each of the terminals ZNk-j belonging to the connectors CN1 to CN4.

As illustrated in FIG. 8, the control unit 6 outputs signals such as the diagnostic control signal Tsig, the drive signal Com, the printing signal SI, a change signal CH, a clock signal CL, a latch signal LAT, and an N charge signal NCH to the head module HM from the connectors CN1 to CN4. The change signal CH and the latch signal LAT are digital signals for designating a period of time during which to discharge the ink from the discharge section D. The N charge signal NCH is a digital signal for designating supplying the drive signal Com to the M discharge sections of the discharge sections D[1] to D[M] provided to the head units HU, in a case such as where maintenance is being performed on the inkjet printer 1. A more detailed description shall follow, but the change signal CH, the N charge signal NCH, and the like may in some instances play different roles than those described above in the diagnostic process or in the startup process.

Signals such as the detection signal NSA, the alert signal Xh, and a temperature signal HT are inputted from the head units HU to the connectors CN1 to CN4 of the control unit 6. The temperature signal HT is a signal indicative of the temperature of a predetermined place on the head module HM, which is outputted by a temperature detector (not shown) provided to the head module HM. The alert signal XH is a signal indicative of the result of the determination by the determination circuit 20 in the diagnostic process, as described above, but may also be indicative of a detection result of an overheating detection circuit (not shown) provided to each of the head units HU. Herein, an overheating detection circuit refers to a circuit provided to each of the head units HU in order to detect if the temperature of a head unit HU has exceeded a predetermined temperature, resulting in overheating.

In addition, a plurality of terminals ZN set to a certain potential, such as the ground potential GND or a variety of power source potentials, are provided to the connectors CN1 to CN4 of the control unit 6.

The relationships between the signals inputted/outputted to/from the connectors CN1 to CN4 and the like and each of the terminals ZN1-1 to ZN4-14 belonging to the connectors CN1 to CN4 shall now be described more specifically.

As illustrated in FIG. 8, the diagnostic control signal Tsig is outputted from the terminal ZN1-2. The drive signal Com is outputted from the terminals ZN1-5, ZN1-7, ZN2-9, ZN2-11, ZN3-9, ZN3-11, ZN4-5, and ZN4-7. The printing signal SI is outputted from the terminals ZN1-13, ZN2-1, ZN2-3, ZN2-5, ZN3-1, ZN3-3, ZN4-11, and Z4-13. The change signal CH is outputted from the terminal ZN1-9. The clock signal CL is outputted from the terminal ZN1-11. The latch signal LAT is outputted from the terminal ZN2-6. The N charge signal NCH is outputted from the terminal ZN3-6.

In the present embodiment, the control unit 6 supplies the drive signal Com individually to each of the head units HU. Therefore, in FIG. 8, the name "drive signal Com-q" is used for the drive signal Com that is supplied to a head unit HU-1, from among the drive signals Com outputted by the control unit 6. In other words, the control unit 6 supplies drive signals Com-1 to Com-4 to the head module HM. Herein, the drive signals Com-1 to Com-4 may be of the same waveform, or may be of mutually different waveforms.

In the present embodiment, the printing signal SI comprises individual designation signals Sd[1] to Sd[M]. Of these, the individual designation signal Sd[m] designates the mode of driving of the discharge section D[m] in the printing process, and designates whether or not to subject the discharge section D[m] to the diagnosis of the ink discharge capability in the diagnostic process. Hereinbelow, the name "discharge section to be diagnosed D-O[m]" is used in some instances to refer to a discharge section D[m] that has been designated as being subject to diagnosis in the diagnostic process. The present embodiment envisions, by way of example, a case where the individual designation signals Sd[m] are two-bit digital signals.

The control unit 6 as in the present embodiment generates the printing signal SI by differentiating into two signals: a printing signal SI1 comprising the individual designation signals Sd[1] to Sd[M1], corresponding to the discharge sections D[1] to D[M1] of the first through M1-th stages, and a printing signal SI2 comprising the individual designation signals Sd[M1+1] to Sd[M], corresponding to the discharge sections D[M1+1] to D[M] of the (M1+1)-th to M-th stages (in the present embodiment, M1 is a natural number satisfying $1 \leq M1 \leq M-1$). Such a mode, however, is merely one example, and the control unit 6 may generate the printing signals SI1 and SI2 as a single printing signal SI.

In FIG. 8, of the printing signals SI outputted by the control unit 6, the printing signal SI1 supplied to a head unit HU-q is called a printing signal SI1-*q*, and the printing signal SI2 supplied to the head unit HU-q is called a printing signal SI2-*q*.

As illustrated in FIG. 8, the temperature signal HT is inputted to the terminal ZN3-5, the detection signal NSA is inputted to the terminal ZN4-2, and the alert signal Xh is inputted to the terminal ZN4-9. The terminals ZN1-4, ZN1-6, ZN2-8, ZN2-10, ZN3-8, ZN3-10, ZN4-4, and ZN4-6 are set to a potential VBS. The terminal ZN2-7 is set to a potential VHV, which is a high potential-side power source potential of the drive signal Com. The terminal ZN1-8 and the terminal ZN3-7 are set to a potential VDD, which is a high potential-side power source potential for a logic circuit such as the switching circuit 10. Other terminals are set to the ground potential GND.

The potential VHV is a higher potential than the potential VDD. In other words, digital signals for logic circuitry, such as the diagnostic control signal Tsig, are have a smaller amplitude than the analog drive signal Com for driving the discharge sections D.

4. Configuration of the Head Units

The configuration of the head units HU shall now be described with reference to FIG. 9. The description hereinbelow relates by way of example to one head unit HU of the head units HU-1 to HU-4, but the description also applies to the other head units HU.

Figure 9:
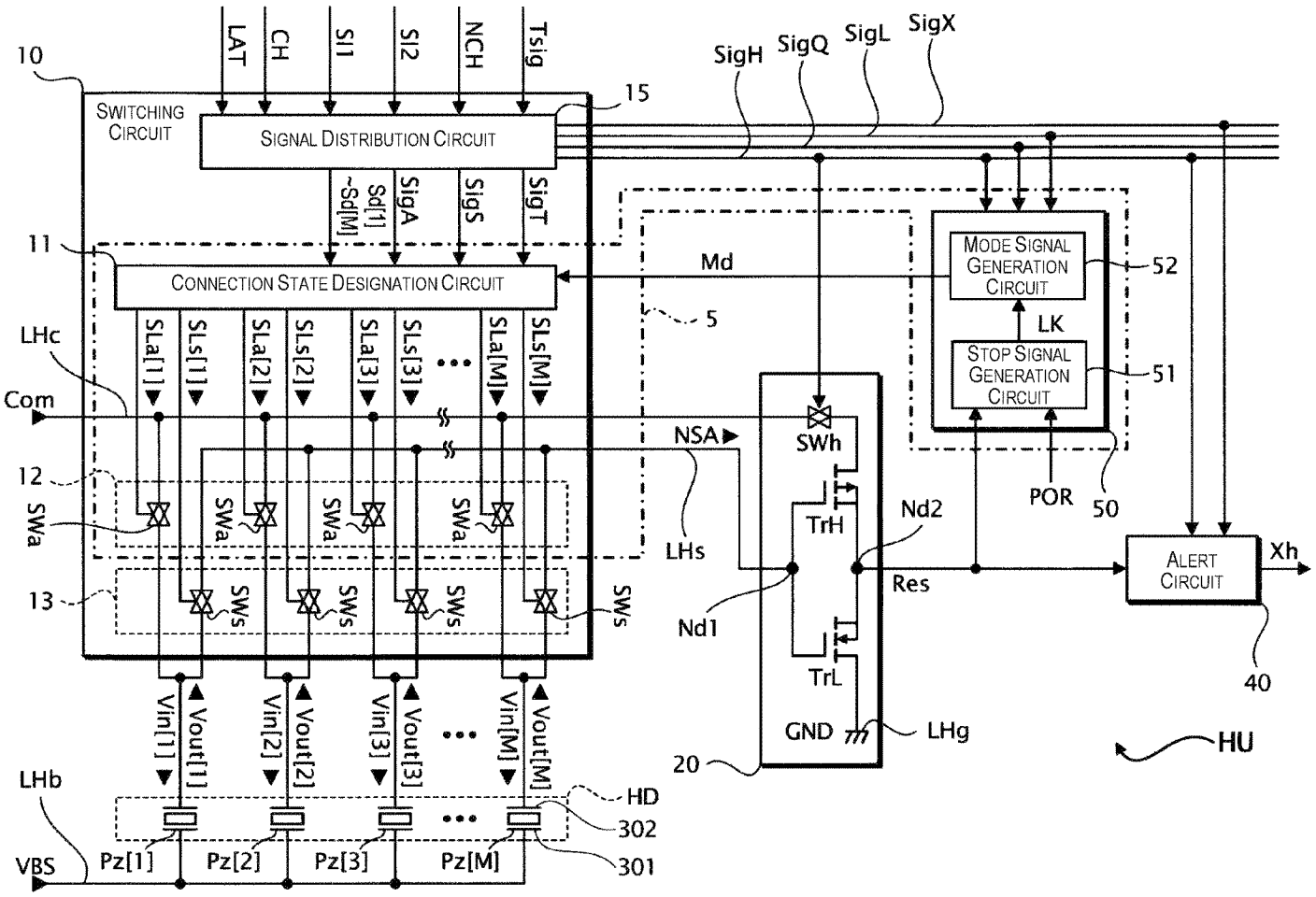
FIG. 9 is a block diagram illustrating the configuration of a head unit HU.

FIG. 9 is a block diagram illustrating one example of the configuration of the head unit HU. As stated above, the head unit HU as in the present embodiment is provided with the recording head HD, the switching circuit 10, the determination circuit 20, the alert circuit 40, and the operation designation circuit 50. The head unit HU is furthermore provided with an internal wiring LHc (an example of a "first wiring") to which the drive signal Com is supplied from the control unit 6 via the connector CNH, an internal wiring LHs (an example of a "second wiring") for supplying the detection signal NSA detected from the discharge sections D to the determination circuit 20, and an internal wiring LHg set to the ground potential GND.

Figure 10A:
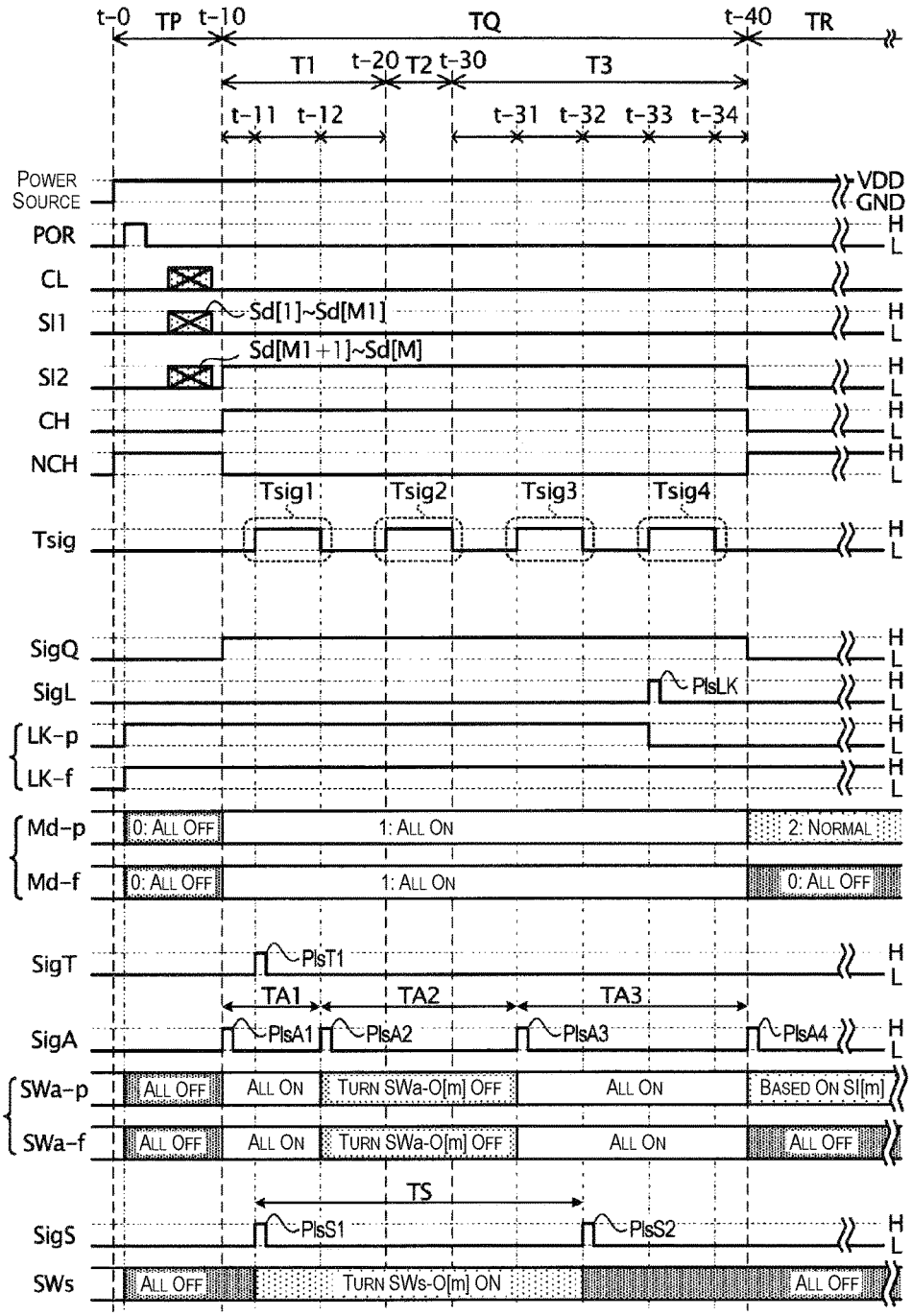
FIG. 10A is a timing chart for describing a startup process and a diagnostic process.
Figure 10B:
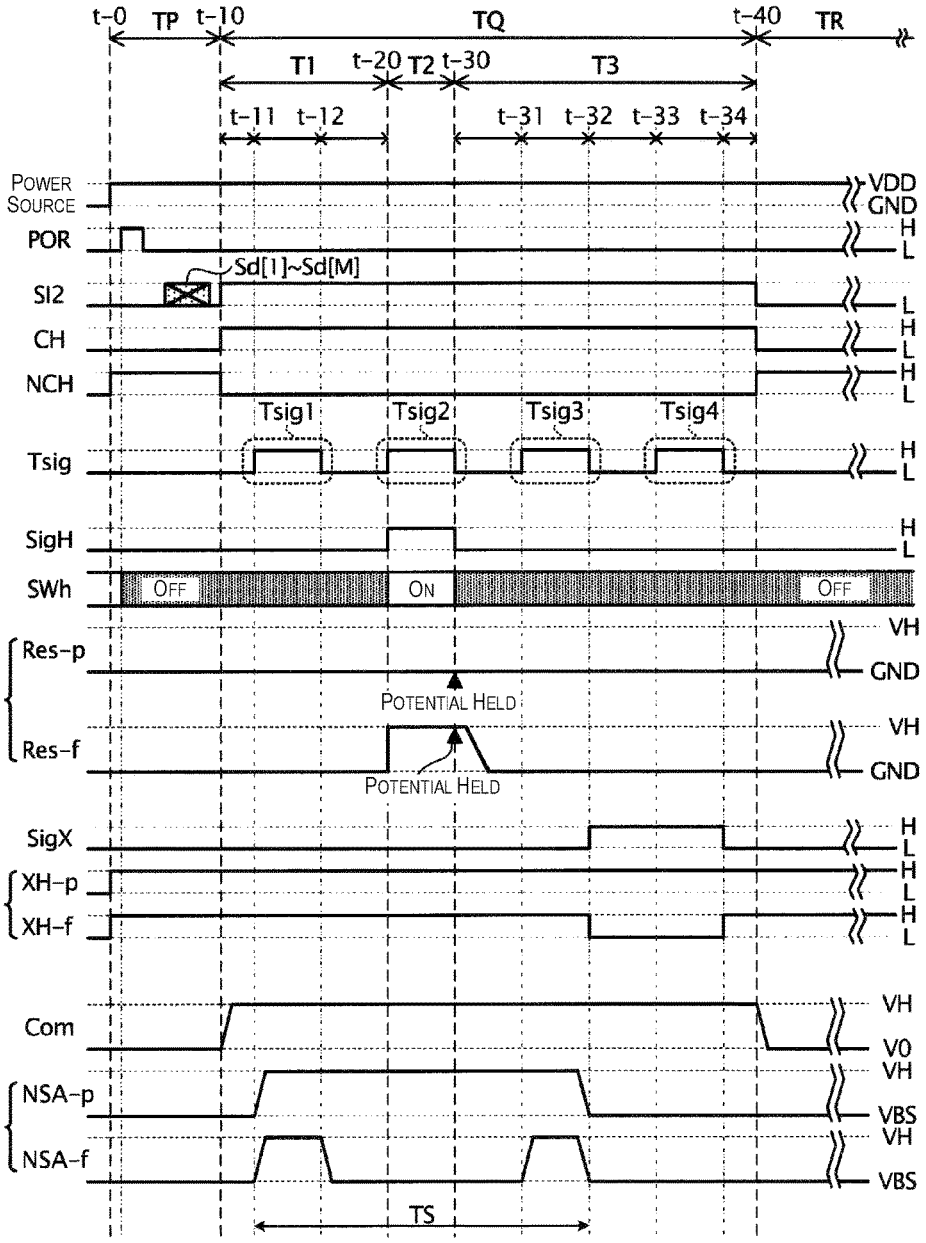
FIG. 10B is a timing chart for describing a startup process and a diagnostic process.

In the present embodiment, the drive signal Com is set to a potential VH (an example of a "predetermined potential") in the period during which the diagnostic process is being executed (see FIG. 10B). The present embodiment assumes that the potential VH is a higher potential than the ground potential GND and the potential VBS, and a lower potential than the potential VHV.

As illustrated in FIG. 9, the switching circuit 10 is provided with: a connection state switching circuit 12 for switching a connection state between the internal wiring LHc and the recording head HD, a connection state switching circuit 13 for switching a connection state between the internal wiring LHs and the recording head HD, a connection state designation circuit 11 for designating the connection states of the connection state switching circuit 12 and the connection state switching circuit 13, and a signal distribution circuit 15 for generating and distributing a signal for controlling each of the parts of the head unit HU on the basis of the variety of signals supplied from the control unit 6.

Of these, the connection state switching circuit 12 is provided with M switches SWa (SWa[1] to SWa[M]) provided so as to have one-to-one correspondence with the M discharge sections D. Of the M switches SWa, the switch SWa[m] of the m-th stage corresponding to the discharge section D[m] of the m-th stage switches between conductivity and non-conductivity between the internal wiring LHc and the upper electrode 302 of the piezoelectric element PZ[m] provided to the discharge section D[m] in accordance with a connection state designation signal SLa[m] outputted by the connection state designation circuit 11. In the present embodiment, a transmission gate is employed as the switch SWa[m].

The connection state switching circuit 13 is provided with M switches SWs (SWs[1] to SWs[M]) provided so as to have one-to-one correspondence with the M discharge sections D. Of the M switches SWs, the switch SWs[m] of the m-th stage corresponding to the discharge section D[m] of the m-th stage switches between conductivity and non-conductivity between the internal wiring LHs and the upper electrode 302 of the piezoelectric element PZ[m] provided to the discharge section D[m] in accordance with a connection state designation signal SLs[m] outputted by the connection state designation circuit 11. In the present embodiment, a transmission gate is employed as the switch SWs [m].

Hereinbelow, in certain instances, the switch SWa[m] provided so as to correspond to the discharge section to be diagnosed D-O[m] is called a switch SWa-O[m] (an example of a "first switch") and the switch SWs[m] provided so as to correspond to the discharge section to be diagnosed D-O[m] is called a switch SWs-O[m] (an example of a "second switch").

The signal distribution circuit 15 supplies the individual designation signals Sd[1] to Sd[M] included in the printing signals SI1 and SI2 to the connection state designation circuit 11 synchronously with the clock signal CL (not shown in FIG. 9).

The signal distribution circuit 15 also generates an enabling signal SigQ in the diagnostic process, on the basis of the printing signal SI, the change signal CH, and the N charge signal NCH. Herein, the enabling signal SigQ refers to a signal for permitting the diagnostic process to be executed in the head unit HU.

During the diagnostic process, the signal distribution circuit 15 also generates a decision signal SigT on the basis of the diagnostic control signal Tsig, generates a designation signal SigA on the basis of the printing signal SI, the change signal CH, or the N charge signal NCH, and the diagnostic control signal Tsig, and generates a designation signal SigS on the basis of the diagnostic control signal Tsig. Herein, the decision signal SigT refers to a signal for deciding whether or not it is proper to control the on/off status of the switches SWa[1] to SWa[M] and the switches SWs[1] to SWsM in accordance with the individual designation signals Sd[1] to Sd[M]. The designation signal SigA is a signal for designating the period of time during which the connection state designation signal SLa[m] is supplied to the switch SWa[m]. The designation signal SigS is a signal for designating the period of time during which the connection state designation signal SLs[m] is supplied to the switch SWs[m].

During the diagnostic process, the signal distribution circuit 15 also generates a designation signal SigH on the basis of the diagnostic control signal Tsig, generates a designation signal SigL on the basis of the diagnostic control signal Tsig, and generates a designation signal SigX on the basis of the diagnostic control signal Tsig. Herein, the designation signal SigH refers to a signal for designating to the determination circuit 20 to execute the determination process. The designation signal SigL refers to a signal for designating a timing for altering the signal level of a stop signal LK (described below). The designation signal SigX refers to a signal for designating a timing for altering the signal level of the alert signal Xh.

In turn, during the printing process, the signal distribution circuit 15 generates the decision signal SigT on the basis of the latch signal LAT, and generates the designation signal SigA on the basis of the latch signal LAT and the change signal CH.

As illustrated in FIG. 9, the connection state designation circuit 11 outputs the connection state designation signals SLa[1] to SLa[M] for designating the connection states of the switches SWa[1] to SWa[M] of the connection state switching circuit 12, and the connection state designation signals SLs[1] to SLs[M] for designating the connection states of the switches SWs[1] to SWs[M] of the connection state switching circuit 13. The switch SWa[m] turns on if the connection state designation signal SLa[m] is high-level, but turns off if the connection state designation signal SLa[m] is low-level. The switch SWs[m] turns on if the connection state designation signal SLs[m] is high-level, but turns off if the connection state designation signal SLs[m] is low-level. The configuration of the connection state designation circuit 11 shall be described below.

The determination circuit 20, as described above, executes the determination process for determining whether or not a discharge section D has the predetermined discharge capability. More specifically, the determination circuit 20 determines whether or not the difference in potential between the potential of the drive signal Com supplied from the internal wiring LHc and the potential of the detection signal NSA supplied from the internal wiring LHs is a predetermined difference in potential or below, as the determination process, and outputs a determination result signal Res indicating the result of this determination.

Herein, the predetermined discharge capability refers to the ability for the piezoelectric element PZ with which the discharge section D is equipped to be displaced in accordance with the drive signal Com, and thereby the capability for the discharge section D to discharge the ink in the mode specified by the drive signal Com. The mode of discharge of ink specified by the drive signal Com refers, for example, to when the discharge section D discharges a quantity of ink that is established by the waveform of the drive signal Com, and discharges the ink at a discharge speed that is established by the waveform of the drive signal Com.

In the present embodiment, if a piezoelectric element PZ has a power storage capability (an example of a "predetermined power storage capability") sufficient to be able to maintain the potential of the upper electrode 302 at a predetermined precision for as long as a predetermined period of time, then the piezoelectric element PZ is regarded as being able to be displaced in accordance with the drive signal Com, and, in this case, the discharge section D is regarded as having the predetermined discharge capability. That is to say, the determination process as in the present embodiment is a process for determining whether or not the piezoelectric element PZ has the predetermined power storage capability. In other words, the diagnostic process as in the present embodiment is a process for diagnosing the power storage capability of the piezoelectric element PZ.

If the piezoelectric element PZ is regarded as having the predetermined power storage capability and the discharge section D is regarded as having the predetermined discharge capability, then the discharge section D is able to discharge ink in the mode specified by the drive signal Com, barring special circumstances such as when the ink dries and clogs the nozzle N.

A state where the discharge section D is unable to discharge the ink in the mode specified by the drive signal Com is called an abnormal discharge. In the present embodiment, for the sake of simplicity, special circumstances such as when the ink dries and clogs the nozzle N are not taken into consideration. Accordingly, in the present embodiment, an abnormal discharge is a state where the piezoelectric element PZ does not have the predetermined power storage capability and the discharge section D does not have the predetermined discharge capability.

The relationship between the capability of the discharge section D to discharge ink and the determination result signal Res shall be described below.

The determination circuit 20, as illustrated in FIG. 9, is provided with a node Nd1 electrically connected to the internal wiring LHs, a node Nd2 (an example of an "output node") for outputting the determination result signal Res, a P-channel transistor TrH (an example of a "first transistor") of which a gate is electrically connected to the node Nd1, an N-channel transistor TrL (an example of a "second transistor") of which a gate is electrically connected to the node Nd1, and a switch SWh (an example of a "third switch") for switching between conductivity and non-conductivity between the transistor TrH and the internal wiring LHc.

In particular, the switch SWh turns on if the designation signal SigH is high-level, but turns off if the designation signal SigH is low-level. An input end of the switch SWh is electrically connected to the internal wiring LHc. The transistor TrH has a source that is electrically connected to an output end of the switch SWh and a drain that is electrically connected to the node Nd2. The transistor TrL has a source that is set to the ground potential GND, and a drain that is electrically connected to the node Nd2.

In the present embodiment, the determination circuit 20 is configured such that the transistors TrH and TrL are not on at the same time. That is to say, with the determination circuit 20, the threshold value voltages and the like of the transistors TrH and TrL are established so as to be able to adopt either a state where one of the transistors TrH or TrL is on or a state where both the transistors TrH and TrL are off.

For example, in a case where the potential of the node Nd1 is substantially the same potential as the potential VH, a state is adopted where the transistor TrH is off and the transistor TrL is on (see FIGS. 11C and 11E, etc.), irrespective of whether the switch SWh is on or off. In this case, the determination result signal Res indicates the ground potential GND, representative of the fact that the determination result in the determination process is affirmative. In other words, the determination result signal Res indicates the ground potential GND if the difference in potential between the potential VH and the potential of the node Nd1 is the predetermined difference in potential or below.

Figure 11A:
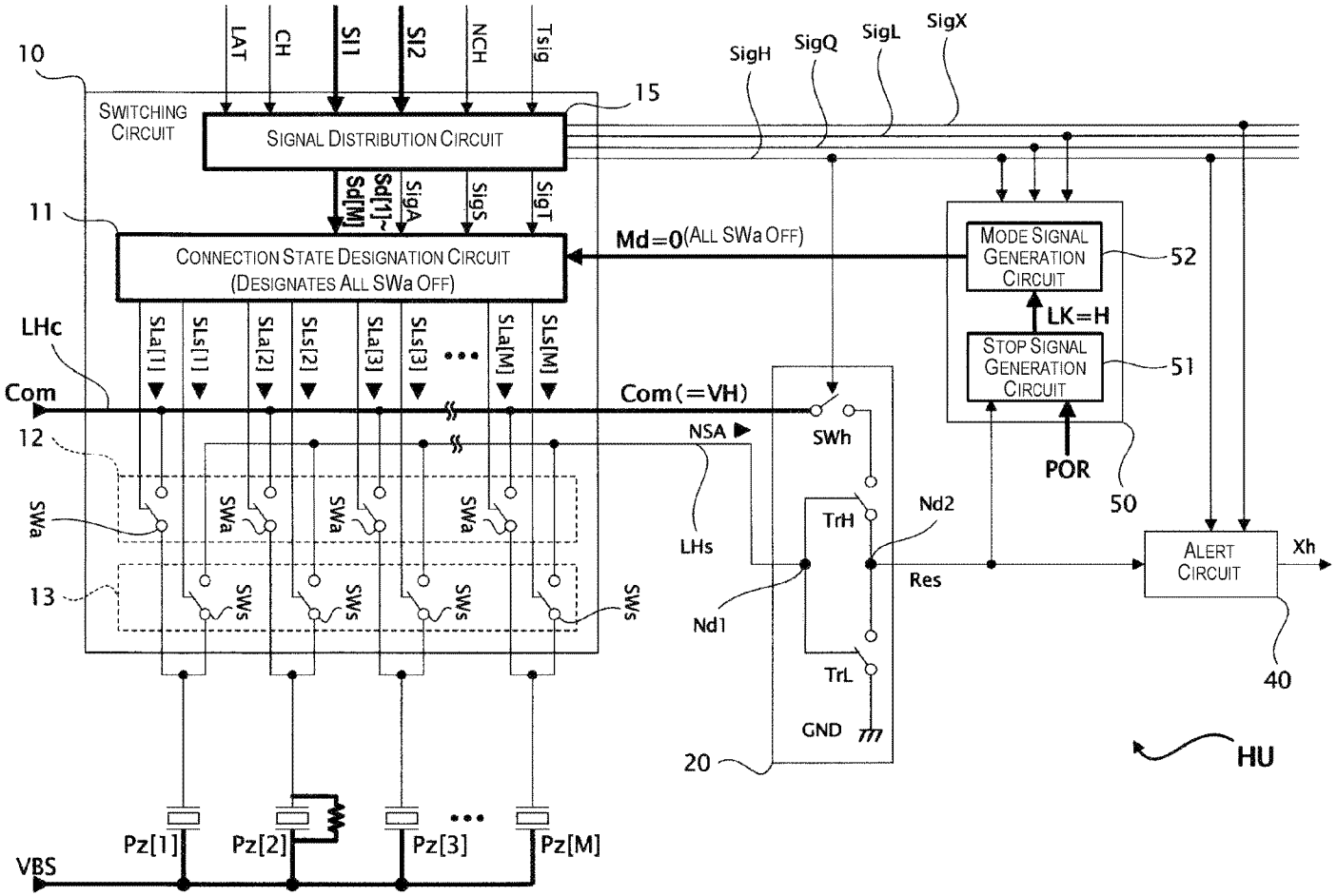
FIG. 11A is a descriptive view for describing a startup process and a diagnostic process.
Figure 11B:
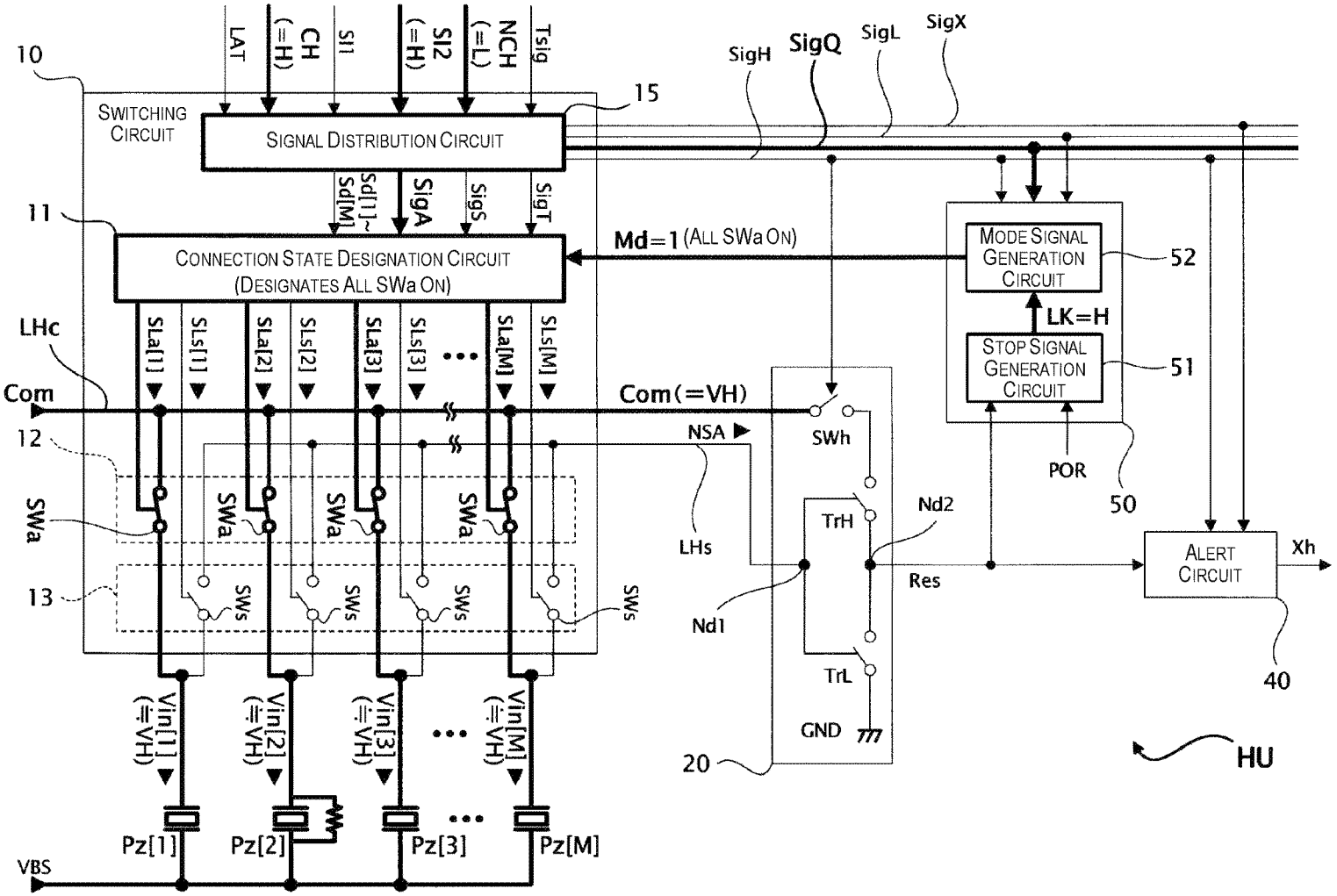
FIG. 11B is a descriptive view for describing a startup process and a diagnostic process.
Figure 11C:
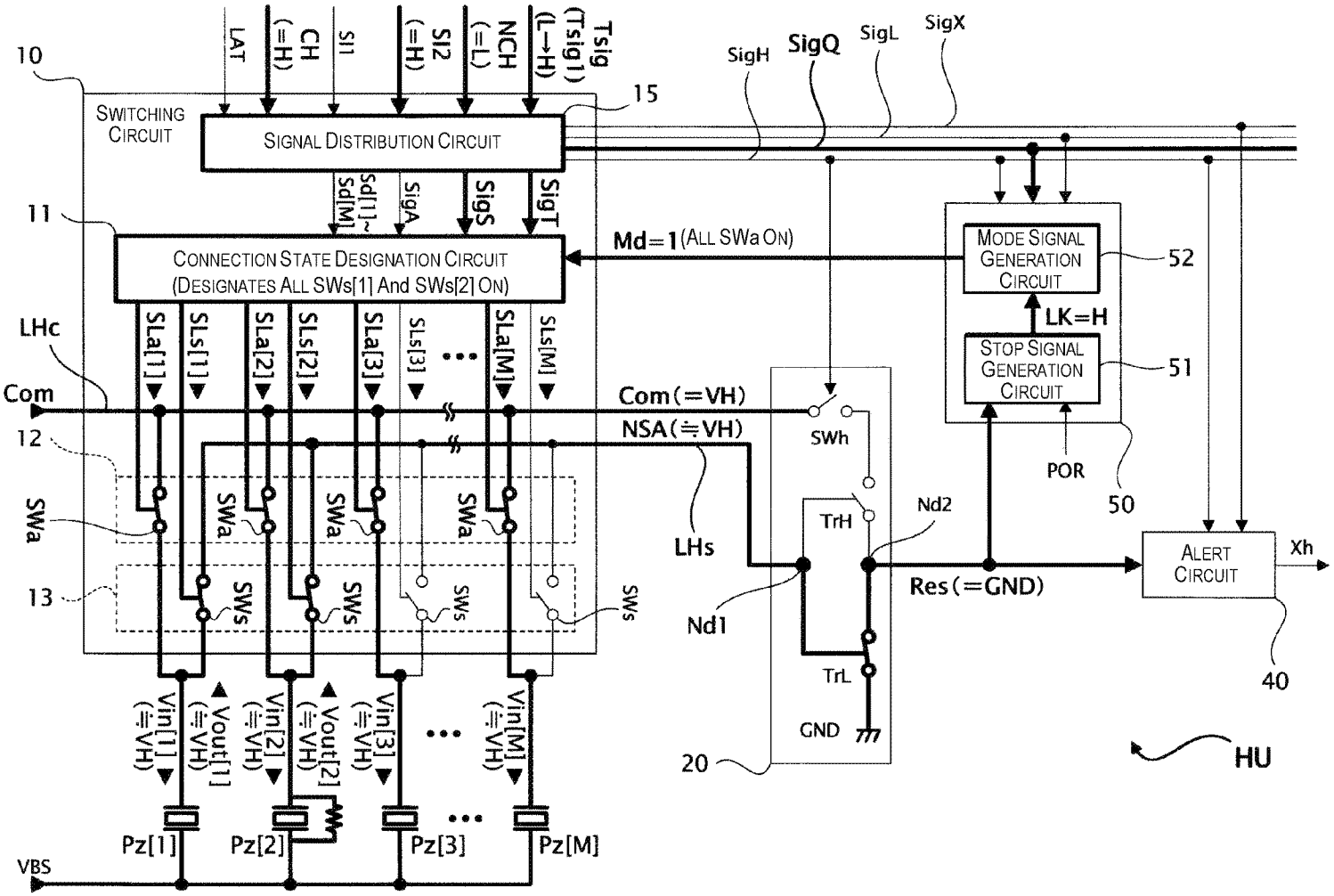
FIG. 11C is a descriptive view for describing a startup process and a diagnostic process.
Figure 11D:
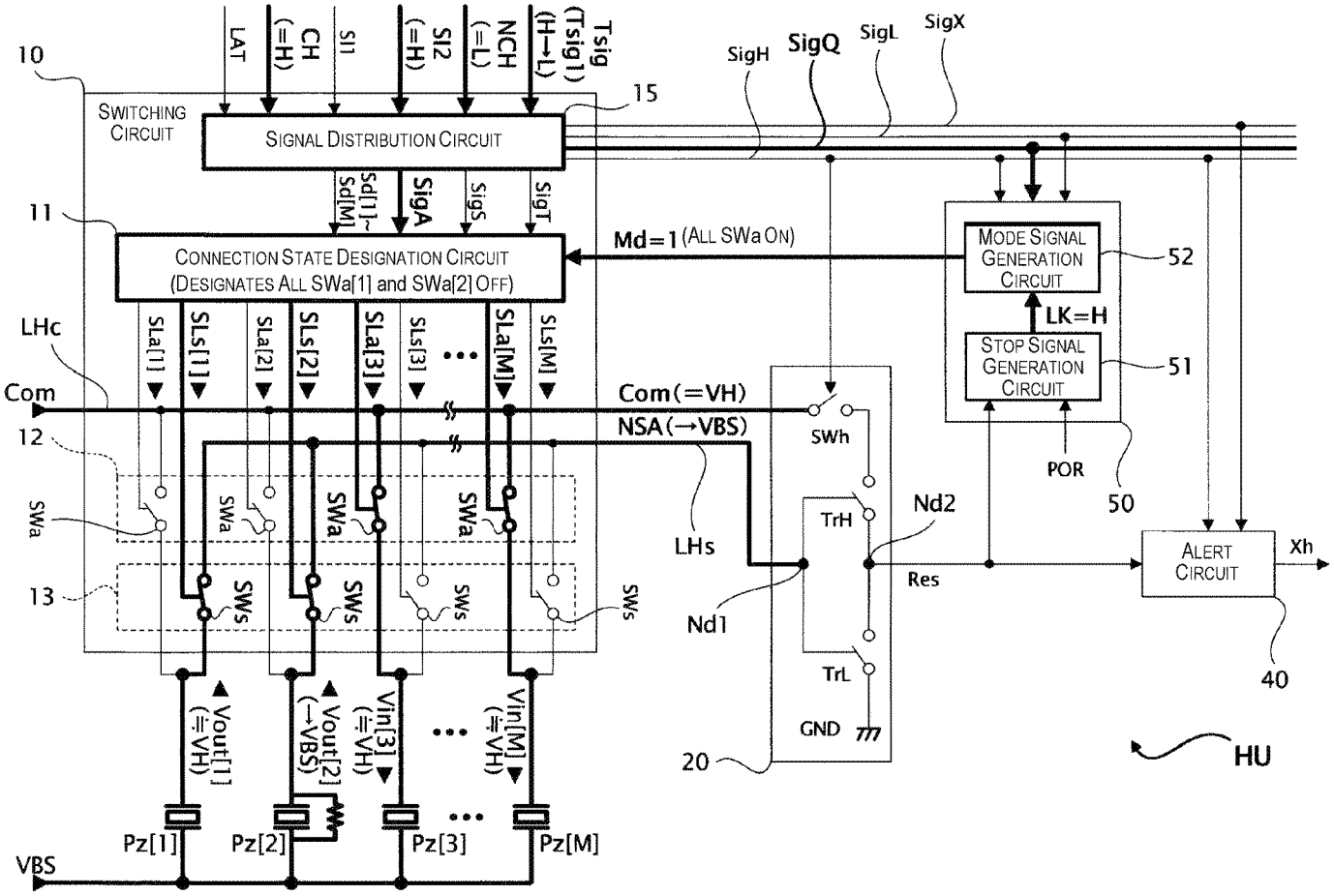
FIG. 11D is a descriptive view for describing a startup process and a diagnostic process.
Figure 11E:
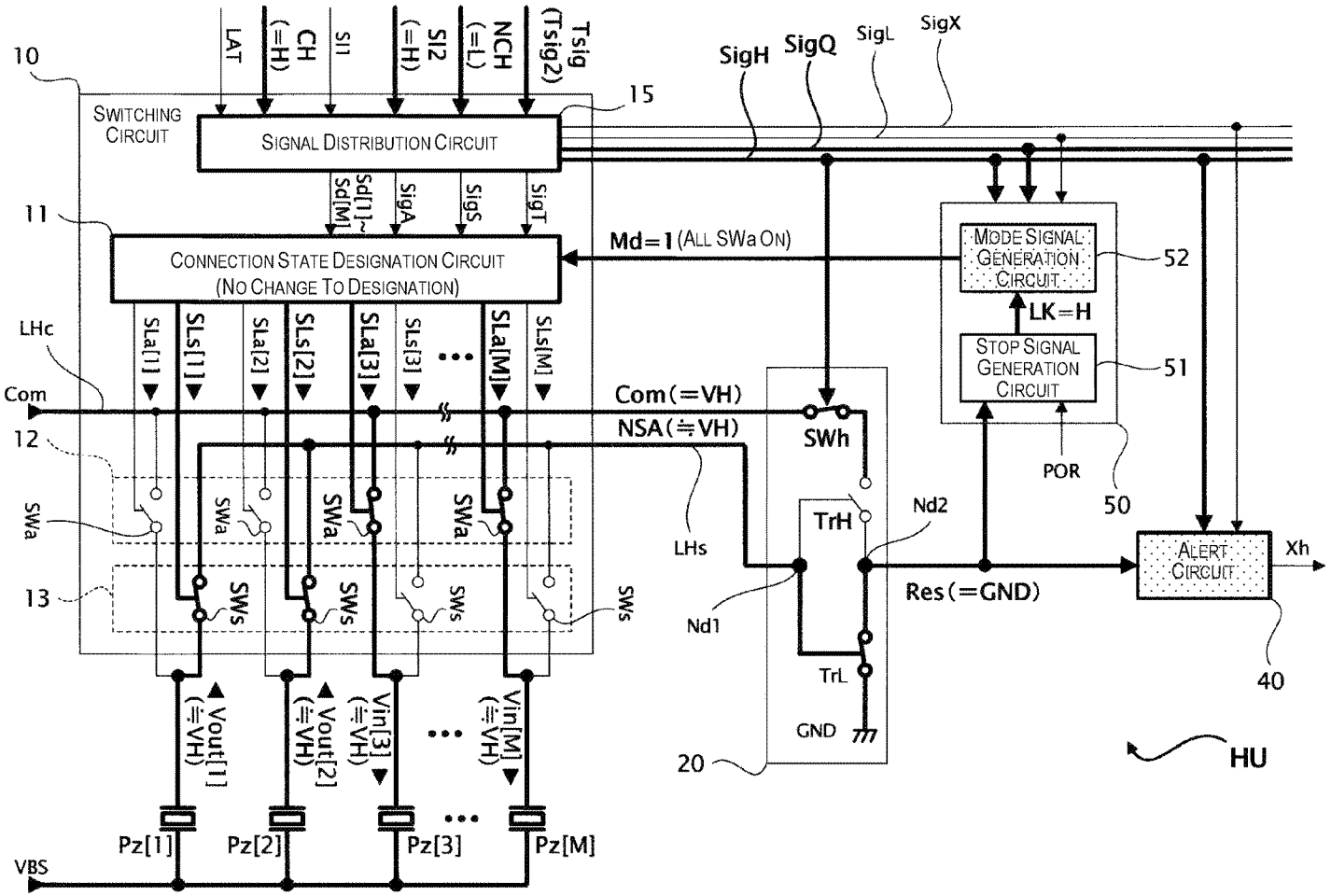
FIG. 11E is a descriptive view for describing a startup process and a diagnostic process.
Figure 11F:
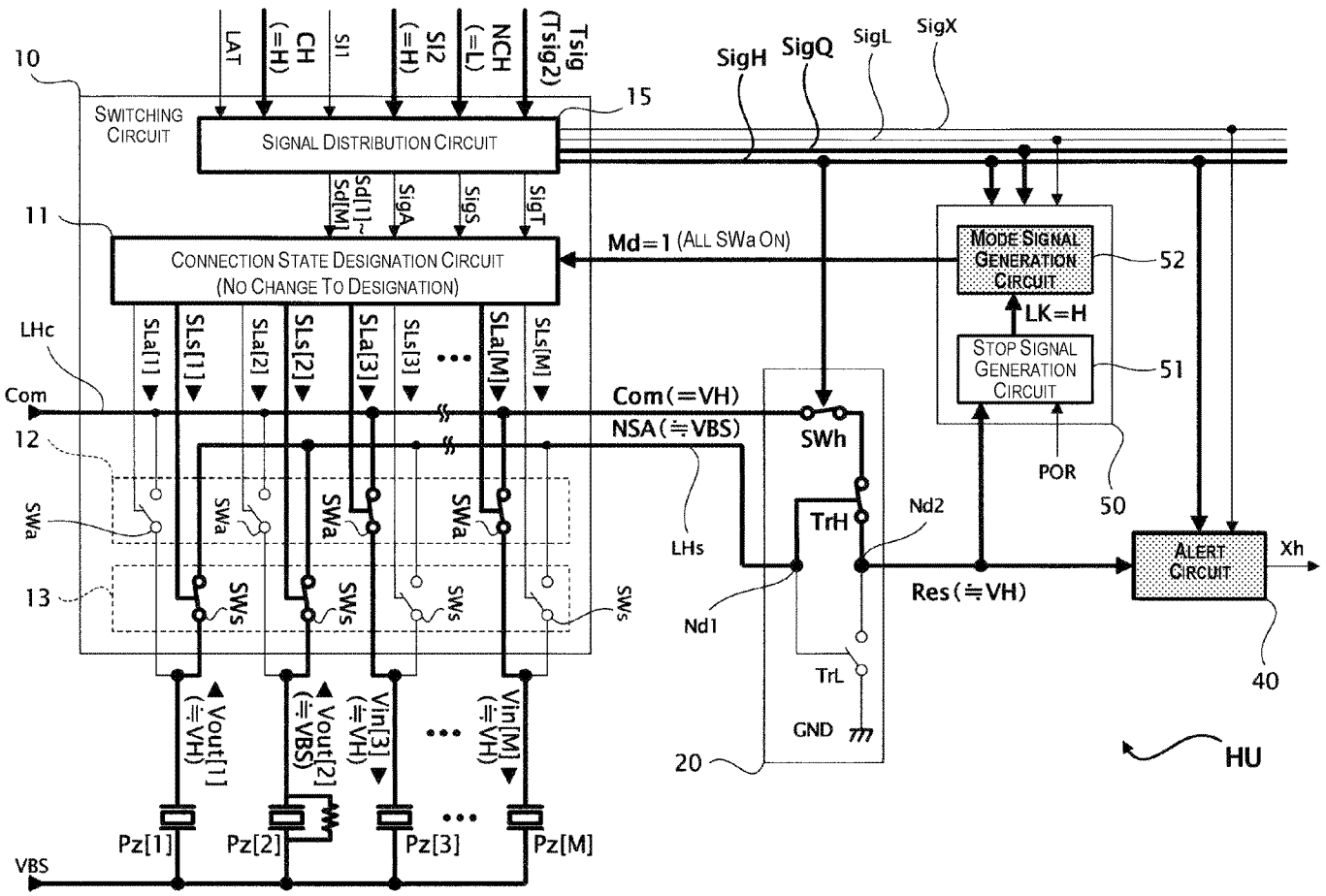
FIG. 11F is a descriptive view for describing a startup process and a diagnostic process.

For example, in a case where the potential of the node Nd1 is closer to the ground potential GND than the potential VH, e.g., is the potential VBS, and where the switch SWh is on and the potential of the drive signal Com is, for example, the potential VH, then a state is adopted where the transistor TrH turns on and the transistor TrL turns off (see FIG. 11F). In this case, the determination result signal Res is the potential VH, representative of the fact that the determination result in the determination process is negative. The present embodiment envisions a case where the difference in potential between the potential VBS and the ground potential GND is smaller than the difference in potential between the potential VH and the ground potential GND. That is to say, in the present embodiment, the ground potential GND is an example of a "first reference potential", and the internal wiring LHg, which is set to the first reference potential, is an example of a "first power feeder line". The potential VBS is an example of a "second reference potential", and the power feeder line LHb, which is set to the second reference potential, is an example of a "second power feeder line".

If, for example, the potential of the node Nd1 is an intermediate potential between the ground potential GND and the potential VH, then a state is adopted where the transistors TrH and TrL are both off (see FIG. 11A).

The determination circuit 20 as in the present embodiment determines whether or not the difference in potential between the potential of the drive signal Com and the potential of the detection signal NSA is the predetermined difference in potential or below, but the present invention is not limited to such an embodiment. For example, a determination may be made as to whether or not a value indicative of the ratio of the difference in potential between the potential of the drive signal Com and the potential of the detection signal NSA to the difference in potential between the potential of the drive signal Com and the potential VBS is a predetermined value or below. For example, the determination circuit 20 may be for determining whether or not the potential of the detection signal NSA and the potential of the drive signal Com are close potentials.

In addition, the determination circuit 20 as in the present embodiment outputs the determination result signal RES indicative of the potential VH of the drive signal Com or the ground potential GND, which is the potential of the internal wiring LHg, depending on whether the transistors TrH and TrL are on or off, but the present invention is not limited to such an embodiment. In terms of the determination result signal Res, the determination circuit 20 need only have a configuration making it possible to output a signal that can take either a value indicating that the determination result in the determination process is affirmative or a value indicating that the determination result in the determination process is negative. For example, the determination result signal Res outputted by the determination circuit 20 may be a signal that is high-level when the determination result in the determination process is affirmative but is low-level when the determination result in the determination process is negative.

If the determination result in the determination process is negative, the alert circuit 40 uses the alert signal Xh to alert the control unit 6 to the determination result in the determination process. If the temperature detected by the overheating detection circuit exceeds the predetermined temperature, then the alert circuit 40 uses the alert signal Xh to alert the control unit 6 to the detection result of the overheating detection circuit.

The operation designation circuit 50 is provided with a stop signal generation circuit 51 for outputting a stop signal LK in accordance with a power-on reset signal (POR signal) or the determination result signal Res, and a mode signal generation circuit 52 for generating the operational mode designation signal Md in accordance with the enabling signal SigQ and the stop signal LK.

Herein, the stop signal LK refers to a signal for requesting that the mode signal generation circuit 52 stops the driving of the discharge sections D[1] to D[M]. The POR signal refers to a signal for initializing the state of the head unit HU when the supply of power to the head unit HU is started and the head unit HU is started up. The operational mode designation signal Md refers to a signal for designating the operational mode of the switching circuit 10, as stated above.

The present embodiment envisions a case where the operational modes of the switching circuit 10 include at least three different operational modes: a supply stop mode for turning off all of the switches SWa[1] to SWa[M], and stopping the supply of the drive signal Com to the discharge sections D[1] to D[M]; a supply mode for turning on all of the switches SWa[1] to SWa[M] and supplying the drive signal Com to the discharge sections D[1] to D[M], except where the individual designation signal Sd designates stopping the supply of the drive signal Com to a discharge section D; and a normal mode for turning on or off each of the switches SWa[1] to SWa[M] in accordance with the designation from the printing signal SI. For descriptive purposes, the following envisions a case where the operational mode designation signal Md is a signal that can take any of three values: "0", a value for designating the supply stop mode as the operational mode of the switching circuit 10; "1" a value for designating the supply mode; or "2", a value for designating the normal mode.

Thus, the operation designation circuit 50, the connection state designation circuit 11, and the connection state switching circuit 12 generate the operational mode designation signal Md in accordance with the determination result signal Res and generate the connection state designation signals SLa[1] to SLa[M] in accordance with the operational mode designation signal Md, whereby the on or off status of the switches SWa[1] to SWa[M] is controlled. If the result of the determination process executed in the determination circuit 20 is negative, then the operation designation circuit 50, the connection state designation circuit 11, and the connection state switching circuit 12 turn the switches SWa[1] to SWa[M] off and thereby stop the supply of the drive signal Com to the piezoelectric elements PZ[1] to PZ[M], thus stopping the driving of the discharge sections D and limiting the discharging of ink from the discharge sections D. That is to say, the operation designation circuit 50, the connection state designation circuit 11, and the connection state switching circuit 12 function as the discharge limitation circuit 5 for limiting the discharging of the ink from the discharge sections D by stopping the supply of the drive signal Com to the piezoelectric elements PZ if the result of the determination process executed in the determination circuit 20 is negative.

The process for limiting the discharging of the ink from the discharge sections D if the result of the determination process executed in the determination circuit 20 is negative may be called a discharge limitation process in some instances.

5. Operation of the Head Units in the Startup Process and Diagnostic Process

A summary of the operation of the head units HU in the startup process and the diagnostic process shall now be described with reference to FIGS. 10A to 11J.

FIGS. 10A and 10B are timing charts for describing the operation of the head units HU in a case where the inkjet printer 1 is powered on and the startup process and the diagnostic process are executed. FIGS. 11A to 11J are descriptive views for describing the operation of the head units HU in each of the periods of time illustrated in FIGS. 10A and 10B.

With the inkjet printer 1 as in the present embodiment, as stated above, the startup process and the diagnostic process are executed after the inkjet printer 1 has been powered on, and thereafter the printing process is executed if the result obtained in the diagnostic process is that the discharge sections D have the predetermined discharge capability, i.e., if the determination result in the determination process is affirmative. If, however, the result obtained in the diagnostic process is that the discharge sections D do not have the predetermined discharge capability (an example of a "predetermined result"), i.e., if the determination result in the determination process is negative, then execution of the printing process is prohibited.

Hereinbelow, as illustrated in FIGS. 10A and 10B, the period from the time t-0 to the time t-10 where the startup process is executed is called a startup period TP; the period from the time t-10 to the time t-40 where the diagnostic process is executed is called a diagnostic period TQ; and the period from the time t-40, when the diagnostic process is concluded, onward is called a normal operation period TR. Of the diagnostic period TQ, a period from the time t-10 to the time t-20 where the determination preparation process is executed is called a determination preparation process period T1; a period from the time t-20 to the time t-30 where the determination process is executed is called a determination period T2; and a period from the time t-30 to the time t-40 where the determination result response process is executed is called a determination result response period T3.

In FIGS. 10A and 10B, for descriptive purposes, the suffix "-p" has been added to the reference signs representative of the various signals or constituent elements for if the result of the determination in the determination process is assumed to be affirmative, and the suffix "-f" has been added to the reference signs representative of the various signals or constituent elements for if the result of the determination in the determination process is assumed to be negative.

5.1. Summary of the Various Signals

First, a summary of the various signals supplied to the head unit HU by the control unit 6 and a summary of the various signals generated by the head unit HU in the startup process and in the diagnostic process shall be described with reference to FIGS. 10A to 10C.

As illustrated in FIG. 10A, the head unit HU sets the POR signal to high-level during a partial period of the startup period TP.

As illustrated in FIG. 10A, the control unit 6 outputs the individual designation signals Sd[I] to Sd[M] synchronously with the clock signal CL, as the printing signal SI, in a part of the startup period TP after which the POR signal has fell down to the low-level. More specifically, the control unit 6 outputs the individual designation signals Sd[1] to Sd[M1] as the printing signal SI1, and outputs the individual designation signals Sd[M1+1] to Sd[M] as the printing signal SI2. The control unit 6 sets the printing signal SI1 to low-level in the period other than the period where the individual designation signals Sd are outputted. The control unit 6 sets the printing signal SI2 to low-level in the startup period other than the period where the individual designation signals Sd are outputted, but to high-level during the diagnostic period TQ, and down to low-level at the end time t-40 for the diagnostic period TQ. The control unit 6 sets the change signal CH to low-level during the startup period TP, to high-level during the diagnostic period TQ, and down to low-level at the end time t-40 for the diagnostic period TQ. The control unit 6 sets the N charge signal NCH to high-level during the startup period TP, to low-level during the diagnostic period TQ, and up to high-level at the end time t-40 for the diagnostic period TQ.

That is to say, the control unit 6 specifies the diagnostic period TQ by setting three signal levels, which are the printing signal SI2, the change signal CH, and the N charge signal NCH, to high-level, high-level, and low-level, respectively. The manner in which the diagnostic period TQ is specified by the three signals as per the present embodiment is one example, and the present invention is in no way limited to such an embodiment. The control unit 6 need only specify the diagnostic period TQ by using at least two signals. For example, the control unit 6 may specify the diagnostic period TQ by setting the printing signal S12 to high-level and setting the N charge signal NCH to low-level.

As illustrated in FIG. 10A, the control unit 6 specifies the times t-11, t-12, t-20, t-30, t-31, t-32, t-33, and t-34 by changing the signal level of the diagnostic control signal Tsig. Specifically, the control unit 6 sets the diagnostic control signal Tsig to high-level in the period of the diagnostic period TQ from the time t-11 to the time t-12, in the determination period T2 from the time t-20 to the time t-30, in the period from the time t-31 to the time t-32, and in the period from the time t-33 to the time t-34, but sets the diagnostic control signal Tsig to low-level during other periods. A portion of the diagnostic control signal Tsig involving a waveform that is high-level at the time t-11 and low-level at the time t-12 is called a control waveform signal Tsig1. A portion involving a waveform that is high-level at the time t-20 and low-level at the time t-30 is called a control waveform signal Tsig2. A portion involving a waveform that is high-level at the time t-31 and low-level at the time t-32 is called a control waveform signal Tsig3. A portion involving a waveform that is high-level at the time t-33 and low-level at the time t-34 is called a control waveform signal Tsig4.

As illustrated in FIG. 10A, the signal distribution circuit 15 as in the present embodiment sets the enabling signal SigQ to high-level if the printing signal S12 is high-level, the change signal CH is high-level, and the N charge signal NCH is low-level, but otherwise sets the enabling signal SigQ to low-level. Thus, the enabling signal SigQ as in the present embodiment is set to high-level only during the diagnostic period TQ, which is the period where the diagnostic process is executed, and is set to the low-level during the startup period TP and the normal operation period TR, which are periods where the diagnostic process is not executed. However, the enabling signal SigQ illustrated in FIG. 10A is one example, and the enabling signal SigQ may have any waveform whatsoever, provided that the signal makes it possible to announce the start and end of the diagnostic period TQ. For example, the enabling signal SigQ may, as illustrated in FIG. 10C, be a signal that has a pulse PlsQ1 that rises to high-level at the timing where the diagnostic period TQ is started, and a pulse PlsQ2 that rises to high-level at the timing where the diagnostic period TQ is ended.

The signal distribution circuit 15 as in the present embodiment also sets, for the designation signal SigL, a pulse PlsLK that rises to high-level at the timing where the control waveform signal Tsig4 is started. That is to say, the designation signal SigL as in the present embodiment has a pulse PlsLK that rises to high-level at the time t-33. However, the designation signal SigL illustrated in FIG. 10A is one example, and the designation signal SigL may have any waveform whatsoever, provided that the signal makes it possible to announce the timing where the control waveform signal Tsig4 is started. For example, as illustrated in FIG. 10, the designation signal SigL may have a waveform that rises to high-level at a time earlier than the time t-33, and falls to low-level at the time t-33.

As illustrated in FIG. 10A, the stop signal generation circuit 51 raises the stop signal LK to high-level at the timing where the POR signal rises to high-level. In the present embodiment, the stop signal LK, when high-level, is a signal for requesting that the mode signal generation circuit 52 stop the driving of the discharge sections D[1] to D[M].

Thereafter, the stop signal generation circuit 51 sets the stop signal LK to high-level from the time when the POR signal rises until the time t-33 where notice is provided by the designation signal SigL, and sets the stop signal LK to a signal level corresponding to the determination result in the determination process at the time t-33 onward. Specifically, as illustrated in FIG. 10A, the stop signal generation circuit 51 as in the present embodiment lowers the stop signal LK to low-level at the timing where the pulse PlsLK of the designation signal SigL rises to high-level if the determination result in the determination process is affirmative, and maintains the stop signal LK at high-level if the determination result in the determination process is negative.

The mode signal generation circuit 52 sets "0," which the value designating the supply stop mode, for the operational mode designation signal Md during the startup period TP, and sets "1," which is the value designating the supply mode, during the diagnostic period TQ. During the normal operation period TR, the value corresponding to the determination result in the determination process is set; specifically, "2," which is the value designating the normal mode, is set if the determination result is affirmative, and "0," which is the value designating the supply stop mode, is set if the determination result is negative.

Specifically, as illustrated in FIG. 10A, the mode signal generation circuit 52 as in the present embodiment sets "1," which is the value designating the supply mode, for the operational mode designation signal Md if the enabling signal SigQ has been set to high-level, sets "0," which is the value designating the supply stop mode, for the operational mode designation signal Md if the enabling signal SigQ has been set to low-level and the stop signal LK has been set to high-level, and sets "2," which is the value designating the normal mode, for the operational mode designation signal Md if the enabling signal SigQ has been set to low-level and the stop signal LK has been set to low-level.

As illustrated in FIG. 10A, the signal distribution circuit 15 sets, for the decision signal SigT, a pulse PlsT1 that rises to high-level at the timing where the control waveform signal Tsig1 is started. That is to say, the decision signal SigT has a pulse PlsT1 that rises to high-level at the time t-11.

The connection state designation circuit 11, in response to being supplied with the pulse PlsT1 as the decision signal SigT, decides to "control the on/off status of the switches SWa and SWs on the basis of the individual designation signals Sd[1] to Sd[M]", and thereby decides to "subject to diagnosis a discharge section to be diagnosed D-O[m] designated by the individual designation signals Sd[1] to Sd[M]".

Figure 10C:
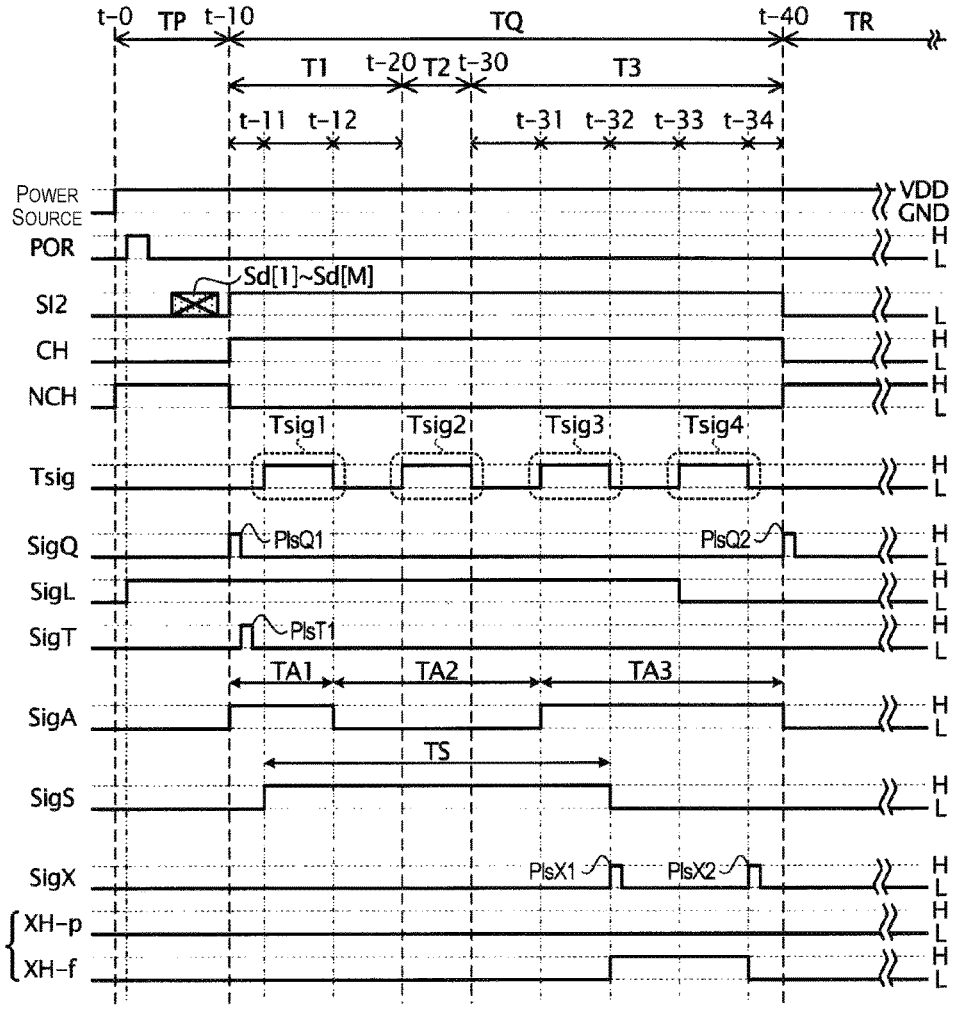
FIG. 10C is a timing chart for describing a startup process and a diagnostic process.

The pulse PlsT1 illustrated in FIG. 10A is one example, however; for example, the pulse PlsT1 may be a waveform that rises to high-level at any timing from the time t-10 to the time t-11, such as is illustrated in FIG. 10C.

As illustrated in FIG. 10A, for the designation signal SigA, the signal distribution circuit 15: sets a pulse PlsA1 that rises to high-level at a timing where the printing signal SI2 rises to high-level, the change signal CH rises to high-level, and the N charge signal NCH falls to low-level; sets a pulse PlsA2 that rises to high-level at the timing where the control waveform signal Tsig1 ends; sets a pulse PlsA3 that rises to high-level at the timing where the control waveform signal Tsig3 starts; and sets a pulse PlsA4 that rises to high-level for the designation signal SigA at a timing where the printing signal SI2 falls to low-level, the change signal CH falls to low-level, and the N charge signal NCH rises to high-level. That is to say, the designation signal SigA has a pulse PlsA1 that rises to high-level at the time t-10, a pulse PlsA2 that rises to high-level at the time t-12, a pulse PlsA3 that rises to high-level at the time t-31, and a pulse PlsA4 that rises to high-level at the time t-40. The designation signal SigA uses the pulses PlsA1 to PlsA4 to specify a control period TA1 from the time t-10 to the time t-12, a control period TA2 from the time t-12 to the time t-31, and a control period TA3 from the time t-31 to the time t-40. Herein, each of the control periods TA (TA1 to TA3) is a period where each of the switches SWa maintains one connection state (either on or off).

The designation signal SigA illustrated in FIG. 10A is one example, however; the designation signal SigA may be any signal, provided that the control periods TA1 to TA3 can be specified. For example, the designation signal SigA may, as illustrated in FIG. 10C, be a signal that specifies the control periods TA1 to TA3 by becoming high-level in the control period TA1, becoming low-level in the control period TA2, and becoming high-level in the control period TA3, or the like.

The connection state designation circuit 11 generates the connection state designation signals SLa[1] to SLa[M] for controlling the on/off status of the switches SWa[1] to SWa[M] on the basis of at least some of the signals from among the operational mode designation signal Md, the individual designation signals Sd[1] to Sd[M], the designation signal SigA, and the decision signal SigT.

Specifically, the connection state designation circuit 11 sets the connection state designation signals SLa[1] to SLa[M] to low-level so as to turn off the switches SWa[1] to SWa[M] if the operational mode designation signal Md indicates the value "0" designating the supply stop mode, as illustrated in FIG. 10A.

The connection state designation circuit 11 sets the signal levels of the connection state designation signals SLa[1] to SLa[M] to signal levels corresponding to the individual designation signals Sd[1] to Sd[M] so that the switches SWa[1] to SWa[M] turn on or off in accordance with the individual designation signals Sd[1] to Sd[M] if the operational mode designation signal Md indicates the value "2" designating the normal mode. The relationship between the individual designation signal Sd[m] and the connection state designation signal SLa[m] where the printing process is being executed shall be described below.

The connection state designation circuit 11 sets the connection state designation signals SLa[1] to SLa[M] to high-level so as to turn on the switches SWa[1] to SWa[M] in the control period TA1 and the control period TA3, of the diagnostic period TQ where the operational mode designation signal Md indicates the value "1" designating the supply mode.

The connection state designation circuit 11 sets the signal levels of the connection state designation signals SLa[1] to SLa[M] to signal levels corresponding to the individual designation signals Sd[1] to Sd[M] so that the switches SWa[1] to SWa[M] turn on or off in accordance with the individual designation signals Sd[1] to Sd[M] supplied to the connection state designation circuit 11 during the rising of the pulse PlsT1 in the control period TA2, of the diagnostic period TQ where the operational mode designation signal Md indicates the value "1" designating the supply mode. Specifically, the connection state designation circuit 11 sets the connection state designation signal SLa[m] to low-level so that the switch SWa[m] (SWa-O[m]) turns off in the control period TA2 if the individual designation signal Sd[m] designates the discharge section D[m] as being subject to diagnosis. Also, the connection state designation circuit 11 sets the connection state designation signal SLa[m] to high-level so that the switch SWa[m] turns on in the control period TA2 if the individual designation signal Sd[m] does not designate the discharge section D[m] as being subject to diagnosis. In other words, the connection state designation circuit 11 sets the signal level of the connection state designation signal SLa[m] so that during the control period TA2, only the switch SWa-O[m] is off, and the other switches SWa are on.

The present invention is not limited to such an embodiment, however, and the connection state designation circuit 11 may also cause all of the switches SWa[1] to SWa[M] to be off during the control period TA2.

As illustrated in FIG. 10A, the signal distribution circuit 15 sets, for the designation signal SigS, a pulse PlsS1 that rises to high-level at the timing where the control waveform signal Tsig1 is started, and sets a pulse PlsS2 that rises to high-level at a timing where the control waveform signal Tsig3 ends. That is to say, the designation signal SigS has a pulse PlsS1 that rises to high-level at the time t-11, and a pulse PlsS2 that rises to high-level at the time t-32. The designation signal SigS uses the pulses PlsS1 and PlsS2 to specify a control period TS from the time t-11 to the time t-32. Herein, the control period TS is a period where each of the switches SWs maintains one connection state (either on or off).

The designation signal SigS illustrated in FIG. 10A is one example, however; the designation signal SigS may be any signal, provided that the control period TS can be specified. For example, the designation signal SigS may, as illustrated in FIG. 10C, be a signal that specifies the control period TS by becoming high-level in the control period TS and becoming low-level in periods other than the control period TS.

The connection state designation circuit 11 generates the connection state designation signals SLs[1] to SLs[M] for controlling the on/off status of the switches SWs[I] to SWs[M] on the basis of at least some of the signals from among the individual designation signals Sd[1] to Sd[M], the designation signal SigS, and the decision signal SigT.

Specifically, the connection state designation circuit 11 sets the connection state designation signals SLs[1] to SLs[M] to low-level so as to turn off the switches SWs[1] to SWs[M] during periods other than the control period TS, as illustrated in FIG. 10A.

The connection state designation circuit 11 sets the signal levels of the connection state designation signals SLs[1] to SLs[M] to signal levels corresponding to the individual designation signals Sd[1] to Sd[M] so that the switches SWs[1] to SWs[M] turn on or off in accordance with the individual designation signals Sd[1] to Sd[M] supplied to the connection state designation circuit 11 during the rising of the pulse PlsT1, in the control period TS, which is started by the rising of the pulse PlsS1. Specifically, the connection state designation circuit 11 sets the connection state designation signal SLs[m] to high-level so that the switch SWs [m] (SWs-O[m]) turns on in the control period TS if the individual designation signal Sd[m] designates the discharge section D[m] as being subject to diagnosis. Also, the connection state designation circuit 11 sets the connection state designation signal SLs[m] to low-level so that the switch SWs[m] turns off in the control period TS if the individual designation signal Sd[m] does not designate the discharge section D[m] as being subject to diagnosis. In other words, the connection state designation circuit 11 sets the signal level of the connection state designation signal SLs[m] so that during the control period TS, only the switch SWs-O[m] is on.

As illustrated in FIG. 10B, the signal distribution circuit 15 sets the designation signal SigH to low-level during the time after the startup of the inkjet printer 1 until the control waveform signal Tsig2 is started, the signal rising to high-level at the timing where the control waveform signal Tsig2 is started and falling to low-level at the timing where the control waveform signal Tsig2 is ended. That is to say, the designation signal SigH is set to high-level in the determination period T2 from the time t-20 to the time t-30, and is set to low-level in periods other than the determination period T2. Therefore, the switch SWh of the determination circuit 20 is on during the determination period T2 where the designation signal SigH is high-level, and is off during periods other than the determination period T2.

The alert circuit 40 and the stop signal generation circuit 51 retain the potential of the determination result signal Res outputted by the determination circuit 20 at a predetermined timing during the determination period T2. In other words, the alert circuit 40 and the stop signal generation circuit 51 retain the potential of the determination result signal Res outputted by the determination circuit 20 at a predetermined timing during the determination period T2. In the present embodiment, the predetermined timing refers to the latest timing within the period where the control waveform signal Tsig2 is high-level, i.e., the time t-30. However, the present invention is in no way limited to such an embodiment, and the predetermined timing at which the alert circuit 40 and the stop signal generation circuit 51 retain the potential of the determination result signal Res need only be included in the time from the time t-20 and the time t-30. Though the present embodiment envisions a case where the alert circuit 40 and the stop signal generation circuit 51 retain the potential of the determination result signal Res at the predetermined timing in the determination period T2, the present invention is in no way limited to such an embodiment, and the alert circuit 40 and the stop signal generation circuit 51 need only retain a potential or value that is representative of the result of the determination in the determination process. For example, the alert circuit 40 and the stop signal generation circuit 51 may retain a logical state corresponding to the potential of the determination result signal Res at the predetermined timing in the determination period r2. For example, the alert circuit 40 and the stop signal generation circuit 51 may retain a value indicating that the determination result is affirmative if the determination result signal Res indicates that the determination result in the determination process is affirmative, but retain a value indicating that the determination result is negative if the determination result signal Res indicates that the determination result in the determination process is negative. The signal level of the determination result signal Res outputted by the determination circuit 20 shall be described below.

The signal distribution circuit 15 sets the designation signal SigX to high-level during the period from the time t-32 to the time t-34. Specifically; as illustrated in FIG. 10B, the signal distribution circuit 15 as in the present embodiment sets the designation signal SigX to low-level during the time after the startup of the inkjet printer 1 until the control waveform signal Tsig3 ends, the signal rising to high-level at the timing where the control waveform signal Tsig3 ends and falling to low-level at the timing where the control waveform signal Tsig4 ends. However, the designation signal SigX illustrated in FIG. 10B is one example, and the designation signal SigX may have any waveform whatsoever, provided that the signal makes it possible to announce the timing at which the control waveform signal Tsig3 ends and the timing at which the control waveform signal Tsig 4 ends. For example, the designation signal SigX may, as illustrated in FIG. 10C, be a signal that has a pulse PlsX1 that rises to high-level at the timing where the control waveform signal Tsig3 ends, and a pulse PlsX2 that rises to high-level at the timing where the control waveform signal Tsig4 ends.

The alert circuit 40 sets the alert signal Xh to a signal level corresponding to the determination result during the period from the time t-32 to the time t-34, and sets the alert signal Xh to high-level, except where the temperature detected by the overheating detection circuit exceeds the predetermined temperature, during periods other than the period from the time t-32 to the period t-34.

Specifically, as illustrated in FIG. 10B, the alert circuit 40 as in the present embodiment raises the alert signal Xh to high-level at the timing where the POR signal rises to high-level. Thereafter, if the determination result in the determination process is negative, the alert circuit 40 lowers the alert signal Xh to low-level at the timing where the designation signal SigX rises to high-level, and again raises the alert signal Xh to high-level at the timing where the designation signal SigX falls to low-level. The alert circuit 40 sets the alert signal Xh to low-level if the temperature detected by the overheating detection circuit exceeds the predetermined temperature. In turn, the alert circuit 40 maintains the alert signal Xh at high-level if the determination result in the determination process is affirmative, except where the temperature detected by the overheating detection circuit exceeds the predetermined temperature.

The alert signal Xh illustrated in FIG. 10B is one example, however, and the alert signal Xh may have any waveform whatsoever, provided that the potential of the signal during the period from the time t-32 to the time t-34 is set to a potential that is different from the potential during periods other than the period from the time t-32 to the time t-34 if the determination result in the determination process is negative. For example, as illustrated in FIG. 10C, the signal may be high-level during the period from the time t-32 to the time t-34 if the determination result is negative, but otherwise be low-level.

As illustrated in FIG. 10B, the control unit 6 raises the drive signal Com to the potential VH from the potential V0, which is a lower potential than the potential VH, at the time t-10 where the diagnostic period TQ is started. The control unit 6 sets the drive signal Com to the potential VH during the diagnostic period, and lowers the drive signal Com to the potential V0 at the time t-40 where the diagnostic period TQ ends.

The waveform of the drive signal Com illustrated in FIG. 10B is one example, however, and the drive signal Com need only have a waveform that is set to a constant potential different from the potential VBS during at least the period from a timing earlier than the time t-11 until a timing that comes after the time t-30. In this case, the potential of the drive signal Com need only be such a potential that the determination process is effectively executed in the determination circuit 20. For example, in this case, the potential of the drive signal Com need only be a potential that is established so that, at least, the difference in potential between the potential of the drive signal Com and the potential VBS is greater than the predetermined difference in potential.

The signal level of the detection signal NSA inputted to the determination circuit 20 shall be described below.

5.2. Operation of the Head Units

A summary of the operation of the head units HU shall now be described, with reference to FIGS. 11A to 11J. In FIGS. 11A to 11J, thicker lines or the like are used to emphasize the indication of constituent elements or signals to which particular attention should be paid, in each of the periods.

FIG. 11A is a descriptive view for describing the operation of a head unit HU during the startup period TP from the time t-0 to the time t-10. The inkjet printer 1 executes the startup process during the startup period TP when the inkjet printer 1 is powered on at the time t-0. Then, when the startup process is started, the inkjet printer 1 starts the supply of power to the head unit HU.

As illustrated in FIG. 11A, the stop signal generation circuit 51 raises the stop signal LK to high-level when the POR signal rises to high-level during the startup process. Also, during the startup period TP, the enabling signal SigQ is set to low-level. Accordingly, the mode signal generation circuit 52 sets the operational mode designation signal Md to "0", the value designating the supply stop mode Therefore, the connection state designation circuit 11 sets the connection state designation signals SLa[1] to SLa[M] to low-level and turns the switches SWa[1] to SWa[M] off during the startup process. Also, the connection state designation circuit 11 sets the connection state designation signals SLs[1] to SLs[M] to low-level and turns the switches SWs[1] to SWs[M] off during the startup process.

The signal distribution circuit 15 supplies the individual designation signals Sd[1] to Sd[M] included in the printing signals SI1 and SI2, which are supplied from the control unit 6 during the startup process, to the connection state designation circuit 11 synchronously with the clock signal CL. The example illustrated in FIGS. 11A to 11J envisions a case where the discharge sections D[1] and D[2] are designated as discharge sections to be diagnosed D-O that are subject to diagnosis in the diagnostic process.

FIG. 11B is a descriptive view for describing the operation of the head unit HU during the period from the time t-10 to the time t-11 within the determination preparation process period T1 during which the determination preparation process is executed, out of the diagnostic period TQ where the diagnostic process is executed.

At the time t-10 where the determination preparation process is started, the control unit 6 raises the printing signal SI2 to high-level, raises the change signal CH to high-level, and lowers the N charge signal NCH to low-level. Therefore, at the time t-10, the signal distribution circuit 15 raises the enabling signal SigQ to high-level, and also sets the pulse PlsA1 for the designation signal SigA, thus starting the control period TA1.

The mode signal generation circuit 52 sets the operational mode designation signal Md to "1", the value designating the supply mode, when the enabling signal SigQ rises to high-level. Thus, the connection state designation circuit 11 sets the connection state designation signals SLa[1] to SLa[M] to high-level and turns the switches SWa[1] to SWa[M] on, thereby electrically connecting the internal wiring LHc and the upper electrodes 302 of each of the piezoelectric elements PZ[1] to PZ[M].

The control unit 6 sets the drive signal Com to the potential VH during the diagnostic period TQ. Thus, the upper electrodes 302 of each of the piezoelectric elements PZ[1] to PZ[M] are set to the potential VH. Hereinbelow, of the drive signals Com, the drive signal Com supplied to the piezoelectric element PZ[m] is in some instances called a supplied drive signal Vin[m].

Also, the connection state designation circuit 11 sets the connection state designation signals SLs[1] to SLs[M] to low-level and turns the switches SWs[1] to SWs[M] off prior to the start of the control period TS.

FIG. 11C is a descriptive view for describing the operation of the head unit HU during the period from the time t-11 to the time t-12, during which the control waveform signal Tsig1 is supplied, out of the determination preparation process period T1 during which the determination preparation process is executed.

The control unit 6 raises the control waveform signal Tsig1 to high-level at the time t-11. Therefore, the signal distribution circuit 15 sets the pulse PlsT1 for the decision signal SigT at the time t-11, deciding that "a discharge section to be diagnosed D-O designated by the individual designation signals Sd[1] to Sd[M] is subject to diagnosis", and sets the pulse PlsS1 for the designation signal SigS at the time t-11 to start the control period TS. Thus, at the time t-11, the connection state designation circuit 11 sets the connection state designation signals SLs[1] and SLs[2] to high-level and turns on the switches SWs[1] and SWs[2] corresponding to the discharge sections D[1] and D[2] that have been decided to be discharge sections to be diagnosed D-O, and sets the connection state designation signals SLs [3] to SLs[M] to low-level and maintains the off state of the switches SWs[3] to SWs[M] corresponding to the discharge sections D[3] to D[M] that are not discharge sections to be diagnosed D-O. Thus, the upper electrodes 302 of each of the piezoelectric elements PZ[1] and PZ[2] and the internal wiring LHs are electrically connected. Accordingly, the detection signal NSA supplied to the internal wiring LHs becomes substantially the same potential as the drive signal Com, i.e., becomes substantially the same potential as the potential WI. Of the detection signals NSA, the detection signal NSA detected from the piezoelectric element PZ[m] is called an individual detection signal Vout[m].

Of the determination preparation process period T1, the period from the time t-11 to the time t-12 may, in some particular instances, be called the "preparation period", and the control waveform signal Tsig1 specifying this preparation period may in some instances be called the "preparation signal".

FIG. 11D is a descriptive view for describing the operation of the head unit HU during the period from the time t-12 to the time t-20, out of the determination preparation process period T1 during which the determination preparation process is executed.

The control unit 6 lowers the control waveform signal Tsig1 to low-level at the time t-12. Therefore, at the time t-12, the signal distribution circuit 15 sets the pulse PlsA2 for the designation signal SigA, thus starting the control period TA2. Thus, at the time t-12, the connection state designation circuit 11 sets the connection state designation signals SLa[1] and SLa[2] to low-level and turns off the switches SWa[1] and SWa[2] corresponding to the discharge sections D[1] and D[2] that have been decided to be discharge sections to be diagnosed D-O, and maintains the connection state designation signals SLa[3] to SLa[M] at high-level and maintains the on state of the switches SWa[3] to SWa[M] corresponding to the discharge sections D[3] to D[M] that are not discharge sections to be diagnosed D-O. Thus, the upper electrodes 302 of each of the piezoelectric elements PZ[1] and PZ[2] and the internal wiring LHc are electrically disconnected.

If the piezoelectric element PZ[m] has the predetermined power storage capability, then the piezoelectric element functions as a holding capacitor, and even after the upper electrode 302 of the piezoelectric element PZ[m] and the internal wiring LHc are electrically disconnected, the potential of the upper electrode 302 of the piezoelectric element PZ[m] is maintained at substantially the same potential as the potential VH of the drive signal COM supplied from the internal wiring LHc. Accordingly, in FIG. 11D, if the piezoelectric elements PZ[1] and PZ[2] both have the predetermined power storage capability, then the potentials of each of the upper electrodes 302 of the piezoelectric elements PZ[1] and PZ[2] shall be maintained at substantially the same potential as the potential VH of the drive signal Com. In such a case, the potential of the detection signal NSA outputted to the internal wiring LHs shall also be substantially the same potential as the potential VH.

However, if there exists leakage path where a current of a predetermined magnitude or greater flows between the upper electrode 302 and the lower electrode 301 of the piezoelectric element PZ[m], such as if the upper electrode 302 and the lower electrode 301 of the piezoelectric element PZ[m] have short-circuited, as illustrated by way of example in the piezoelectric element PZ[2] in FIG. 11D, then the piezoelectric element PZ[m] does not have the predetermined power storage capability and does not function as a holding capacitor. Then, if the piezoelectric element PZ[m] of the discharge section D[m] designated as subject to diagnosis as a discharge section to be diagnosed D-O does not have the predetermined power storage capability, then the potential of the upper electrode 302 of the piezoelectric element PZ[m], despite having been set to the potential VH at the time t-12, changes from the potential VH so as to approach the potential VBS, which is the potential of the power feeder line LHb, at the time t-12 onward. In this case, the potential of the detection signal NSA outputted to the internal wiring LHs also changes from the potential VH toward the potential VBS at the time t-12 onward.

FIGS. 11E and 11F are descriptive views for describing the operation of the head unit HU during the determination period T2, from the time t-20 to the time t-30, during which the control waveform signal Tsig2 is supplied and the determination process is executed. Of these, FIG. 11E illustrates the operation of the head unit HU in a case where the determination result in the determination process is affirmative, and FIG. 11F illustrates the operation of the head unit HU in a case where the determination result in the determination process is negative.

The control unit 6 raises the control waveform signal Tsig2 to high-level at the time t-20, and lowers the control waveform signal Tsig2 to low-level at the time t-30. Therefore, the signal distribution circuit 15 raises the designation signal SigH to high-level at the time t-20, and lowers the designation signal SigH to low-level at the time t-30. Thus, the switch SWh of the determination circuit 20 is on at the time t-20 and is off at the time t-30. The alert circuit 40 and the stop signal generation circuit 51 hold the potential of the determination result signal Res outputted from the determination circuit 20 at the time t-30.

Strictly speaking, the alert circuit 40 and the stop signal generation circuit 51 hold the potential of the determination result signal Res during the period where the switch SWh is on. Therefore, strictly speaking, the switch SWh preferably turns off after the alert circuit 40 and the operation designation circuit 50 have held the potential of the determination result signal Res at the time t-30. FIG. 10B, for convenience of depiction, does not distinguish between the rendering of the time at which the alert circuit 40 and the operation designation circuit 50 hold the potential of the determination result signal Res and the timing at which the switch SWh turns off.

The determination result signal Res outputted by the determination circuit 20 has a potential corresponding to the potential of the detection signal NSA supplied to the node Nd1.

Specifically, as illustrated by way of example in FIG. 11E, if all of the discharge sections D designated as discharge sections to be diagnosed D-O are equipped with piezoelectric elements PZ that have the predetermined power storage capability, then the potential of the detection signal NSA at the time t-30 will be substantially the same potential as the potential VH, which is the potential of the drive signal Com. In this case, the transistor TrL turns on, and the transistor TrH turns off. Accordingly, in this case, the potential of the determination result signal Res at the time t-30 will be the ground potential GND. That is to say, a case where the determination result signal Res exhibits the ground potential GND indicates that the determination result in the determination process is affirmative, and the result obtained in the diagnostic process would be that the discharge sections D have the predetermined discharge capability.

As illustrated by way of example in FIG. 11F, if there exists a discharge section D equipped with a piezoelectric element PZ that does not have the predetermined power storage capability among the discharge sections D designated as discharge sections to be diagnosed D-O, then the potential of the detection signal NSA at the time t-30 will be a different potential than the potential of the drive signal Com, e.g., substantially the same potential as the potential VBS. In this case, the transistor TrH turns on, and the transistor TrL turns off. Accordingly, in this case, the potential of the determination result signal Res at the time t-30 will be the potential VH. That is to say, a case where the determination result signal Res exhibits the potential VH indicates that the determination result in the determination process is negative, and the result obtained in the diagnostic process would be that a discharge section D does not have the predetermined discharge capability (the predetermined result).

Therefore, the alert circuit 40 and the stop signal generation circuit 51 hold the ground potential GND as the potential of the determination result signal Res if all of the discharge sections to be diagnosed D-O are equipped with piezoelectric elements PZ that have the predetermined power storage capability (FIG. 11E), and hold the potential VH as the potential of the determination result signal Res if even one of the discharge sections to be diagnosed D-O is equipped with a piezoelectric element PZ that does not have the predetermined power storage capability (FIG. 11F).

In other words, if the determination result in the determination process is affirmative and the piezoelectric elements PZ have the predetermined power storage capability, then the potential of the determination result signal Res held by the alert circuit 40 and the stop signal generation circuit 51 will be the ground potential GND; if the determination result in the determination process is negative and a piezoelectric element PZ does not have the predetermined power storage capability, then the potential of the determination result signal Res held by the alert circuit 40 and the stop signal generation circuit 51 will be the potential VH.

Thus, during the period where the control waveform signal Tsig2 is being supplied from the control unit 6, the head unit HU executes the determination process, in which a determination is made as to whether or not the discharge sections to be diagnosed D-O have the predetermined discharge capability and the determination result signal Res indicative of the determination result is generated. In other words, the control waveform signal Tsig2 is one example of an instruction signal instructing the head unit HU to execute the determination process.

Figure 11G:
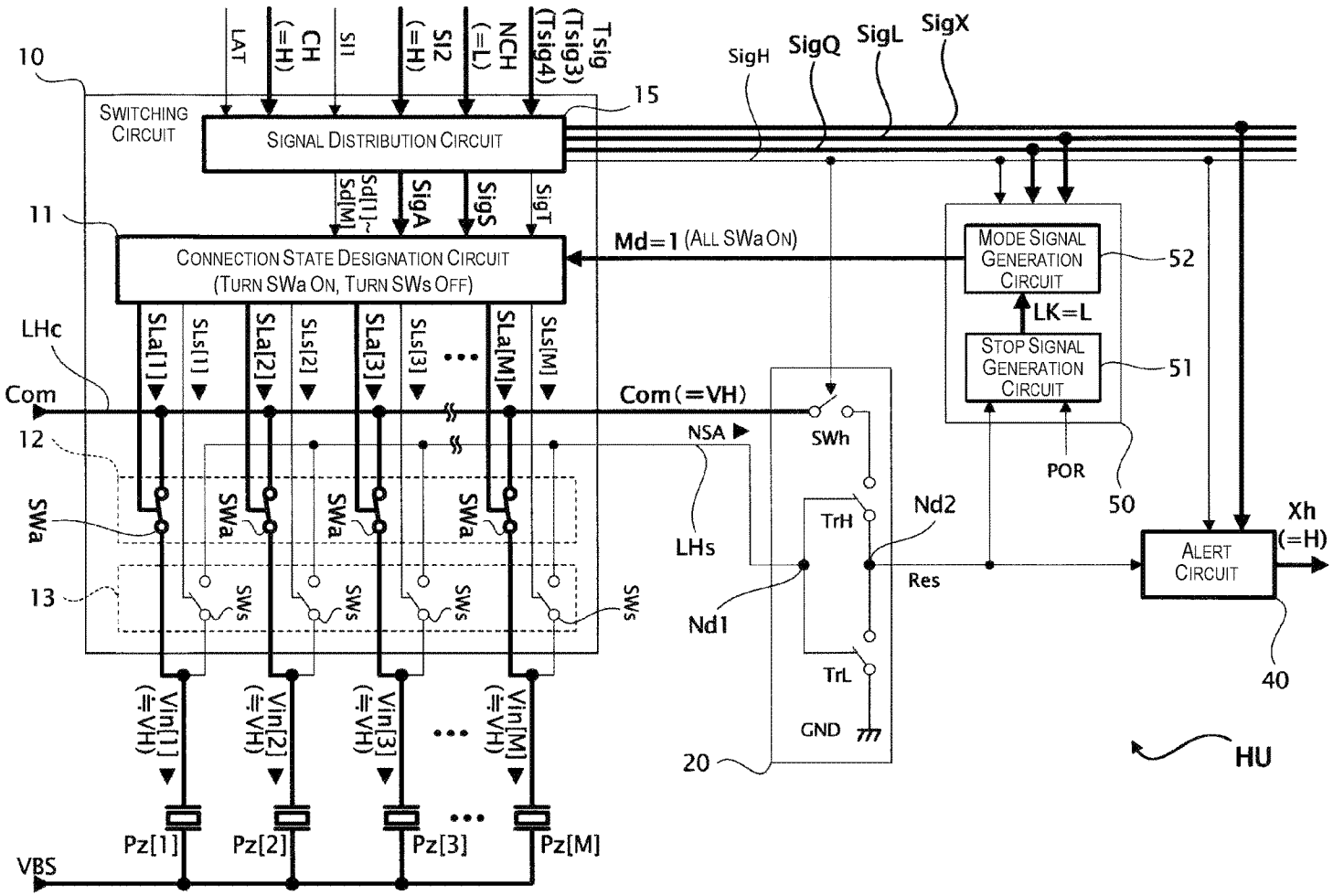
FIG. 11G is a descriptive view for describing a startup process and a diagnostic process.
Figure 11H:
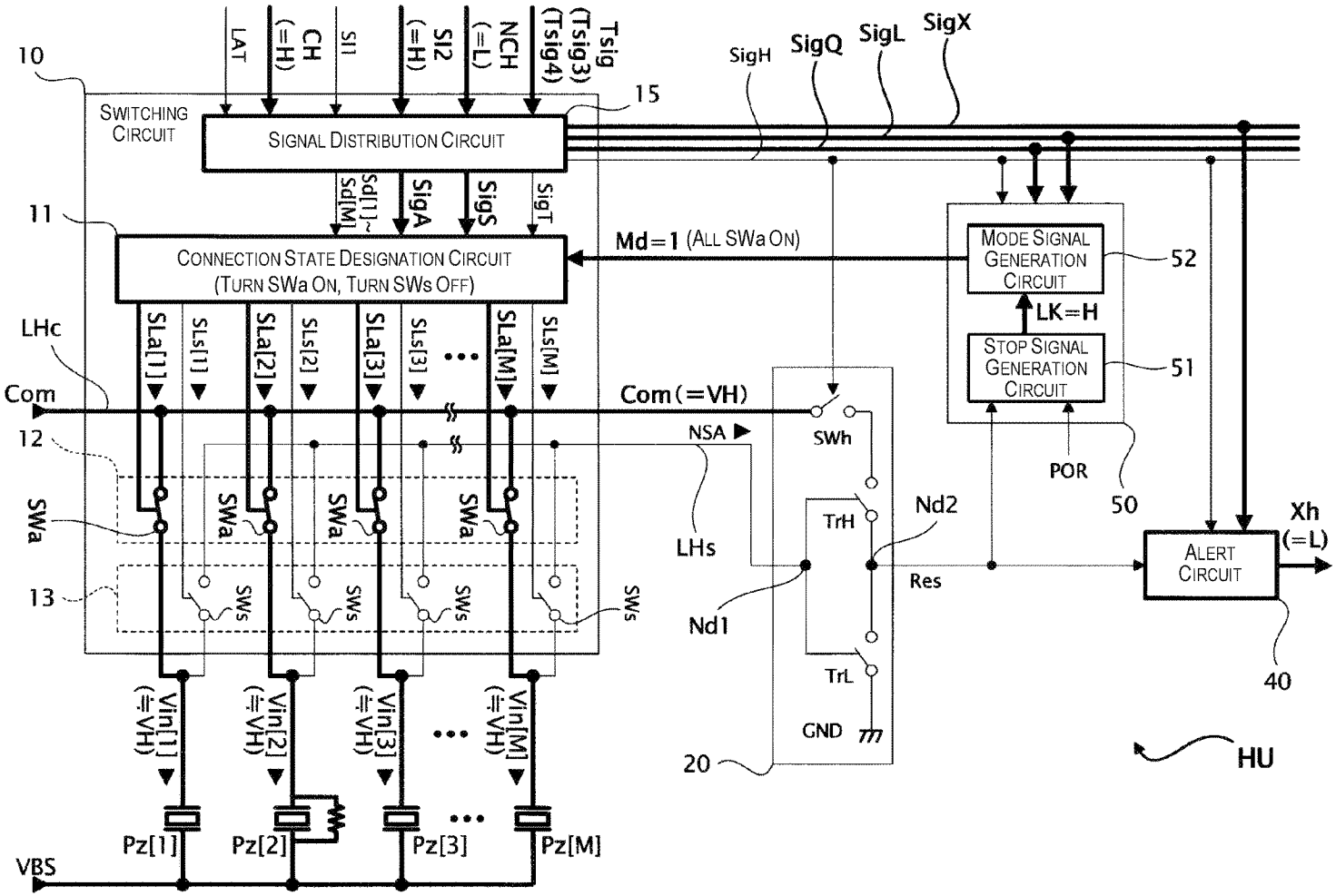
FIG. 11H is a descriptive view for describing a startup process and a diagnostic process.

FIGS. 11G and 11H are descriptive views for describing the operation of the head unit HU during the determination result response period T3 from the time t-30 to the time t-40, during which the determination result response process is executed. Of these, FIG. 11G illustrates the operation of the head unit HU in a case where the determination result in the determination process is affirmative, and FIG. 11F illustrates the operation of the head unit HU in a case where the determination result in the determination process is negative.

The control unit 6 raises the control waveform signal Tsig3 to high-level at the time t-31. Therefore, at the time t-31, the signal distribution circuit 15 sets the pulse PlsA3 for the designation signal SigA, thus starting the control period TA3. Thus, the connection state designation circuit 11 sets the connection state designation signals SLa[1] to SLa[M] to high-level and turns the switches SWa[1] to SWa[M] on at the time t-31.

Next, the control unit 6 lowers the control waveform signal Tsig3 to low-level at the time t-32. Therefore, at the time t-32, the signal distribution circuit 15 sets the pulse PlsS2 for the designation signal SigS, thus starting the control period TS. Thus, the connection state designation circuit 11 sets the connection state designation signals SLs[1] to SLs[M] to low-level and turns the switches SWs[1] to SWs[M] off at the time t-32. Also, the signal distribution circuit 15 raises the designation signal SigX to high-level at the time t-32. Thus, the alert circuit 40 sets the alert signal Xh to a signal level corresponding to the determination result in the determination process at the time t-32. Specifically, the alert circuit 40 maintains the alert signal Xh at high-level, as illustrated in FIG. 11G, if the determination result is affirmative, but lowers the alert signal Xh to low-level, as illustrated in FIG. 11H, if the determination result is negative.

Next, the control unit 6 raises the control waveform signal Tsig4 to high-level at the time t-33. Therefore, the signal distribution circuit 15 sets the pulse PlsLK for the designation signal SigL at the time t-33. Thus, the stop signal generation circuit 51 sets the stop signal LK to a signal level corresponding to the determination result in the determination process at the time t-33. Specifically, the stop signal generation circuit 51 lowers the stop signal LK to low-level, as illustrated in FIG. 11G, if the determination result is affirmative, but maintains the stop signal LK at high-level, as illustrated in FIG. 11H, if the determination result is negative.

Next, the control unit 6 lowers the control waveform signal Tsig4 to low-level at the time t-34. Therefore, the signal distribution circuit 15 lowers the designation signal SigX to low-level at the time t-34. Thus, the alert circuit 40 sets the alert signal Xh to high-level at the time t-34.

Figure 11I:
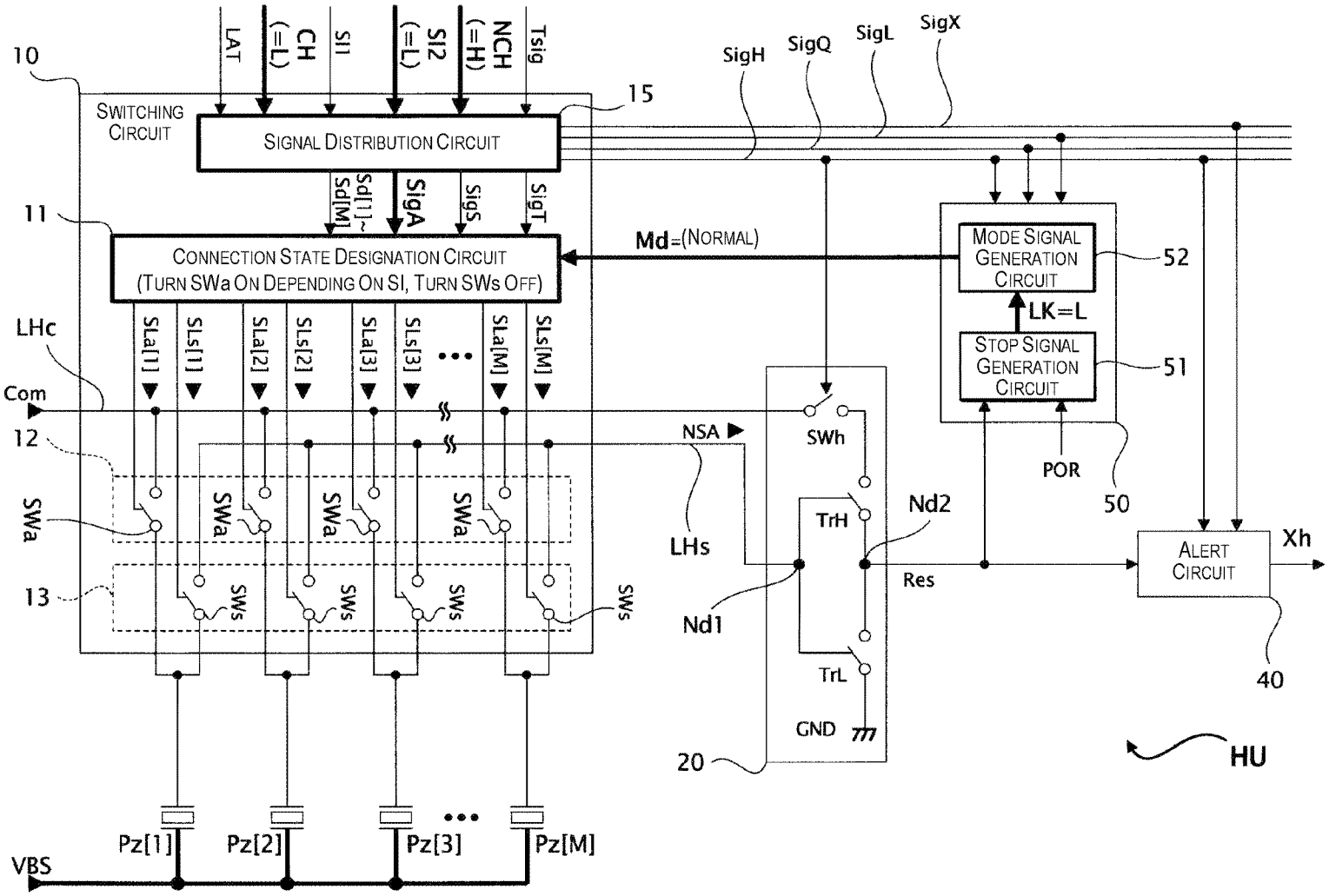
FIG. 11I is a descriptive view for describing a startup process and a diagnostic process.
Figure 11J:
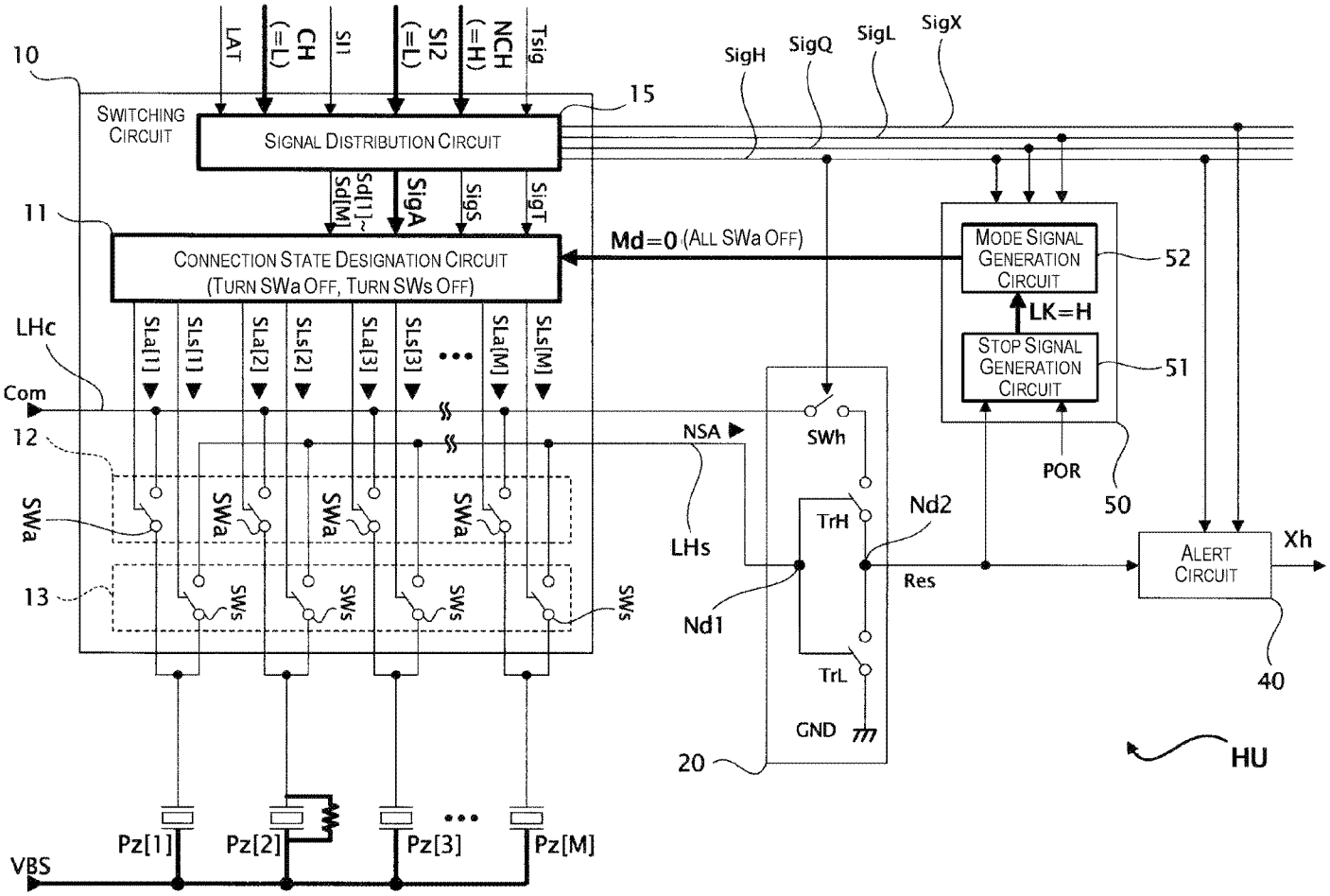
FIG. 11J is a descriptive view for describing a startup process and a diagnostic process.

FIGS. 11I and 11J are descriptive views for describing the operation of the head unit HU in a case where the diagnostic process ends and the normal operation period TR, during which the printing process or the like is executed, is started. Of these, FIG. 11I illustrates the operation of the head unit HU in a case where the determination result in the determination process is affirmative, and FIG. 11J illustrates the operation of the head unit HU in a case where the determination result in the determination process is negative.

At the time t-40 where the diagnostic process ends, the control unit 6 lowers the printing signal SI2 to low-level, lowers the change signal CH to low-level, and raises the N charge signal NCH to high-level. Therefore, at the time t-40, the signal distribution circuit 15 lowers the enabling signal SigQ to low-level, and also sets the pulse PlsA4 for the designation signal SigA, thus ending the control period TA3.

Accordingly, the mode signal generation circuit 52 sets the value "2" designating the normal mode for the operational mode designation signal Md during the normal operation period TR if the determination result in the determination process is affirmative and the stop signal LK is low-level, as illustrated in FIG. 11I, but sets the value "0" designating the supply stop mode for the operational mode designation signal Md during the normal operation period TR if the determination result in the determination process is negative and the stop signal LK is high-level, as illustrated in FIG. 11J. The connection state designation circuit 11 sets the signal levels of the connection state designation signals SLa[1] to SLa[M] so that the switches SWa[1] to SWa[M] turn on or off in accordance with the individual designation signals Sd[1] to Sd[M] supplied to the connection state designation circuit 11 if the operational mode designation signal Md indicates the value "2" designating the normal mode, as illustrated in FIG. 11I. In turn, the connection state designation circuit 11 sets the connection state designation signals SLa[1] to SLa[M] to low-level to keep the off state of the switches SWa[1] to SWa[M] if the operational mode designation signal Md indicates the value "0" designating the supply stop mode, as illustrated in FIG. 11J.

During the normal operation period TR, the connection state designation circuit 11 sets the connection state designation signals SLs[1] to SLs[M] to low-level and places the switches SWs[l] to SWs[M] in an off state, irrespective of the determination result in the determination process.

As per the foregoing description in FIGS. 11A to 11J, the head unit HU as in the present embodiment executes the determination process for determining whether or not the discharge sections D have the predetermined discharge capability, and the discharge limitation process for stopping the driving of the discharge sections D and limiting the discharging of the ink from the discharge sections D if the result of the determination process is negative.

6. Operation of the Head Units in the Printing Process

A summary of the operation of the head unit HU during the printing process shall now be described with reference to FIG. 12.

Figure 12:
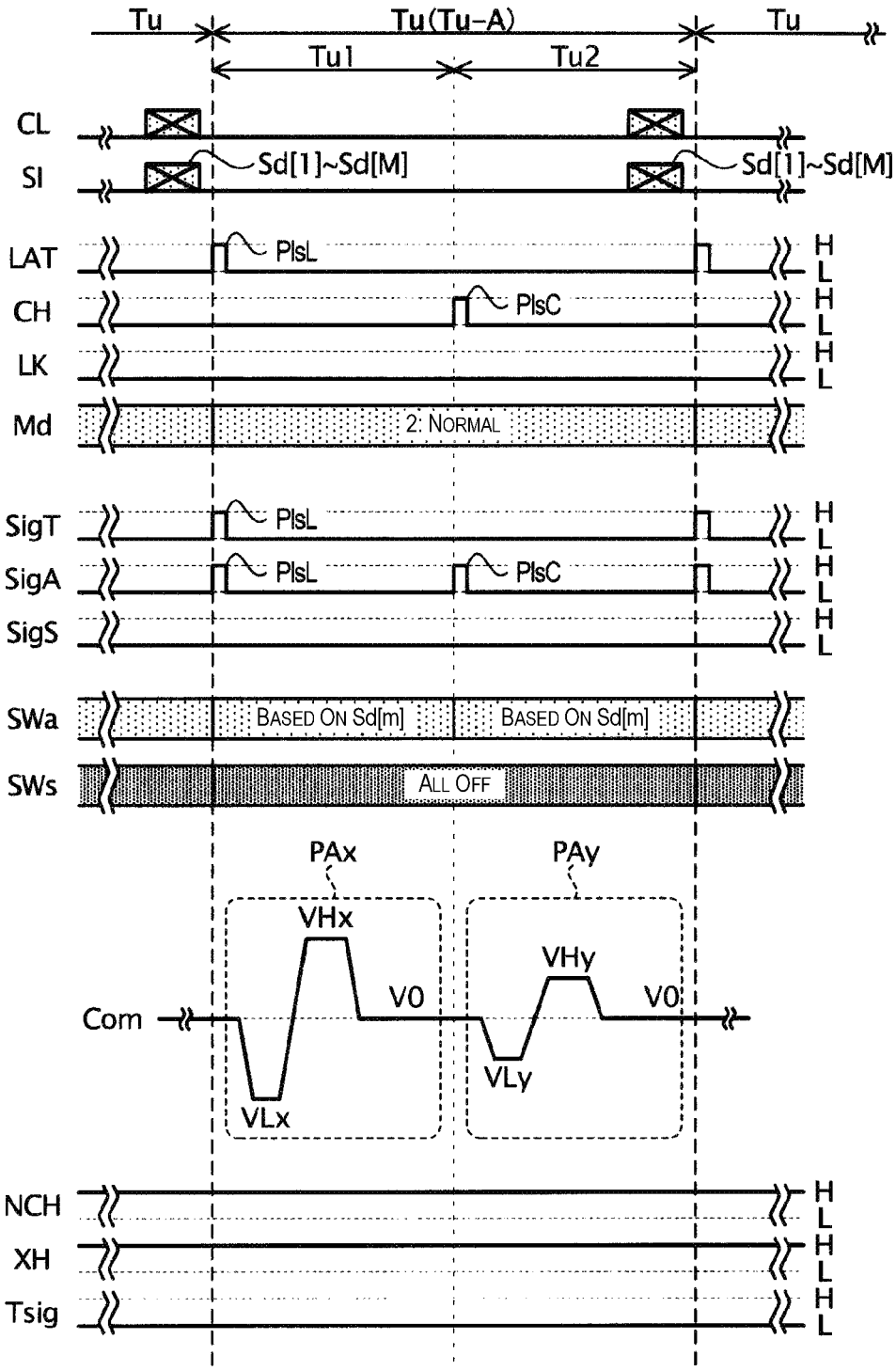
FIG. 12 is a timing chart for describing a printing process.

FIG. 12 is a timing chart for describing the operation of the head unit HU if the printing process is being executed.

As illustrated in FIG. 12, the printing process is executed in unit periods Tu provided to the normal operation period TR. Herein, the unit period Tu refer to periods for each of the discharge sections D to discharge ink for forming one dot during the printing process. In general, the inkjet printer 1 forms the image indicated by the printing data Img by repeatedly executing the printing process over the span of a plurality of unit periods Tu and causing ink to be discharged a plurality of times each time from each of the discharge sections D. The inkjet printer 1 may also in some instances execute a process different than the printing process, such as, for example, a process for expelling ink from the discharge sections D in order to perform maintenance on the discharge sections D, during the unit periods Tu. Therefore, a unit period Tu during which the printing process is executed may in some instances be specifically called a unit printing period Tu-A.

As illustrated in FIG. 12, in the present embodiment, the unit periods Tu are specified by a period from the rising of a pulse PlsL provided to the latch signal LAT to the subsequent rising of the pulse PlsL within the normal operation period TR. Moreover, in the present embodiment, the unit printing periods Tu-A among the unit periods Tu are subdivided into two periods which are printing control periods Tu1 and Tu2, by pulses PlsC provided to the change signal CH.

As illustrated in FIG. 12, the control unit 6 generates the individual designation signals Sd[1] to Sd[M] for designating the mode of driving of the discharge sections D[1] to D[M] in each of the unit periods Tu in order to form dots corresponding to the image indicated by the printing data Img during the printing process. The control unit 6 supplies the printing signals SI1 and SI2 comprising the individual designation signals Sd[l] to Sd[M] to the signal distribution circuit 15 in synchronicity with the clock signal CL prior to the start of each of the unit periods Tu. During the printing process, the signal distribution circuit 15 generates the decision signal SigT to which the pulse PlsL on the basis of the latch signal LAT, and generates the designation signal SigA to which the pulse PlsL and the pulse PlsC are provided on the basis of the latch signal LAT and the change signal CH. The signal distribution circuit 15 supplies the individual designation signals Sd[1] to Sd[M], the decision signal SigT, and the designation signal SigA to the connection state designation circuit 11.

As stated above, the stop signal generation circuit 51 sets the stop signal LK to low-level if the printing process can be executed during the normal operation period TR. The mode signal generation circuit 52 supplies the operational mode designation signal Md, for which the value "2" designating the normal mode has been set, to the connection state designation circuit 11 if the printing process can be executed during the normal operation period TR. Therefore, the connection state designation circuit 11 outputs the connection state designation signals SLa[1] to SLa[M] of such a signal level that the on/off state of the switches SWa[1] to SWa[M] is controlled in accordance with the designations of the individual designation signals Sd[1] to Sd[M] during the printing process.

The individual designation signal Sd[m] as in the present embodiment designates, for each of the discharge sections D[m] at every unit period Tu (unit printing period Tu-A) during the printing process, any one driving mode out of four driving modes: discharging of ink of an amount corresponding to a large dot (a large-sized amount) (called in some instances "formation of a large dot"), discharging of ink of an amount corresponding to a medium dot (a medium-sized amount) (called in some instances "formation of a medium dot"), discharging of ink of an amount corresponding to a small dot (a small-sized amount) (called in some instances "formation of a small dot"), and non-discharging of ink.

As illustrated in FIG. 12, during the printing process, the control unit 6 outputs the drive signal Com having a waveform PAX provided to the printing control period Tu1 and a waveform PAY provided to the printing control period Tu2. In the present embodiment, the waveform PAX is established such that the difference in potential between a highest potential VHX and a lowest potential VLX of the waveform PAX is greater than the difference in potential between the potential V0 and a highest potential VH of the drive signal Com during the diagnostic process. The waveform PAY is established such that the difference in potential between a highest potential VHY and a lowest potential VLY of the waveform PAY is smaller than the difference in potential between the highest potential VHX and the lowest potential VLX of the waveform PAX. Specifically, the waveform PAX is established such that if the discharge section D[m] is being driven by the drive signal Com having the waveform PAX, the medium-sized amount of ink is discharged from the discharge section D[m]. Furthermore, the waveform PAY is established such that if the discharge section D[m] is being driven by the drive signal Com having the waveform PAY, the small-sized amount of ink is discharged from the discharge section D[m].

If the individual designation signal Sd[m] designates formation of a large dot for the discharge section D[m], then the connection state designation circuit 11 sets the connection state designation signal SLa[m] to high-level during the printing control period Tu1 and to high-level during the printing control period Tu2. In this case, the discharge section D[m] is driven by the drive signal Com having the waveform PAX and discharges the medium-sized amount of ink during the printing control period Tu1, and is driven by the drive signal Com having the waveform PAY and discharges the small-sized amount of ink during the printing control period Tu2. Thus, the discharge section D[m] discharges in total a large-sized amount of ink during the unit period Tu, and a large dot is formed on the recording paper P.

If the individual designation signal Sd[m] designates formation of a medium dot for the discharge section D[m], then the connection state designation circuit 11 sets the connection state designation signal SLa[m] to high-level during the printing control period Tu1 and to low-level during the printing control period Tu2. In this case, the discharge section D[m] is driven by the drive signal Com having the waveform PAX and discharges the medium-sized amount of ink during the printing control period Tu1, but does not discharge any ink, there being no drive signal Com supplied, during the printing control period Tu2. Thus, the discharge section D[m] discharges a medium-sized amount of ink during the unit period Tu, and a medium dot is formed on the recording paper P.

If the individual designation signal Sd[m] designates formation of a small dot for the discharge section D[m], then the connection state designation circuit 11 sets the connection state designation signal SLa[m] to low-level during the printing control period Tu1 and to high-level during the printing control period Tu2. Thus, the discharge section D[m] is driven by the drive signal Com having the waveform PAY and discharges a small-sized amount of ink during the unit period Tu, and a small dot is formed on the recording paper P.

If the individual designation signal Sd[m] designates non-discharging of ink for the discharge section D[m], then the connection state designation circuit 11 sets the connection state designation signal SLa[m] to low-level during the printing control period Tu1 and to low-level during the printing control period Tu2. Thus, the discharge section D[m] does not discharge any ink during the unit period Tu, and no dot is formed on the recording paper P.

As illustrated in FIG. 12, the connection state designation circuit 11 sets the switches SWs[1] to SWs[M] to low-level so that the switches SWs[1] to SWs[M] are off if the printing process is being executed during the normal operation period TR. The alert circuit 40 sets the alert signal Xh to high-level, except where the temperature detected by the overheating detection circuit exceeds the predetermined temperature, if the printing process is being executed during the normal operation period TR.

The control unit 6 sets the N charge signal NCH to high-level and sets the diagnostic control signal Tsig to low-level if the printing process is being executed during the normal operation period TR, as illustrated in FIG. 12.

The control unit 6 can also set the N charge signal NCH to low-level during a period where the printing process is not executed within the normal operation period TR. In such a case, the signal distribution circuit 15 outputs, to the connection state designation circuit 11, such connection state designation signals SLa[1] to SLa[M] that all of the switches SWa[1] to SWa[M] are on. That is to say, the control unit 6 sets the N charge signal NCH to low-level when driving all of the discharge sections D[1] to D[M] at the same time and causing the ink to be expelled from all of the discharge sections D[1] to D[M], such as, for example, during maintenance of the inkjet printer 1.

However, the potential of the lower electrode 301 of the discharge section D[m] also changes in accordance with the change in potential of the upper electrode 302 if, during the printing process, the control unit 6 supplies the drive signal Com having the waveform PAX or the waveform PAY to the upper electrode 302. That is to say, if the printing process is being executed, then: the wirings LC and the terminals ZN for supplying the drive signal Com, such as the wiring LC-15 and the terminal ZN1-5, will have a greater variation width in potential than the wirings LC and the terminals ZN for supplying the potential VBS, such as the wiring LC1-4 and the terminal ZN-14; and the wirings LC and the terminals ZN for supplying the potential VBS, such as the wiring LC1-4 and the terminal ZN1-4, will have a greater variation width in potential than the wirings LC and the terminals for supplying the ground potential GND, such as the wiring LC1-3 and the terminal ZN1-3.

As described above, the inkjet printer 1 as in the present embodiment forms the image indicated by the printing data 1 mg on the recording paper P by forming dots of three sizes, which are large dots, medium dots, and small dots, during the printing process.

7. Connection State Designation Circuit

Figure 13:
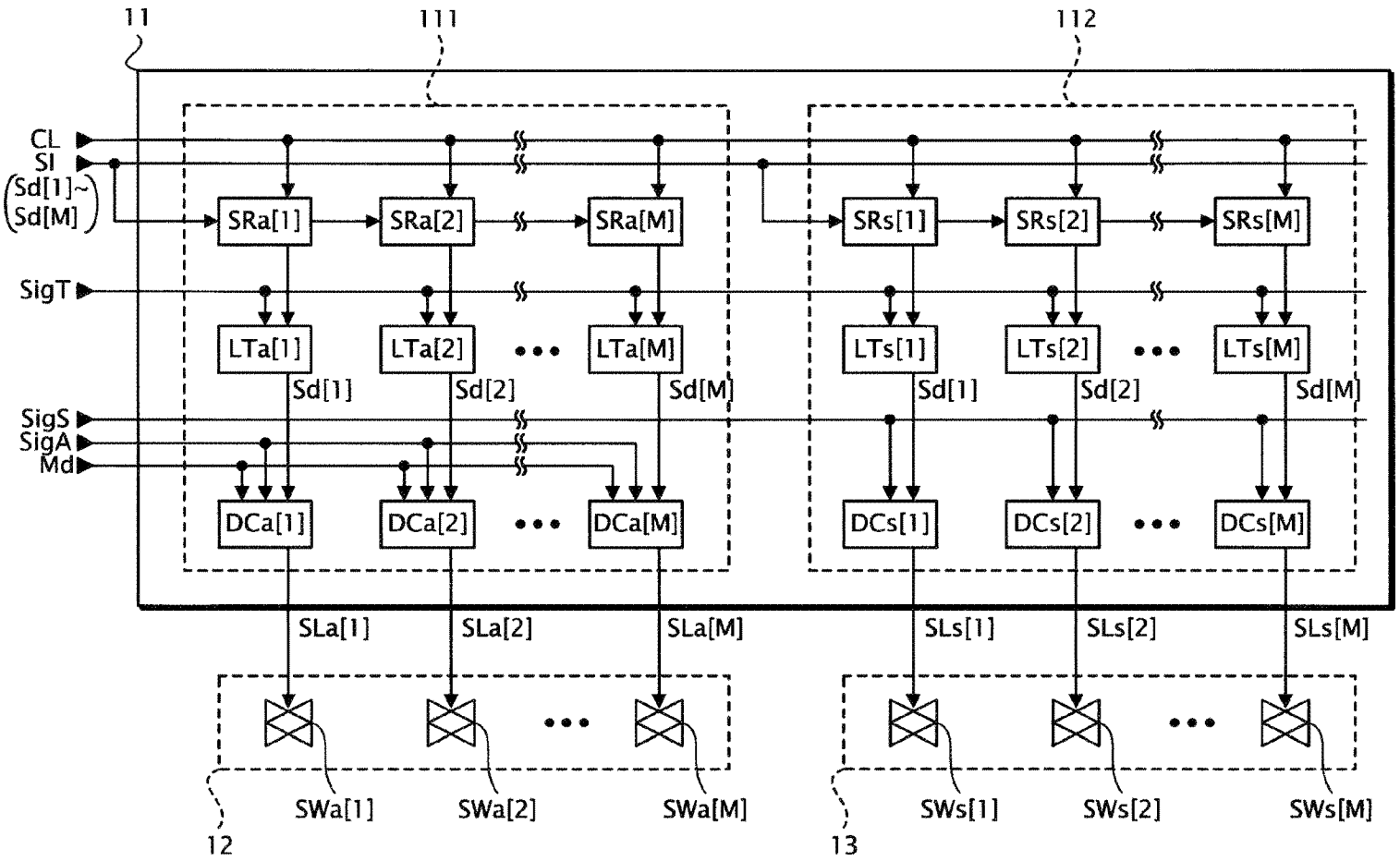
FIG. 13 is a block diagram illustrating the configuration of a connection state designation circuit 11.

Next, the configuration and operation of the connection state designation circuit 11 shall be described, with reference to FIGS. 13 to 14C.

FIG. 13 is a drawing illustrating the configuration of the connection state designation circuit 11 as in the present embodiment. As illustrated in FIG. 13, the connection state designation circuit 11 has a designation signal generation circuit 111 for generating the connection state designation signals SLa[l] to SLa[M] to be supplied to the switches SWa[1] to SWa[M], and has a designation signal generation circuit 112 for generating the connection state designation signals SLs[1] to SLs[M] to be supplied to the switches SWs[1] to SWs[M].

As illustrated in FIG. 13, the designation signal generation circuit 111 has transfer circuits SRa[1] to SRa[M], latch circuits LTa[1] to LTa[M], and decoders DCa[1] to DCa[M], so as to have one-to-one correspondence with the switches SWa[1] to SWa[M].

The individual designation signal Sd[m] is supplied to the transfer circuit SRa[m]. In FIG. 13, the individual designation signals Sd[1] to Sd[M] are supplied serially; for example, the case illustrated by way of example is one where the individual designation signal Sd[m] corresponding to the m-th stage is transferred in sequential order from the transfer circuit SRa[I] to the transfer circuit SRa[m], synchronously with the clock signal CL.

The latch circuit LTa[m] latches the individual designation signal Sd[m] supplied to the transfer circuit SRa[m] at a timing where the decision signal SigT rises to high-level. Specifically, the latch circuit LTa[m] latches the individual designation signal Sd[m] at the timing where the pulse PlsL of the decision signal SigT rises to high-level during the printing process, and latches the individual designation signal Sd[m] at the timing where the pulse PlsT1 of the decision signal SigT rises to high-level during the diagnostic process The decoder DCa[m] generates the connection state designation signal SLa[m] on the basis of the individual designation signal Sd[m], the designation signal SigA, and the operational mode designation signal Md.

FIGS. 14A and 14B are descriptive views for describing the generation of the connection state designation signal SLa[m] at the decoder DCa[m]. The decoder DCa[m] generates the connection state designation signal SLa[m] by decoding the individual designation signal Sd[m] in accordance with FIGS. 14A and 14B.

As illustrated in FIG. 14A, if the operational mode designation signal Md indicates "1", i.e., if the head unit HU is executing the diagnostic process during the diagnostic period TQ, then the individual designation signal Sd[m] supplied to the head unit HU during the startup period TP prior to the start of the diagnostic period TQ indicates either a value (1, 1) designating that the discharge section D[m] is subject to diagnosis, or a value (0, 0) designating that the discharge section D[m] is not subject to diagnosis.

In FIG. 14A, if the individual designation signal Sd[m] indicates (1, 1), then the decoder DCa[m] outputs a connection state designation signal SLa[m] that becomes high-level during the control periods TA1 and TA3 and becomes low-level during the control period TA2. In this case, as has also been described with FIG. 10A and the like, the switch SWa[m] (SWa-O[m]) is on during the control periods TA1 and TA3, and off during the control period TA2.

In FIG. 14A, if the individual designation signal Sd[m] indicates (0, 0), then the decoder DCa[m] sets the signal level of the connection state designation signal SLa[m] so as to be high-level during the control periods TA1 to TA3. In this case, as has also been described with FIG. 10A and the like, the switch SWa[m] is on during the control periods TA1 to TA3.

As illustrated in FIG. 14B, if the operational mode designation signal Md indicates "2", i.e., if the inkjet printer 1 is executing the printing process during the normal operation period TR, then the individual designation signal Sd[m] supplied to the head unit HU prior to the start of the unit period Tu indicates any one value among the value (1, 1) designating formation of a large dot, a value (1, 0) designating formation of a medium dot, a value (0, 1) designating formation of a small dot, or the value (0, 0) designating non-discharging of ink.

In FIG. 14B, if the individual designation signal Sd[m] indicates (1, 1), then the decoder DCa[m] sets the signal level of the connection state designation signal SLa[m] so as to be high-level during the printing control periods Tu1 and Tu2. In this case, the switch SWa[m] is on during the printing control periods Tu1 and Tu2. Therefore, the discharge section D[m] is driven by the waveform PAX and the waveform PAY, and discharges a large-sized amount of ink during the unit period Tu.

In FIG. 14B, if the individual designation signal Sd[m] indicates (1, 0), then the decoder DCa[m] sets the signal level of the connection state designation signal SLa[m] so as to be high-level during the printing control period Tu1, and be low-level during the printing control period Tu2. In this case, the switch SWa[m] is on during the printing control period Tu1, and off during the printing control period Tu2. Therefore, the discharge section D[m] is driven by the waveform PAX, and discharges a medium-sized amount of ink during the unit period Tu.

In FIG. 14B, if the individual designation signal Sd[m] indicates (0, 1), then the decoder DCa[m] sets the signal level of the connection state designation signal SLa[m] so as to be low-level during the printing control period Tu1, and be high-level during the printing control period Tu2. In this case, the switch SWa[m] is off during the printing control period Tu1, and on during the printing control period Tu2. Therefore, the discharge section D[m] is driven by the waveform PAY, and discharges a small-sized amount of ink during the unit period Tu.

In FIG. 14B, if the individual designation signal Sd[m] indicates (0, 0), then the decoder DCa[m] sets the signal level of the connection state designation signal SLa[m] so as to be low-level during the printing control periods Tu1 and Tu2. In this case, the switch SWa[m] is off during the printing control periods Tu1 and Tu2. Therefore, the discharge section D[m] does not discharge ink during the unit period Tu.

As illustrated in FIG. 13, the designation signal generation circuit 112 has transfer circuits SRs[1] to SRs[M], latch circuits LTs[1] to LTs[M], and decoders DCs[1] to DCs[M], so as to have one-to-one correspondence with the switches SWs[1] to SWs[M].

The individual designation signal Sd[m] is supplied to the transfer circuit SRs[m]. FIG. 13 depicts, by way of example, a case where the individual designation signals Sd[1] to Sd[M] are supplied serially. The latch circuit LTa[m] latches the individual designation signal Sd[m] held in the transfer circuit SRs[m] at a timing where the pulse PlsT1 of the decision signal SigT rises to high-level during the diagnostic process.

The decoder DCs[m] generates the connection state designation signal SLs[m] on the basis of the individual designation signal Sd[m] and the designation signal SigS.

FIG. 14C is a descriptive view for describing the generation of the connection state designation signal SLs[m] at the decoder DCs[m]. The decoder DCs[m] generates the connection state designation signal SLs[m] by decoding the individual designation signal Sd[m] in accordance with FIG. 14C.

As illustrated in FIG. 14C, if the operational mode designation signal Md indicates "1", i.e., if the head unit HU is executing the diagnostic process during the diagnostic period TQ, then the individual designation signal Sd[m] supplied to the head unit HU during the startup period TP prior to the start of the diagnostic period TQ indicates either a value (1, 1) designating that the discharge section D[m] is subject to diagnosis, or a value (0, 0) designating that the discharge section D[m] is not subject to diagnosis.

In FIG. 14C, if the individual designation signal Sd[m] indicates (1, 1), then the decoder DCs[m] sets the signal level of the connection state designation signal SLs[m] so as to be high-level during the control period TS, and be low-level during periods other than the control period TS. In this case, the switch SWs[m] (SWs-O[m]) is on during the control period TS, and off during periods other than the control period TS.

In FIG. 14C, if the individual designation signal Sd[m] indicates (0, 0), then the decoder DCs[m] sets the signal level of the connection state designation signal SLs[m] so as to be low-level during the control period TS and during periods other than the control period TS. In this case, the switch SWs[m] is off during the control period TS and during periods other than the control period TS.

8. Conclusion of the First Embodiment

As described above, the head unit HU as in the present embodiment is equipped with the determination circuit 20 for executing the determination process for determining whether or not the discharge sections D have the predetermined discharge capability, and the discharge limitation circuit 5 for executing the discharge limitation process for stopping the driving of the discharge sections D and limiting the discharging of the ink from the discharge sections D if the determination result in the determination process is negative.

As stated above, the determination circuit 20 executes the determination process during the determination period T2 specified by the control waveform signal Tsig2. The determination circuit 20 then generates the determination result signal Res on the basis of the detection signal NSA supplied from the discharge sections D within the head unit HU, as the determination process, and supplies the generated determination result signal Res to the alert circuit 40 and the operation designation circuit 50 within the head unit HU. That is to say, the determination process itself is executed in a self-contained manner within the interior of the head unit HU.

The discharge limitation circuit 5 executes the discharge limitation process in the determination result response period T3 specified by the printing signal SI2, the change signal CH, and the N charge signal NCH (these three signals are in some instances also called "the printing signal SI2 and the like") as well as by the diagnostic control signal Tsig. The discharge limitation circuit 5 generates the connection state designation signals SLa[I] to SLa[M] on the basis of the determination result signal Res and turns the switches SWa[I] to SWa[M] off, as the discharge limitation process. Specifically, as the discharge limitation process, the discharge limitation circuit 5 firstly sets the potential of the stop signal LK on the basis of the determination result signal Res supplied from the determination circuit 20 within the head unit HU, secondly sets the value of the operational mode designation signal Md on the basis of the stop signal LK, and thirdly generates the connection state designation signals SLa[1] to SLa[M] on the basis of the operational mode designation signal Md and turns off the switches SWa[1] to SWa[M]. That is to say, the discharge limitation process itself is executed in a self-contained manner within the interior of the head unit HU.

Thus, the head unit HU as in the present embodiment executes the determination process and the discharge limitation process in a self-contained manner within the head unit HU. Therefore, according to the present embodiment, it becomes possible to reduce the possibility of noise being mixed into the signals generated in the determination process and the discharge limitation process, in comparison to if at least a part of the processing of the determination process and the discharge limitation process were executed outside of the head unit HU. That is to say, according to the present embodiment, it becomes possible to keep low the possibility of noise being mixed into the signals generated or utilized in the determination process or the discharge limitation process, such as the detection signal NSA, the determination result signal Res, the stop signal LK, the operational mode designation signal Md, and the connection state designation signals SLa[1] to SLa[M], in comparison to if at least a part of the determination circuit 20 and the discharge limitation circuit 5 were provided to the exterior of the head unit HU, such as to the substrate 600.

Therefore, according to the present embodiment, it becomes possible to execute the determination in the determination process at higher precision and possible to more reliably limit the driving of a discharge section D not having the predetermined discharge capability, in comparison to if at least a part of the determination circuit 20 and the discharge limitation circuit 5 were provided to the exterior of the head unit HU. It is thus possible to more reliably prevent a low-quality image from being printed by a discharge section D not having the predetermined discharge capability, and becomes possible to more reliably prevent a decrease in safety due to driving of a piezoelectric element PZ not having the predetermined power storage capability.

Moreover, according to the present embodiment, the various signals supplied from the control unit 6 to the head unit HU, such as the printing signal SI, and the various signals generated in the head unit HU, such as the designation signal SigA, will not change in potential during a period, of the determination period T2, where the control waveform signal Tsig2 is high-level. Therefore, according to the present embodiment, it is possible to keep low the possibility of noise caused by a change in potential of other signals from being mixed into the detection signal NSA serving as the subject of determination in the determination process and the determination result signal Res indicating the result of the determination in the determination process, in comparison to if the various signals were to change in potential during the period where the control waveform signal Tsig2 is high-level. Thus, according to the present embodiment, it becomes possible to increase the accuracy of the determination in the determination process.

According to the present embodiment, the potential of signals (called hereinbelow "other supplied signals") among the signals supplied to the head unit HU from the control unit 6, excluding the diagnostic control signal Tsig for controlling the progress of the diagnostic process, is kept substantially constant during the diagnostic period TQ (strictly speaking, during the period from the time t-11 to the time t-40). Therefore, according to the present embodiment, it is possible to suppress the occurrence of noise caused by changes in the potential of the other supplied signals during the diagnostic period TQ. In other words, according to the present embodiment, it becomes possible to reduce noise superimposed onto the diagnostic control signal Tsig and possible to reduce noise superimposed onto signals generated during the diagnostic process and the like, in comparison to if the potential of the other supplied signals were to change during the diagnostic period TQ. This makes it possible to reduce the possibility of malfunctions during the diagnostic process, enhance the accuracy of the determination in the determination process, and enhance the reliability of the stopping of the discharge sections D in the discharge limitation process.

In the present embodiment, during the normal operation period TR where the printing process is executed, the printing signal SI is set to low-level except during the period where the individual designation signals Sd[1] to Sd[M] are supplied, the change signal CH is set to low-level except during the period where the pulse PlsC is supplied, and the N charge signal NCH is set to high-level. During the diagnostic period TQ where the diagnostic process is executed, the printing signal SI2 is set to high-level, the change signal is set to high-level, and the N charge signal NCH is set to low-level. That is to say, the three signals of the printing signal SI2 and the like have an inverse relationship between the respective signal levels during the normal operation period TR and the respective signal levels during the diagnostic period TQ. Accordingly, during the normal operation period TR, even if noise were to be mixed into the printing signal SI2, the change signal CH, and the N charge signal NCH, it would normally be unthinkable for the signal levels of the three signals to be reversed at the same time.

Therefore, it is possible to reliably prevent the diagnostic process from being started by a malfunction at a timing where the diagnostic process cannot be executed, such as a timing where the printing process is being executed.

The printing signal SI2 is one example of a first designation signal for specifying the diagnostic period TQ and also for specifying the mode of driving of the discharge section D[m] by the individual designation signal Sd[m] in the printing process. The N charge signal NCH is one example of a second designation signal for specifying the diagnostic period TQ, and also for designating that all of the switches SWa[1] to SWa[M] should be on during the normal operation period TR. The change signal CH is one example of a third designation signal for specifying the diagnostic period TQ, and also for demarcating the printing control periods Tu1 and Tu2 during the printing process.

In the present embodiment, the control unit 6 uses the individual designation signals Sd to designate the discharge section to be diagnosed D-O serving as the subject of the diagnostic process. Accordingly, the control unit 6 as in the present embodiment can, for example, set the values of the individual designation signals Sd and designate the discharge section to be diagnosed D-O so that the diagnosis is executed depending on the mode required for the diagnostic process.

For example, the control unit 6 preferably diagnoses the discharge capability of all of the discharge sections D when the inkjet printer 1 is being started up for the first time, and therefore generates individual designation signals Sd designating all of the 4M discharge sections of the head module HM as discharge sections to be diagnosed D-O; when the inkjet printer is being started up for the second time and thereafter, not all of the discharge sections D need to be diagnosed, and therefore the control unit may generate individual designation signals Sd designating some discharge sections D of the 4M discharge sections D as discharge sections to be diagnosed D-O.

Thus, in the present embodiment, the diagnostic process can be executed in the mode required for the diagnostic process, e.g., in a mode corresponding to the circumstances of use of the inkjet printer 1, as described above.

A user of the inkjet printer 1 may operate an operation unit (not shown) to designate the requirements for the diagnostic process or the values of the individual designation signals Sd for designating the discharge sections to be diagnosed D-O. In this case, it becomes possible to execute the diagnostic process according to the mode corresponding to the user's needs.

In the present embodiment, the control unit 6 specifies the times t-11, t-12, t-20, t-30, t-31, t-32, t-33, and t-34 by using the diagnostic control signal Tsig. That is to say, adjusting the waveform of the diagnostic control signal Tsig enables the control unit 6 as in the present embodiment to set time lengths of the period where the control waveform signal Tsig1 is high-level, or the determination period T2 where the control waveform signal Tsig2 is high-level.

A variety of modes can be indicated by way of example for the adjustment of the various time lengths via the adjustment of the waveform of the diagnostic control signal Tsig.

For example, the control unit 6 may establish the time length where the control waveform signal Tsig1 is high-level in accordance with the number of discharge sections D designated as discharge sections to be diagnosed D-O. In such a case, it would become possible to adjust the period of supply of the drive signal Com to the discharge sections to be diagnosed D-O in accordance with the number of discharge sections D designated as discharge sections to be diagnosed D-O. This makes it possible to precisely set the potential VH of the drive signal Com for the upper electrodes 302 of the piezoelectric elements PZ of the discharge sections to be diagnosed D-O, and to precisely execute the determination in the determination process.

As another example, the control unit 6 may establish the time length(s) of the determination period T2 and/or the period from the time t-12 to the time t-30 in accordance with the number of discharge sections D designated as discharge sections to be diagnosed D-O. In such a case, even if there are many discharge sections D designated as discharge sections to be diagnosed D-O, it would be possible to ensure a period of time for making obvious any change in potential of the internal wiring LHs caused by a leakage current produced in a piezoelectric element PZ having a leakage path. Therefore, during the diagnostic process, the detection signal NSA can be made to be precisely reflective of the potential of the individual detection signal Vout detected from a discharge section to be diagnosed D-O not having the predetermined discharge capability, even if many discharge sections D have been designated as discharge sections to be diagnosed D-O. This makes it possible to precisely determine whether or not there are any discharge sections D not having the predetermined discharge capability.

As another example, the control unit 6 may establish the length of the period where the control waveform signal Tsig1 is high-level and/or the time length of the determination period T2 in accordance with the accuracy of determination required for the determination process. In such a case, in order to enhance the accuracy of determination, it would suffice to have either the period where the control waveform signal Tsig1 is high-level or the determination period T2 be long, or have both be long.

As another example, the control unit 6 may establish the length of the period where the control waveform signal Tsig1 is high-level and/or the time length of the determination period T2 in accordance with the requirements of the user of the inkjet printer 1.

Thus, in the present embodiment, adjusting the waveform of the diagnostic control signal Tsig in accordance with the accuracy required for determination, the user's needs, or the like makes it possible to execute the diagnostic process with a mode suited to the accuracy required for determination, the user's needs, or the like.

In the present embodiment, the control unit 6 outputs various signals, such as the diagnostic control signal Tsig, the printing signal SI, and the change signal CH, from the terminals ZN of the connectors CN, to be supplied to the head unit HU via the terminals ZC of the cables CB and the wiring LC of the cables CB. However, if there is poor contact between the terminals ZN of the connectors CN and the terminals ZC of the cables CB, there may also occur instances where noise is mixed into the signals outputted from the terminals ZN, and furthermore the signals outputted from the terminals ZN are no longer supplied to the head unit HU. In particular, there is a high likelihood of poor contact between the connectors CN and the cables CB occurring if the relative positional relationship between at least some of the cables CB and the connectors CN changes, as is the case with a serial printer where the carriage 100 moves reciprocally.

In general, poor contact between the connectors CN and the cables CB is more likely to occur in terminals ZN provided to positions close to the end Eg of the connectors CN than terminals ZN provided to the central part of the connectors CN.

Furthermore, foreign matter such as ink or dust in the air is more likely to be adhered to the terminals ZN provided to positions close to the end Eg of the connectors CN than to the terminals ZN provided to the central part of the connectors CN. If foreign matter has adhered to the terminals ZN, similarly to if there is poor contact, there may also occur instances where noise is mixed into the signals outputted from the terminals ZN, and furthermore the signals outputted from the terminals ZN are no longer supplied to the head unit HU.

Thus, there is a high likelihood that images formed will be of poor quality if the printing process is executed in circumstances where poor contact has occurred between the connectors CN and the cables CB, or in circumstances where foreign matter has adhered to the terminals ZN of the connectors CN. Attempting to transmit signals via portions where poor contact has occurred or portions where foreign matter has adhered may produce leakage of signals or the like, and may lead to failure of the inkjet printer 1 or a decrease in safety of the inkjet printer 1.

The inkjet printer 1 as in the present embodiment executes the printing process if and only if the diagnostic process is completed and the result of the determination process executed in the diagnostic process is affirmative. The progression of the diagnostic process is controlled by the diagnostic control signal Tsig. Accordingly, when, hypothetically the supply of the diagnostic control signal Tsig to the head unit HU failed, whether due to poor contact between the connectors CN and the cables CB or to foreign matter adhering to the connectors CN, the diagnostic process would not be completed and the printing process also would not be executed.

As stated above, the control unit 6 as in the present embodiment outputs the diagnostic control signal Tsig from the terminal ZN1-2 of the connector CN1. Thus, of the terminals ZN1-1 to ZN4-14 of the connector CN1, only the terminal ZN1-1 set to the ground potential GND is provided between the terminal ZN1-2 and the end Eg1. In other words, in the present embodiment, the terminal ZN1-2 outputting the diagnostic control signal Tsig is provided closer to the end of the terminal array section AR than the terminals ZN1-5 or ZN1-7 outputting the drive signal Com, the terminal ZN1-11 outputting the clock signal CL, and the like. Thus, according to the present embodiment, if poor contact occurs between the connector CN1 and the cable CB1 or if foreign matter has adhered to the terminals ZN of the connector CN1, the possibility of failure to supply the diagnostic control signal Tsig to the head unit HU can be rendered greater than the possibility of failure to supply the signals needed for the printing process such as the drive signal Com and the clock signal CL.

Therefore, according to the present embodiment, if poor contact or foreign matter adhesion occurs in the connectors CN and there exists the possibility that a low-quality image will be formed in the printing process, the possibility that the execution of the diagnostic process, which is a prerequisite for the printing process, will not be completed can be raised, consequently raising the possibility that execution of the printing process will be limited.

Moreover, in the connector CN1 in the present embodiment, the terminal ZN1-3 set to the ground potential GND is arranged between the terminal ZN1-2 outputting the diagnostic control signal Tsig and the terminal ZN1-5 outputting the drive signal Com, and the terminal Z1-4 set to the potential VBS is arranged between the terminal ZN1-3 and the terminal ZN1-5. As stated above, at least if the printing process is being executed, the variation width of the potential of the terminal ZN1-4 is smaller than the variation width of the potential of the terminal ZN1-5, and the variation width of the potential of the terminal ZN1-3 is smaller than the variation width of the potential of the terminal ZN1-4. Accordingly, the terminal ZN1-3 and the terminal ZN1-4 function as shields for preventing noise caused by fluctuations in the potential of the drive signal Com outputted by the terminal ZN1-5 from propagating to the terminal ZN1-2. That is to say, in the present embodiment, the terminal ZN1-3 and the terminal ZN1-4 suppress the superimposition of noise caused by the drive signal Com onto the diagnostic control signal Tsig. Thus, it is possible to prevent the determination process from being executed by a malfunction at a timing where the determination process cannot be executed, such as a timing where the printing process is being executed.

The terminal ZN1-2 at which the diagnostic control signal Tsig comprising the control waveform signal Tsig2, which is one example of an instruction signal, is outputted is one example of a first terminal. The terminal ZN1-5 at which the drive signal Com is outputted is one example of a second terminal. The terminal ZN1-3 that is provided to between the terminal ZN1-2 and the terminal ZN1-5 and is set to the ground potential GND is one example of a third terminal. The terminal ZN1-4, which is provided to between the terminal ZN1-3 and the terminal ZN1-5, is set to the potential VBS, and is electrically connected to the power feeder line LHb, is one example of a fourth terminal. The terminal ZN1-1 provided to between the terminal ZN1-2 and the end Eg1 is one example of a fifth terminal.

Similarly, in the cable CB1 in the present embodiment, the wiring LC1-3 set to the ground potential GND is arranged between the wiring LC1-2 to which the diagnostic control signal Tsig is supplied and the wiring LC1-5 to which the drive signal Com is supplied, and the wiring LC1-4 set to the potential VBS is arranged between the wiring LC1-3 and the wiring LC1-5. Accordingly, the wiring LC1-3 and the wiring LC1-4 function as shields for preventing noise caused by fluctuations in the potential of the drive signal Com supplied to the LC1-5 from propagating to the wiring LC1-2, and thus reduce noise that is superimposed onto the diagnostic control signal Tsig. Thus, it is possible to prevent the determination process from being executed by a malfunction at a timing where the determination process cannot be executed, such as a timing where the printing process is being executed.

The wiring LC1-2 for transmitting the diagnostic control signal Tsig, which includes the control waveform signal Tsig2, is one example of a first connection wiring. The wiring LC1-5 to which the drive signal Com is outputted is one example of a second connection wiring. The wiring LC1-3, which is provided to between the wiring LC1-2 and the wiring LC1-5 and is set to the ground potential GND, is one example of a third connection wiring. The wiring LC1-4, which is provided to between the wiring LC1-3 and the wiring LC1-5, is set to the potential VBS, and is electrically connected to the power feeder line LHb, is one example of a fourth connection wiring. The wiring LC1-1, which is provided to the opposite side of the wiring LC1-2 from the wiring LC1-3, is one example of a fifth connection wiring.

B. Second Embodiment

A second embodiment of the present invention shall now be described. In each of the embodiments illustrated by way of example hereinbelow, for those elements that have actions or functions similar to those in the first embodiment, the reference signs used in the first embodiment shall be reused, and a detailed description thereof shall be omitted as appropriate.

The inkjet printer 1*a* as in the second embodiment differs from the inkjet printer 1 as in the first embodiment in that it is possible to execute an inspection of the discharge state of the ink in the discharge sections D (called a "discharge state inspection" hereinbelow); the startup process, diagnostic process, and printing process, however, can be executed in the same manner as with the inkjet printer 1 as in the first embodiment.

The discharge state inspection refers to an inspection for confirming whether or not there exist any factors that would hinder the discharge sections D from discharging ink in the mode specified by the drive signal Com, such as whether or not the ink filling the cavities 320 of the discharge sections D has thickened, or whether or not ink has seeped out from the nozzles N of the discharge sections D.

Figure 15:
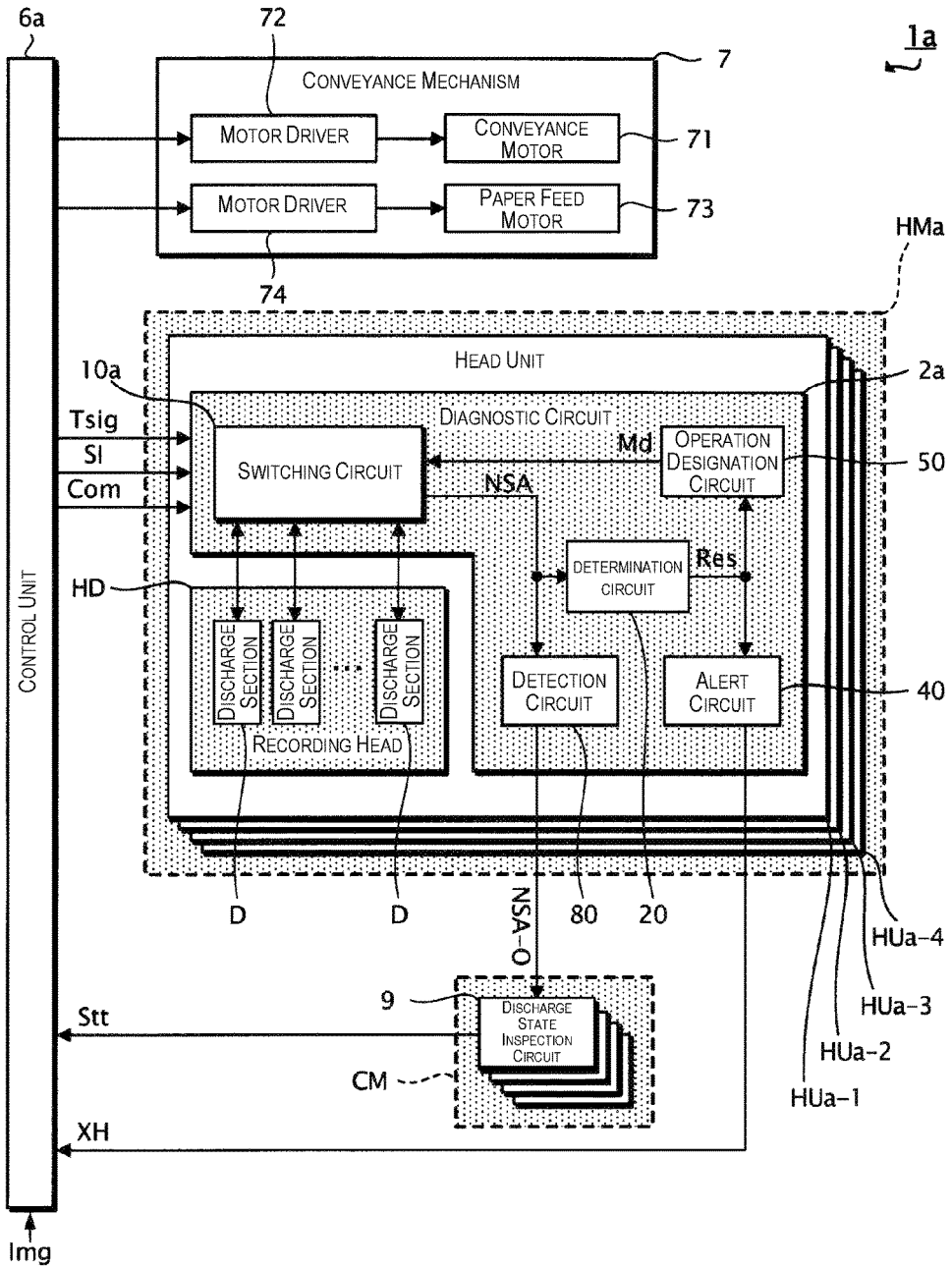
FIG. 15 is a block diagram illustrating the configuration of an inkjet printer 1*a* as in a second embodiment.

FIG. 15 is a diagram illustrating one example of the configuration of an inkjet printer 1*a* as in a second embodiment. As illustrated in FIG. 15, the inkjet printer 1*a* is similar to the inkjet printer 1 as in the first embodiment except in being provided with a head module HMa equipped with four head units HUa (HUa-1 to HUa-4) instead of the head module HM equipped with the four head units HU, and in being provided with an inspection module CM equipped with four discharge state inspection circuits 9 provided so as to have one-to-one correspondence with the four head units HUa.

The head units HUa are configured similarly to the head units HU as in the first embodiment, except in being provided with a switching circuit 10*a* instead of the switching circuit 10, and in being provided with a detection circuit 80. A portion of the head units HUa excluding the recording heads HD, i.e., the switching circuit 10*a*, the determination circuit 20, the alert circuit 40 the operation designation circuit 50, and the detection circuit 80, is called a diagnostic circuit 2*a*. The head units HUa may be configured so as not to be provided with the alert circuit 40, and the diagnostic circuits 2*a* may be configured so as not to be provided with the alert circuit 40.

The detection circuit 80 generates an amplified detection signal NSA-O obtained by amplifying the detection signal NSA. The detection circuit 80 is configured so as to comprise, for example, a high-pass filter for cutting out a direct current component of the detection signal NSA, an operational amplifier for amplifying the detection signal NSA, and a low-pass filter for attenuating a high-frequency component of the detection signal NSA.

The discharge state inspection circuits 9 perform the discharge state inspection on the basis of the amplified detection signal NSA-O outputted by the detection circuit 80 of the head unit HU corresponding to the respective discharge state inspection circuit 9, and output an inspection result signal Stt indicative of the result of the discharge state inspection. A more detailed description shall follow, but in the inkjet printer 1*a*, it is necessary to execute a series of processes, such as selecting the discharge sections D that are to be subject to the discharge state inspection (hereinafter called "discharge sections to be inspected D-K"), driving the discharge sections to be inspected D-K with the drive signal Com, detecting the detection signal NSA from the discharge sections to be inspected D-K, and generating the amplified detection signal NSA-O based on the detection signal NSA, as preparation for the discharge state inspection circuits 9 to perform the discharge state inspection. Therefore, hereinbelow, processes related to the discharge state inspection, including the discharge state inspection and the series of processes for preparing for the discharge state inspection, shall be called the discharge state inspection process.

The present embodiment envisions a case where the inspection module CM equipped with the four discharge state inspection circuits 9 is provided inside the housing 200 but separately from the control unit 6, on the exterior of the carriage 100 where the head module HM is mounted.

However, the present invention is in no way limited to such an embodiment, and each of the discharge state inspection circuits 9 may be provided on the substrate 600 as a part of the control unit 6, or may be provided on the substrate to which the diagnostic circuit 2*a* is provided, as a part of the head unit HUa.

In addition to the individual designation signals Sd, the control unit 6 as in the present embodiment also generates a printing signal SI comprising an inspection execution signal SP. Herein, the inspection execution signal SP refers to a signal indicating that the inkjet printer 1*a* is to execute the discharge state inspection process. The inspection execution signal SP is, for example, set to "1" if the inkjet printer 1*a* is executing the discharge state inspection process during the normal operation period TR, and set to "0" if the inkjet printer 1*a* is executing the discharge state inspection process during the normal operation period TR, e.g., is executing the printing process.

Figure 16:
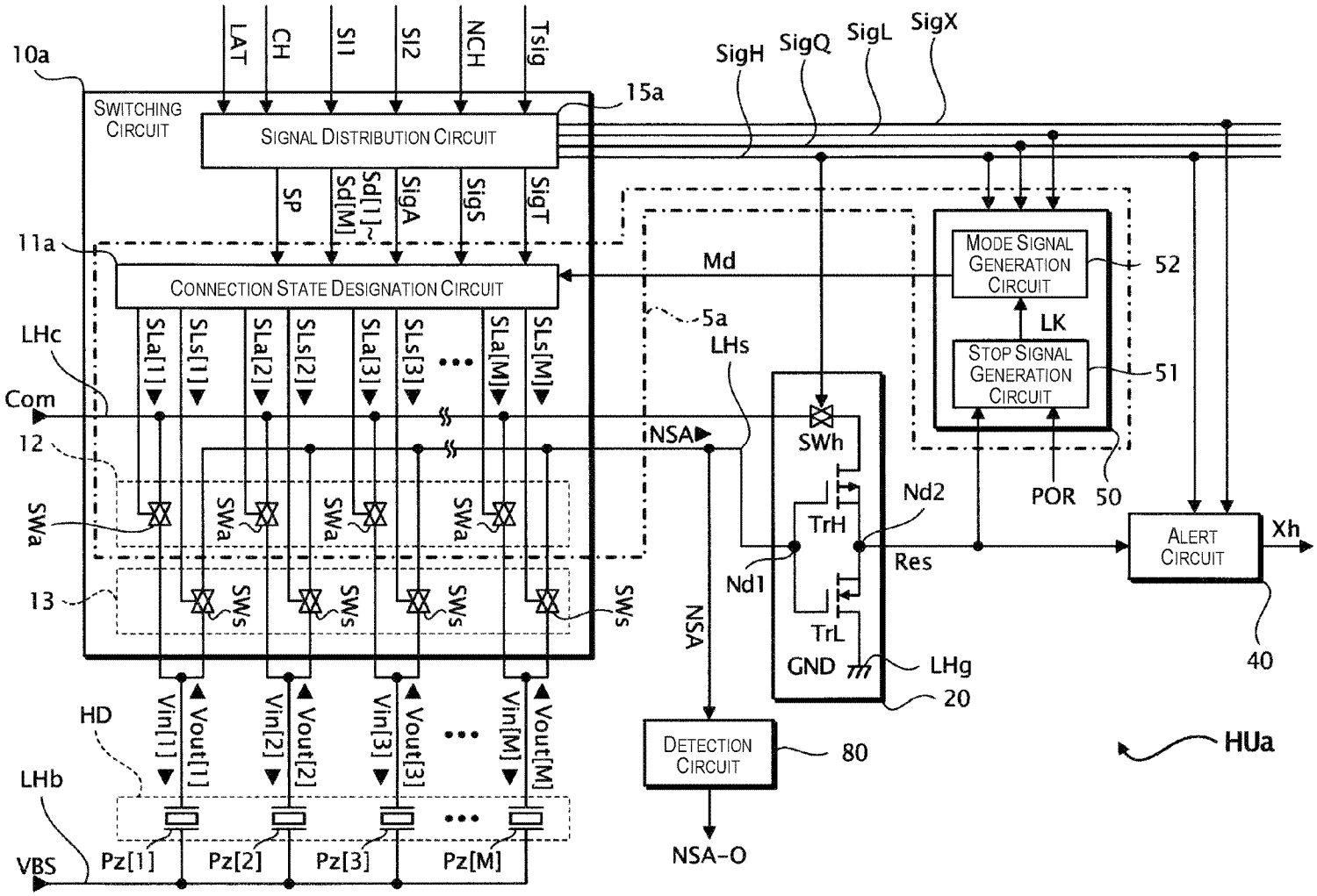
FIG. 16 is a block diagram illustrating the configuration of a head unit HUa.

FIG. 16 is a block diagram illustrating one example of the configuration of the head unit HUa.

As illustrated in FIG. 16, the switching circuit 10*a* provided to the head unit HUa is configured similarly to the switching circuit 10 as in the first embodiment, except in being provided with a connection state designation circuit 11*a* instead of the connection state designation circuit 11, and in being provided with a signal distribution circuit 15*a* instead of the signal distribution circuit 15.

The operation designation circuit 50, the connection state designation circuit 11*a*, and the connection state switching circuit 12 function as a discharge limitation circuit 5*a* for limiting the discharging of the ink from the discharge sections D by stopping the supply of the drive signal Com to the piezoelectric elements PZ if the result of the determination process executed in the determination circuit 20 is negative.

The signal distribution circuit 15*a* supplies the designation signal SigA, the designation signal SigS, the decision signal Sig T, the individual designation signals Sd[1] to Sd[M], and the inspection execution signal SP included in the printing signal SI1 or SI2 to the connection state designation circuit 11*a*.

The connection state designation circuit 11*a* generates the connection state designation signals SLa[1] to SLa[M] and the connection state designation signals SLs[1] to SLs[M] on the basis of the operational mode designation signal Md supplied from the mode signal generation circuit 52, and the designation signal Sig, the designation signal SigS, the decision signal SigT, and the individual designation signals Sd[1] to Sd[M] supplied from the signal distribution circuit 15*a*, and the inspection execution signal SP.

Next, the operation of the inkjet printer 1*a* shall be described with reference to FIGS. 17 to 21.

The inkjet printer 1*a* operates as was described in FIGS. 10A, 10B, and 12, except in that the inspection execution signal SP is included in the printing signal SI where the startup process, the diagnostic process, and the printing process are being executed. Therefore, the description hereinbelow is centered on the operation of the inkjet printer 1*a* in the discharge state inspection process.

Figure 17:
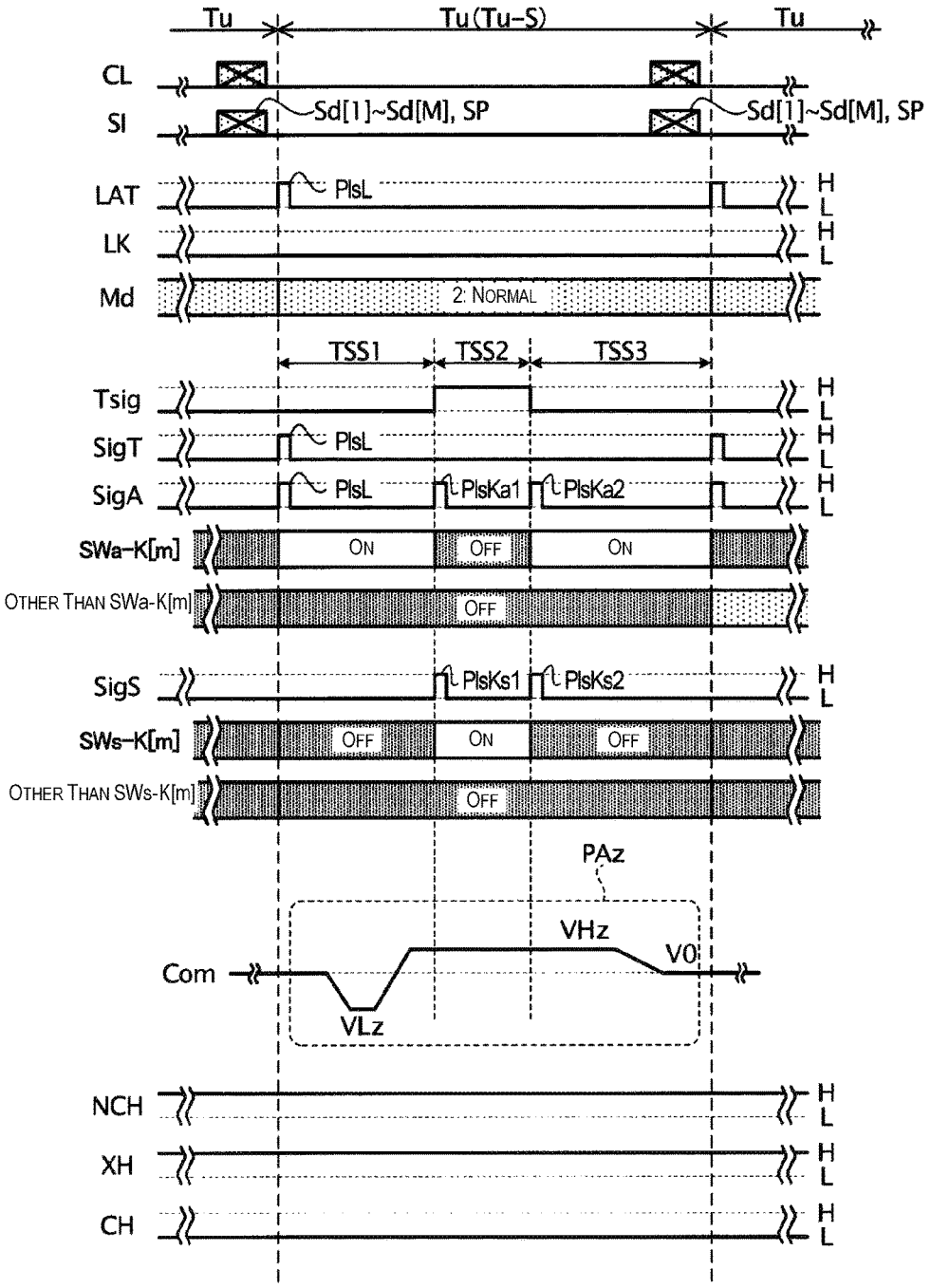
FIG. 17 is a timing chart for describing a discharge state inspection process.

FIG. 17 is a timing chart for describing the operation of the head unit HUa if the discharge state inspection process is being executed.

As illustrated in FIG. 17, the discharge state inspection process is executed in unit periods Tu provided to the normal operation period TR. The inkjet printer 1*a* as in the present embodiment envisions a case (so-called non-print inspection) where the discharge state inspection process is executed during a unit period Tu different than the unit printing period Tu-A where the printing process is executed. Hereinbelow, the unit period where the discharge state inspection process is executed is in some instances called a unit inspection period Tu-S.

As illustrated in FIG. 17, when starting the unit inspection period Tu-S, the control unit 6 outputs the inspection execution signal SP and the individual designation signals Sd[1] to Sd[M] as the printing signals S11 and SI2, synchronously with the clock signal CL, prior to the start of the unit inspection period Tu-S.

In this case, the control unit 6 uses the individual designation signals Sd[1] to Sd[M] to designate the discharge sections to be inspected D-K that are to be subject to the discharge state inspection during the unit inspection period Tu-S. As stated above, the present embodiment envisions a case where the head units HUa and the discharge state inspection circuits 9 are provided so as to have one-to-one correspondence. Therefore, in the present embodiment, one discharge section to be inspected D-K is designated from each of the head units HUa in each of the unit inspection periods Tu-S.

Also, the control unit 6 sets "1", the value indicating that the next unit period Tu is the unit inspection period Tu-S, for the inspection execution signal SP outputted prior to the start of the unit inspection period Tu-S.

As illustrated in FIG. 17, the control unit 6 outputs the diagnostic control signal Tsig, which, during the unit inspection period Tu-S, is set to low-level during a control period TSS1, set to high-level during a control period TSS2, and set to low-level during a control period TSS3. The control unit 6 thereby subdivides the unit inspection period Tu-S into the control period TSS1, the control period TSS2, and the control period TSS3.

The signal distribution circuit 15, during the unit inspection period, sets a pulse PlsL, a pulse PlsKa1, and a pulse PlsKa2 for the designation signal SigA, and sets a pulse PlsKs1 and a pulse PlsKs2 for the designation signal SigS. Herein, the pulses PlsKa2 and PlsKs1 are waveforms that rise to high-level at the start of the control period TSS2, and the pulses PlsKa2 and PlsKs2 are waveforms that rise to high-level at the start of the control period TSS3.

During the unit inspection period, the latch signal LAT, the stop signal LK, the operational mode designation signal Md, the decision signal SigT, the N charge signal NCH, and the alert signal Xh are set to a similar waveform or signal level as in the unit printing period Tu-A. The change signal is set to low-level during the unit inspection period Tu-S.

The control unit 6 outputs the drive signal Com, which has a waveform PAZ, during the unit inspection period Tu-S, as illustrated in FIG. 17. In the present embodiment, the waveform PAZ is established so that the difference in potential between a highest potential VHZ and lowest potential VLZ of the waveform PAZ is smaller than a difference in potential between the highest potential VHY and lowest potential VLY of the waveform PAY, and so that the discharge sections D are driven to such an extent as not to discharge ink if the drive signal Com having the waveform PAZ has been supplied. However, this is one example, and the waveform PAZ may also be a waveform whereby the discharge sections D are driven such that the ink is discharged from the discharge sections D.

Figure 18:
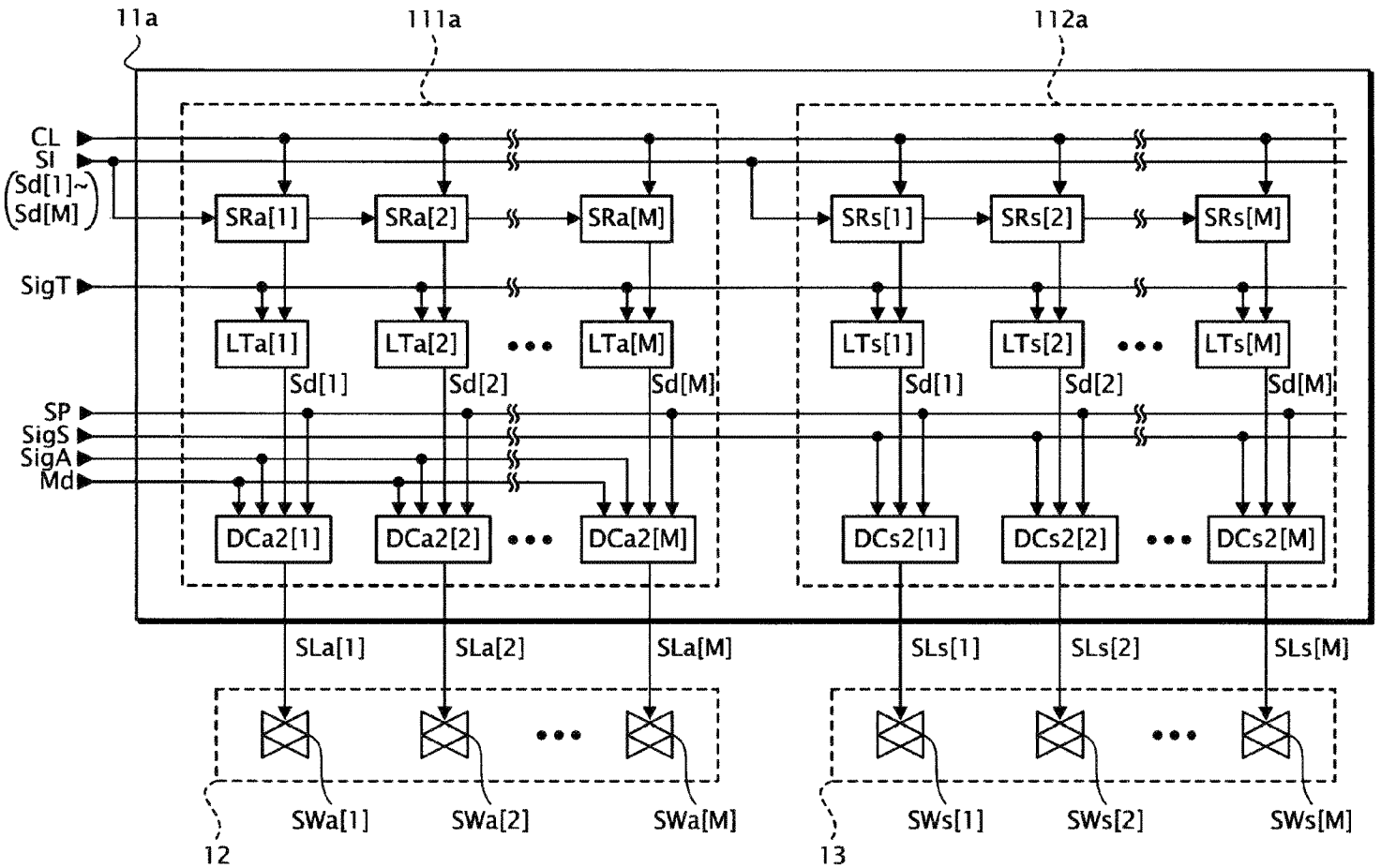
FIG. 18 is a block diagram illustrating the configuration of a connection state designation circuit 11*a;*

FIG. 18 is a drawing illustrating the configuration of the connection state designation circuit 11*a* as in the present embodiment. The connection state designation circuit 11*a* is provided with a designation signal generation circuit 111*a* and a designation signal generation circuit 112*a*.

The designation signal generation circuit 111*a* is configured similarly to the designation signal generation circuit 111, except in being provided with decoders DCa2[1] to DCa2[M] instead of the decoders DCa[1] to DCa[M]. The designation signal generation circuit 112*a* is configured similarly to the designation signal generation circuit 112, except in being provided with decoders DCs2[1] to DCs2[M] instead of the decoders DCs[1] to DCs[M].

The decoder DCa2[*m*] generates the connection state designation signal SLa[m] on the basis of the individual designation signal Sd[m], the designation signal SigA, the operational mode designation signal Md, and the inspection execution signal SP. The decoder DCs2[*m*] generates the connection state designation signal SLs[m] on the basis of the individual designation signal Sd[m], the designation signal SigS, and the inspection execution signal SP.

FIG. 19*a* is a descriptive view for describing the generation of the connection state designation signal SLa[m] at the decoder DCa2[*m*].

As illustrated in FIG. 19A, the decoder DCa2[*m*] operates similarly to the operation of the decoder DCa[m] in the printing process as in the first embodiment, illustrated in FIG. 14B, if the operational mode designation signal Md indicates "2" and the inspection execution signal SP indicates "0", i.e., if the printing process is to be executed.

As illustrated in FIG. 19A, if the operational mode designation signal Md indicates "2" and the inspection execution signal SP indicates "1", i.e., if the discharge state inspection process is to be executed, then the individual designation signal Sd[m] indicates either the value (1, 1) indicating that the discharge section D[m] is being designated as a discharge section to be inspected D-K or the value (0, 0) indicating that the discharge section D[m] is not being designated as a discharge section to be inspected D-K.

If the individual designation signal Sd[m] indicates (1, 1) and the discharge section D[m] is designated as a discharge section to be inspected D-K, then the decoder DCa2[*m*] outputs a connection state designation signal SLa[m] that becomes high-level during the control periods TSS1 and TSS3 and becomes low-level during the control period TSS2. Therefore, as illustrated in FIG. 17, the switch SWa [m] corresponding to the discharge section D[m] designated as a discharge section to be inspected D-K (called a "switch SWa-K[m]") turns on during the control periods TSS1 and TSS3, but off during the control period TSS2.

If the individual designation signal Sd[m] indicates (0, 0) and the discharge section D[m] is not designated as a discharge section to be inspected D-K, then the decoder DCa2[*m*] outputs a connection state designation signal SLa [m] that is low-level during the control periods TSS1 to TSS3. Therefore, as illustrated in FIG. 17, switches SWa other than the switch(es) SWa-K[m] are off during the control periods TSS1 to TSS3.

However, the decoder DCa2[*m*] operates similarly to the operation of the decoder DCa[m] in the diagnostic process as in the first embodiment, illustrated in FIG. 14A, if the operational mode designation signal Md indicates "1", i.e., if the diagnostic process is to be executed, irrespective of the value of the individual designation signal Sd.

FIG. 19B is a descriptive view for describing the generation of the connection state designation signal SLs[m] at the decoder DCs2[*m*].

As illustrated in FIG. 19B, the decoder DCs2[*m*] outputs a connection state designation signal SLs[m] that is low-level during the printing control periods Tu1 and Tu2, similarly to the operation of the decoder DCa[m] in the printing process as in the first embodiment, if the operational mode designation signal Md indicates "2" and the inspection execution signal SP indicates "0", i.e., if the printing process is to be executed.

Further, as illustrated in FIG. 19B, if the operational mode designation signal Md indicates "2" and the inspection execution signal SP indicates "1", i.e., if the discharge state inspection process is to be executed, and the individual designation signal Sd[m] indicates (1, 1) and the discharge section D[m] is designated as a discharge section to be inspected D-K, then the decoder DCs2[*m*] outputs a connection state designation signal SLs[m] that becomes high-level during the control period TSS2 and becomes low-level during the control periods TSS1 and TSS3. Therefore, as illustrated in FIG. 17, the switch SWs[m] corresponding to the discharge section D[m] designated as a discharge section to be inspected D-K (called a "switch SWs-K[m]") is on during the control period TSS2 and off during the control periods TSS1 and TSS3.

If the individual designation signal Sd[m] indicates (0, 0) and the discharge section D[m] is not designated as a discharge section to be inspected D-K, then the decoder DCs2[*m*] outputs a connection state designation signal SLs [m] that is low-level during the control periods TSS1 to TSS3. Therefore, switches SWs other than the switch(es) SWs-K[m] are off during the control periods TSS1 to TSS3.

However, the decoder DCs2[*m*] operates similarly to the operation of the decoder DCa[m] in the diagnostic process as in the first embodiment, illustrated in FIG. 14C, if the operational mode designation signal Md indicates "1", i.e., if the diagnostic process is to be executed, irrespective of the value of the individual designation signal Sd.

As illustrated in FIG. 17, the drive signal Com is supplied during the control period TSS1 to the discharge section D[m] designated as a discharge section to be inspected D-K (to the discharge section to be inspected D-K[m]). During the control period TSS1, the potential of the drive signal Com changes from the lowest potential VLZ to the highest potential VHZ. Therefore, during the control period TSS1, the piezoelectric element PZ[m] of the discharge section to be inspected D-K[m] is also displaced in accordance with the change in potential of the drive signal Com; as a result, a vibration is produced in the discharge section to be inspected D-K[m]. The vibration produced in the discharge section to be inspected D-K[m] remains also during the control period TSS2. Thus, the potential of the upper electrode 302 of the discharge section to be inspected D-K[m], i.e., the potential of the individual detection signal Vout[m] changes in accordance with the vibration that remains in the discharge section to be inspected D-K[m] during the control period TSS2 (called a "residual vibration" hereinbelow).

As stated above, the connection state designation circuit 11*a* outputs such a connection state designation signal SLs[m] as to turn the switch SWs-K[m] on during the control period TSS2. Therefore, the detection circuit 80 detects, as the detection signal NSA, the individual detection signal Vout[m] that changes potential in accordance with the residual vibration produced in the discharge section to be inspected D-K[m] during the control period TSS2.

In general, the residual vibration occurring in the discharge sections D has a specific vibration frequency that is determined, inter alia, by the shape of the nozzles N, the weight of the ink filling the cavities 320, and the viscosity of the ink filling the cavities 320.

Also, in general, the frequency of the residual vibration will be higher if air bubbles have mixed into the cavities 320 than if air bubbles have not mixed into the cavities 320. Also, the frequency of the residual vibration will be lower if foreign matter such as paper dust has adhered to near the nozzles N than if foreign matter has not adhered. Moreover, the frequency of the residual vibration will be lower if the ink filling the cavities 320 has thickened than if the ink has not thickened. The frequency of the residual vibration will also be lower if the ink filling the cavities 320 has thickened than if foreign matter such as paper dust has adhered to near the nozzles N. The amplitude of the residual vibration will be smaller if the cavities 320 are not filled with ink, or if the piezoelectric elements PZ cannot be adequately displaced.

Thus, beyond when a piezoelectric element PZ does not have the predetermined power storage capability, a discharge section D can also experience abnormal discharge if air bubbles have mixed into the cavity 320, if the ink in the cavity 320 has thickened, if foreign matter has adhered to near the nozzle N, if the cavity 320 is not filled with ink, or the like.

Therefore, in the present embodiment, the discharge state inspection based on the waveform of the residual vibration produced in the discharge sections D, such as the frequency or amplitude of the residual vibration, is performed in order to discover an abnormal discharge such as could not be detected during the diagnostic process and preemptively prevent a degradation of the printing quality during the printing process. The waveform of the amplified detection signal NSA-O is established on the basis of the detection signal NSA. Therefore, the discharge state inspection circuit 9 inspects the discharge state of the discharge section to be inspected D-K on the basis of the amplified detection signal NSA-O.

Specifically, the discharge state inspection circuit 9 generates period information Info-T indicative of a time length NTc of one period of the amplified detection signal NSA-O, and generates amplitude information Info-S indicative of whether or not the amplified detection signal NSA-O has a predetermined amplitude. Next, the discharge state inspection circuit 9 inspects the discharge state of the discharge section to be inspected D-K on the basis of the period information Info-T and the amplitude information Info-S, and generates an inspection result signal Stt indicative of the result of the inspection.

Figure 20:
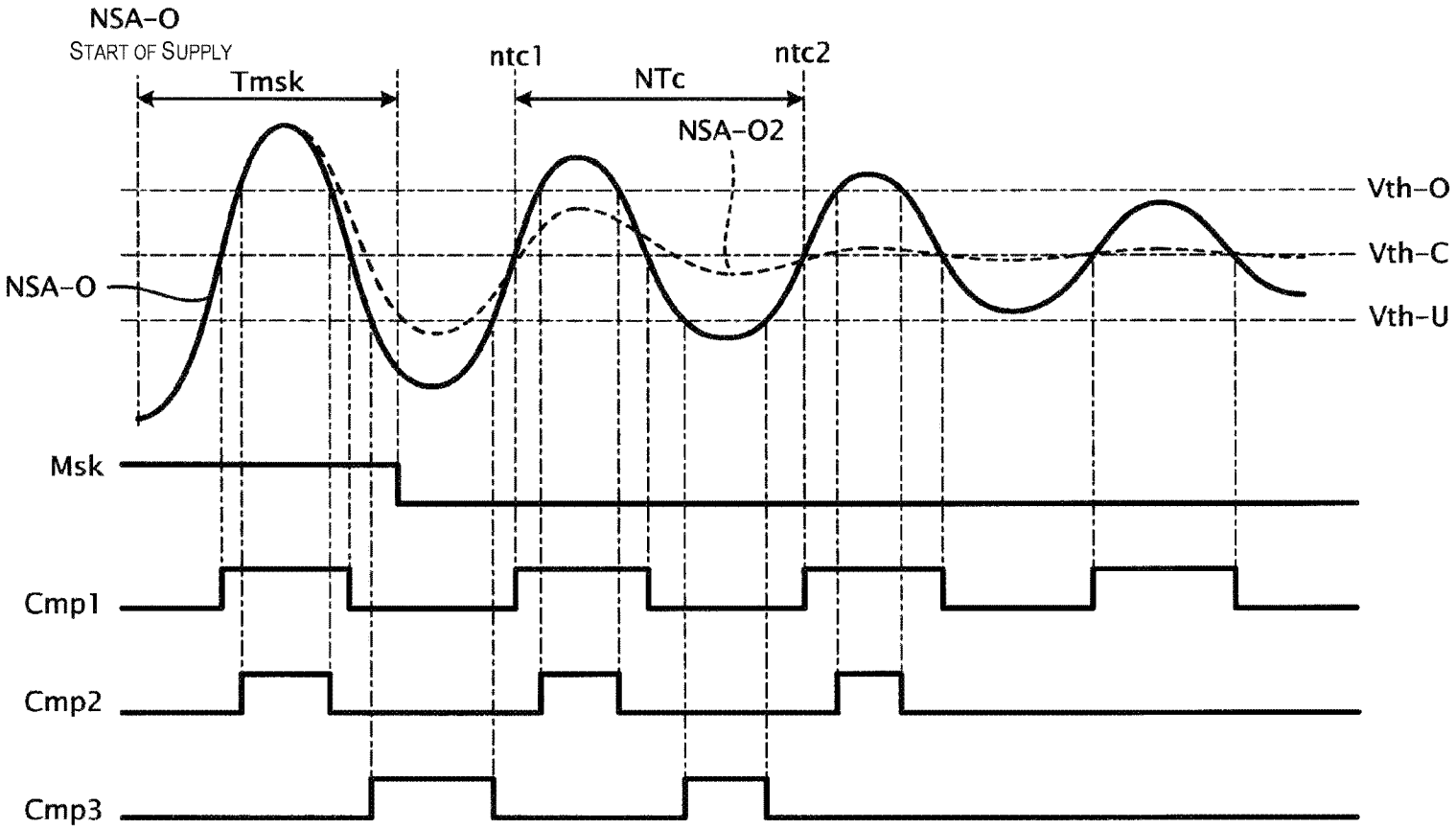
FIG. 20 is a descriptive view for describing the generation of period information Info-T in the discharge state inspection process.

FIG. 20 is a timing chart for describing one example of the operation for generating the period information Info-T and the amplitude information Info-S in the discharge state inspection circuit 9.

As illustrated in FIG. 20, the discharge state inspection circuit 9 compares the amplified detection signal with a threshold potential Vth-C that is a potential of an amplitude center level of the amplified detection signal NSA-O, a threshold potential Vth-O that is a higher potential than the threshold potential Vth-C, and a threshold potential Vth-U that is a lower potential than the threshold potential Vth-C. The discharge state inspection circuit 9 then generates a comparison signal Cmp1 that is high-level if the potential of the amplified detection signal NSA-O is at or above the threshold potential Vth-C, a comparison signal Cmp2 that is high-level if the potential of the amplified detection signal NSA-O is at or above the threshold potential Vth-O, and a comparison signal Cmp3 that is high-level if the potential of the amplified detection signal NSA-O is less than threshold potential Vth-U.

The discharge state inspection circuit 9 then counts the clock signal CL during a period from a time ntc1 where the comparison signal Cmp1 first rises to high-level to a time ntc2 where the comparison signal Cmp1 rises for the second time to high-level, for example, after a mask signal Msk has fallen to low-level, and outputs the period information Info-T indicating a resulting count value. The mask signal is a signal that is high-level for a period Tmsk from the start time of the control period TSS2 where the supply of the amplified detection signal NSA-O from the detection circuit 80 is started.

As illustrated with the dashed line NSA-02 in FIG. 20, a case where the amplitude of the amplified detection signal NSA-O is small is envisioned as being when abnormal discharge is occurring in the discharge section to be inspected D-K, such as when the cavity 320 is not filled with ink. Therefore, the discharge state inspection circuit 9 sets the amplitude information Info-S to "1" if, during the period from the time ntc1 to the time ntc2, the potential of the amplified detection signal NSA-O was at or above the threshold potential Vth-O and the potential of the amplified detection signal NSA-O was less than the threshold potential Vth-U, i.e., if, during the period from the time ntc1 to the time ntc2, the comparison signal Cmp2 was high-level and the comparison signal Cmp3 was high-level; in other instances, the amplitude information is set to "0".

FIG. 21 is a descriptive view for describing the generation of the inspection result signal Stt in the discharge state inspection circuit 9.

As illustrated in FIG. 21, the discharge state inspection circuit 9 compares the time length NTc indicated by the period information Info-T against some or all of a threshold value Tth1, a threshold value Tth2, and a threshold value Tth3, and thereby inspects the discharge state of the discharge section to be inspected D-K and generates the inspection result signal Stt indicating the result of this inspection.

Herein, the threshold value Tth1 is a value for indicating a boundary between a time length of one period of the residual vibration when the discharge state of the discharge section to be inspected D-K is normal, and a time length of one period of the residual vibration when air bubbles have been introduced into the cavity 320. The threshold value Tth2 is a value for indicating a boundary between a time length of one period of the residual vibration when the discharge state of the discharge section to be inspected D-K is normal, and a time length of one period of the residual vibration when foreign matter has adhered to near the nozzle N. The threshold value Tth3 is a value for indicating a boundary between a time length of one period of the residual vibration when foreign matter has adhered to near the nozzle N, and a time length of one period of the residual vibration when the ink inside the cavity 320 has thickened. The threshold value Tth1 to threshold value Tth3 satisfy the relationship "Tth1<Tth2<Tth3".

As illustrated in FIG. 21, in the present embodiment, the discharge state of the ink in the discharge section to be inspected D-K is regarded as being normal if the value of the amplitude information Info-S is "1" and the time length NTc indicated by the period information Info-T satisfies "Tth1≤NTc≤Tth2". In such a case, the discharge state inspection circuit 9 sets the value "1" indicating that the discharge state of the discharge section to be inspected D-K is normal for the inspection result signal Stt.

The discharge section to be inspected D-K is regarded as experiencing abnormal discharge due to air bubbles if the value of the amplitude information Info-S is "1" and the time length NTc indicated by the period information Info-T satisfies "NTc<Tth1". In such a case, the discharge state inspection circuit 9 sets the value "2" indicating that the discharge section to be inspected D-K is experiencing abnormal discharge due to air bubbles for the inspection result signal Stt.

The discharge section to be inspected D-K is regarded as experiencing abnormal discharge due to foreign matter adhesion if the value of the amplitude information Info-S is "1" and the time length NTc indicated by the period information Info-T satisfies "Tth2<NTc≤Tth3". In such a case, the discharge state inspection circuit 9 sets the value "3" indicating that the discharge section to be inspected D-K is experiencing abnormal discharge due to foreign matter adhesion for the inspection result signal Stt.

The discharge section to be inspected D-K is regarded as experiencing abnormal discharge due to thickening if the value of the amplitude information Info-S is "I" and the time length NTc indicated by the period information Info-T satisfies "Tth3<NTc". In such a case, the discharge state inspection circuit 9 sets the value "4" indicating that the discharge section to be inspected D-K is experiencing abnormal discharge due to thickening for the inspection result signal Stt.

The discharge section to be inspected D-K is also regarded as experiencing abnormal discharge if the value of the amplitude information Info-S is "0". In such a case, the discharge state inspection circuit 9 sets the value "5" indicating that the discharge section to be inspected D-K is experiencing abnormal discharge for the inspection result signal Stt.

Thus, the discharge state inspection circuit 9 generates the inspection result signal Stt on the basis of the period information Info-T and the amplitude information Info-S.

The present embodiment illustrates, by way of example, a case where the inspection result signal Stt is information with five values "1" to "5", but the inspection result signal Stt may be binary information indicating whether or not the time length NTc satisfies "Tth1≤NTc≤Tth2". At the least, the inspection result signal Stt should include information indicating whether or not the discharge state of the ink in the discharge section to be inspected D-K is normal.

As described above, the inkjet printer 1*a* as in the second embodiment is able to execute the discharge state inspection process, in addition to the diagnostic process. Therefore, in addition to abnormal discharge caused by when a piezoelectric element PZ does not have the predetermined power storage capability and the discharge section D does not have the predetermined discharge capability, it is also possible to discover abnormal discharge caused by factors such as mixing of air bubbles into the cavity 320, or thickening of the ink inside the cavity 320. This makes it possible to increase the likelihood of preemptively preventing degradation of printing quality during the printing process.

C. Alternate Embodiments

Each of the embodiments above can be modified in a variety of manners. Specific variant modes are illustrated by way of example hereinbelow. Any two or more modes selected from those illustrated by way of example hereinbelow can be combined, as appropriate, within scopes in which the modes do not conflict with one another. In each of the alternate embodiments illustrated by way of example hereinbelow, for those elements that have actions or functions similar to those in the embodiments, the reference signs referenced in the description above shall be reused, and a detailed description thereof shall be omitted as appropriate.

Alternate Embodiment 1

In the embodiments described above, of the signals supplied to the head unit HU (or HUa) from the control unit 6, those signals (hereinbelow called "control system signals") excluding the drive signal Com are distributed to the respective parts of the head unit HU via the signal distribution circuit 15 (or 15*a*), but the present invention is in no way limited to such an embodiment. For example, the signals generated within the head unit (or HUa) may have any waveform whatsoever, provided that it is possible for each of the constituent elements of the head unit HU (or HUa) to operate in the modes illustrated in FIGS. 10A and 10B at the times t-10, t-11, t-12, t-20, t-30, t-31, t-32, t-33, t-34, and t-40 specified by the control system signals. For example, the control system signals may be supplied directly to respective parts of the head unit HU, without going through the signal distribution circuit 15.

Figure 22:
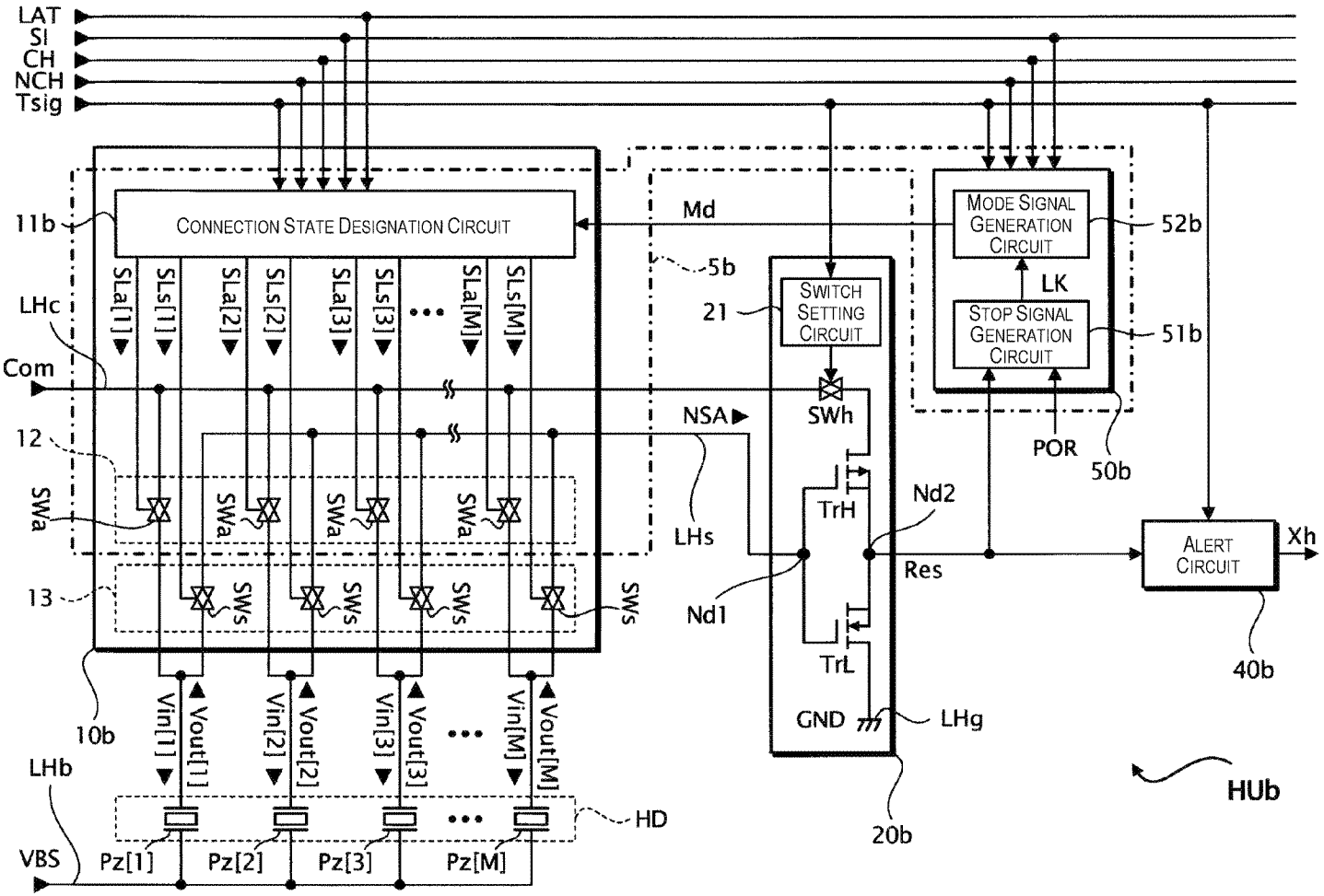
FIG. 22 is a block diagram illustrating the configuration of a head unit HUb in an alternate embodiment 1.

FIG. 22 is a block diagram illustrating the configuration of a head unit HUb as in the present alternate embodiment 1. As illustrated in FIG. 22, the head unit HUb differs from the head unit HU as in the first embodiment illustrated in FIG. 9 in being provided with a switching circuit 10*b* instead of a switching circuit 10, in being provided with a determination circuit 20*b* instead of the determination circuit 20, in being provided with an alert circuit 40*b* instead of the alert circuit 40, and in being provided with an operation designation circuit 50*b* instead of the operation designation circuit 50.

As illustrated in FIG. 22, the switching circuit 10*b* is configured similarly to the switching circuit 10 as in the first embodiment except in being configured so as not to have the signal distribution circuit 15, and in being provided with a connection state designation circuit 11*b* instead of the connection state designation circuit 11.

The connection state designation circuit 11*b* can generate the connection state designation signals SLa[1] to SLa[M] and the connection state designation signals SLs[1] to SLs[M] on the basis of the diagnostic control signal Tsig and the individual designation signals Sd[1] to Sd[M] included in the printing signal SI during the diagnostic period TQ where, of the printing signals SI, the printing signal SI2 is high-level, the change signal CH is low-level, and the N charge signal NCH is low-level, and control the on/off status of the switches SWa[1] to SWa[M] and the switches SWs[1] to SWs[M] in a mode similar to that of the connection state designation circuit 11 illustrated in FIG. 10A.

The determination circuit 20*b* is configured similarly to the determination circuit 20 except in being provided with a switch setting circuit 21. The switch setting circuit 21 turns the switch SWh on during the determination period T2 where the control waveform signal Tsig2 is supplied, as the diagnostic control signal Tsig. This enables the determination circuit 20*b* to execute the determination process in a mode similar to that of the determination circuit 20 as in the first embodiment.

The alert circuit 40*b* can output the alert signal Xh in a mode similar to the alert circuit 40 as in the first embodiment, on the basis of the determination result signal Res and the diagnostic control signal Tsig.

The operation designation circuit 50*b* differs from the operation designation circuit 50 in being provided with a stop signal generation circuit 51*b* instead of the stop signal generation circuit 51, and in being provided with a mode signal generation circuit 52*b* instead of the mode signal generation circuit 52. The stop signal generation circuit 51*b* can output the stop signal LK in a mode similar to that of the stop signal generation circuit 51 as in the first embodiment, on the basis of the POR signal, the determination result signal Res, and the diagnostic control signal Tsig. The mode signal generation circuit 52*b* can output the operational mode designation signal Md in a mode similar to that of the mode signal generation circuit 52 as in the first embodiment, on the basis of the stop signal LK, the printing signal SI2, the change signal CH, and the N charge signal NCH.

The connection state designation circuit 11*b*, the connection state switching circuit 12, and the operation designation circuit 50*b* function as a discharge limitation circuit 5*b* for limiting the discharging of the ink from the discharge sections D by stopping the supply of the drive signal Com to the piezoelectric elements PZ if the result of the determination process executed in the determination circuit 20*b* is negative.

As illustrated by way of example above, in the head unit HUb as in the present alternate embodiment, the diagnostic process comprising the determination process and the discharge limitation process can be executed in a manner similar to the head unit HU or HUa.

Alternate Embodiment 2

In the embodiments and alternate embodiment described above, the control unit 6 is provided with one substrate 600, but the present invention is in no way limited to such an embodiment, and the control unit 6 may comprise a plurality of substrates.

Figure 23:
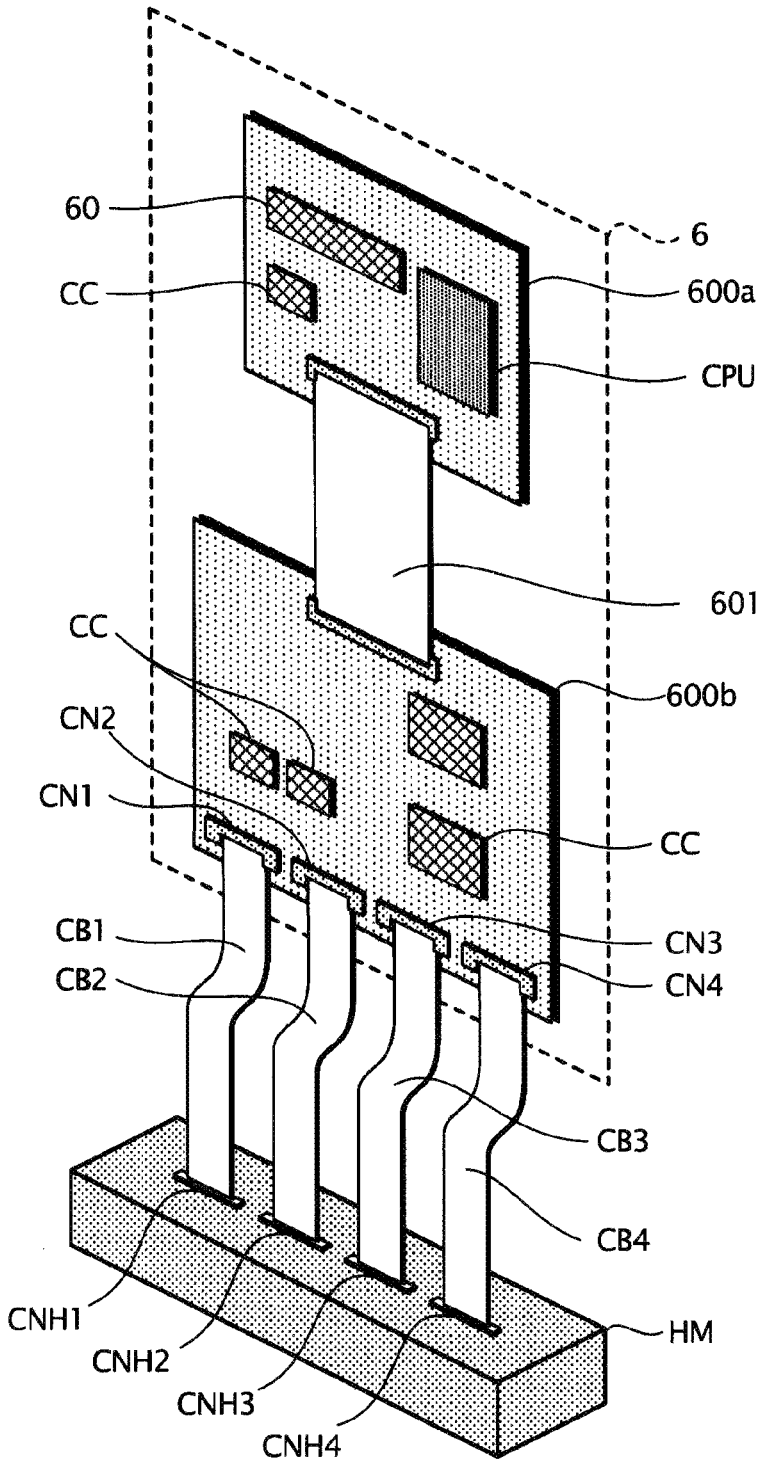
FIG. 23 is a descriptive view illustrating a connection between the control unit 6 and the head module HM as in an alternate embodiment 2.

For example, as illustrated in FIG. 23, the control unit 6 may be configured so as to comprise a substrate 600*a*, a substrate 600*b*, a cable 601 electrically connecting the substrate 600*a* and the substrate 600*b*, and a CPU, various circuits CC, and storage unit 60 that are formed on the substrate 600*a* or the substrate 600*b*.

In any case, the connectors CN (CN1 to CN4) provided to the control unit 6 are connected to the connectors CNH provided to the head module HM via only the cables CB (CB1 to CB4).

Alternate Embodiment 3

In the embodiment and alternate embodiments described above, the diagnostic process is executed in the period from after the end of the startup process until before the start of the printing process, but the present invention is in no way limited to such an embodiment, and the diagnostic process may be executed at any timing. For example, the diagnostic process may be started after the printing process has been executed, or may be started when the user of the inkjet printer 1 uses an operation unit (not shown) or the like to instruct execution of the diagnostic process.

Alternate Embodiment 4

In the embodiments and alternate embodiments described above, the inkjet printer 1 or 1*a* had four head units HU (or HUa or HUb) and four ink cartridges 31 provided so as to have one-to-one correspondence, but the present invention is in no way limited to such an embodiment, and the inkjet printer 1 or 1*a* need only be provided with at least one head unit HU and at least one ink cartridge 31. In such a case, one ink cartridge 31 may be provided so as to correspond to a plurality of head units HU, or a plurality of ink cartridges 31 may be provided so as to correspond to one head unit HU. One example of a possible mode may be such that of the M discharge sections D[1] to D[M] provided to one head unit HU, the discharge sections D[1] to D[M1] receive ink supplied from one ink cartridge 31, and the discharge sections D[M1+1] to D[M] receive ink supplied from another ink cartridge 31.

Alternate Embodiment 5

In the embodiments and alternate embodiments described above, the cables CB1 to CB4 for connecting the control unit 6 and the head module HM or HMa have a total of 56 wirings LC, which are the wirings LC1-1 to wirings LC4-14, but the present invention is in no way limited to such an embodiment, and there need only be a sufficient number of wirings LC needed to supply the drive signal Com and the control system signals to the head module HM or HMa.

However, in any case, a first connecting wiring to which the diagnostic control signal Tsig is supplied and a second connection wiring to which the drive signal Com is supplied must have provided therebetween at least a third connection wiring or fourth connection wiring set to the ground potential GND or the potential VBS. If there are two connection wirings, which are the third connection wiring and the fourth connection wiring, provided to between the first connection wiring and the second connection wiring, then the fourth connection wiring is preferably provided to between the second connection wiring and the third connection wiring.

In the embodiments and alternate embodiments described above the control unit 6 and the head module HM or HMa are connected by four cables CB1 to CB4, but the present invention is in no way limited to such an embodiment, and the control unit 6 and the head module HM or HMa need only be connected with at least one cable CB.

Alternate Embodiment 6

In the embodiments and alternate embodiments described above, the difference in potential between the highest potential VHX and lowest potential VLX of the drive signal if the printing process is being executed is greater than the difference in potential between the highest potential VH of the drive signal Com and the potential V0, which is the lowest potential, if the diagnostic process is being executed, but the present invention is in no way limited to such an embodiment, and the difference in potential between the highest potential and lowest potential of the drive signal Com if the printing process is being executed may also be at or below the difference in potential between the highest potential and lowest potential of the drive signal Com if the diagnostic process is being executed.

Alternate Embodiment 7

In the embodiments and alternate embodiments described above, the diagnostic period TQ is specified on the basis of the signal level of the printing signal SI2, but the present invention is in no way limited to such an embodiment, and the diagnostic period TQ may be specified on the basis of the signal level of the printing signal SI1, or the diagnostic period TQ may be specified on the basis of the signal levels of both of the printing signals SI1 and SI2.

Alternate Embodiment 8

The embodiments and alternate embodiments described above envision a case where the inkjet printer 1 or 1*a* is a serial printer, but the present invention is in no way limited to such an embodiment, and the inkjet printer 1 or 1*a* may also be a so-called line printer, in which a plurality of nozzles N are provided so as to extend wider than the width of the recording paper P in the head module HM.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least 5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A head unit comprising:

a discharge section including a piezoelectric element that is configured to be displaced in accordance with changes in potential of a drive signal when the drive signal is supplied, the discharge section being configured to discharge a liquid in accordance with displacement of the piezoelectric element;

a determination circuit configured to determine whether or not the piezoelectric element has a predetermined power storage capability; and a discharge limitation circuit configured to stop supply of the drive signal to the piezoelectric element and limit discharging of liquid from the discharge section when a result of determination is negative.

2. The head unit according to claim 1, wherein a first designation signal, a second designation signal, a third designation signal, and an instruction signal that is for instructing execution of the determination are supplied, and the determination circuit is configured to execute the determination in a determination period during which the first designation signal is high-level, the second designation signal is low-level, the third designation signal is high-level, and the instruction signal is being supplied.

3. The head unit according to claim 2, wherein the discharge limitation circuit includes a first switch electrically connected between a first wiring to which the drive signal is supplied and the piezoelectric element, and when the result of the determination is negative, the first switch is turned off after an end of the determination period and when the first designation signal falls from high-level to low-level, the second designation signal rises from low-level to high-level, and the third designation signal falls from high-level to tow-level.

4. The head unit according to claim 3, further comprising a second wiring, and a second switch electrically connected between the piezoelectric element and the second wiring, wherein the first switch is configured to turn on in a preparation period during which a preparation signal is supplied within a period during which the first designation signal is high-level, the second designation signal is low-level, and the third designation signal is high-level, and until the determination period is started, and the first switch is configured to turn off at the end of the determination period after an end of the preparation period, the second switch is configured to turn on at least from a start of the preparation period until the end of the determination period, the drive signal is configured to set to a predetermined potential at least from the start of the preparation period until the end of the determination period, and the determination circuit is configured to determine that the piezoelectric element has the predetermined power storage capability when, at a predetermined timing within the determination period, a difference in potential between a potential of the first wiring and a potential of the second wiring is a predetermined difference in potential or below.

5. The head unit according to claim 4, wherein the determination circuit includes an output node, a third switch at which one end is electrically connected to the first wiring, a first transistor of which a gate is electrically connected to the second wiring and which is electrically connected between another end of the third switch and the output node, and a second transistor of which a gate is electrically connected to the second wiring and which is electrically connected between the output node and a first power feeder line set to a first reference potential, and the third switch is on during the determination period.

6. The head unit according to claim 5, wherein the second transistor is configured to be on when the difference in potential between the potential of the first wiring and the potential of the second wiring is a predetermined difference in potential or below.

7. The head unit according to claim 6, wherein the piezoelectric element includes a first electrode electrically connected to the first switch, and a second electrode electrically connected to a second power feeder line set to a second reference potential, and a difference in potential between the second reference potential and the first reference potential is smaller than a difference in potential between the predetermined potential and the first reference potential.

8. The head unit according to claim 1, wherein the first designation signal is configured to designate discharging or non-discharging of the liquid from the discharge section when the result of the determination is affirmative and the liquid is configured to be discharged from the discharge section, when the result of the determination is affirmative and the liquid is configured to be discharged from the discharge section, the second determination signal is configured to be low-level, and thereby configured to designate turning on the first switch between the piezoelectric element and the first wiring to which the drive signal is supplied, and the third designation signal is configured to specify a period of time for discharging the liquid from the discharge section when the result of the determination is affirmative and the liquid is configured to be discharged from the discharge section.

9. The head unit according to claim 1, wherein all of the discharge section, the determination circuit and the discharge limitation circuit are disposed within an interior of the head unit.

10. A head unit comprising:

a discharge section including a piezoelectric element that is configured to be displaced in accordance with changes in potential of a drive signal when the drive signal is supplied, the discharge section being configured to discharge a liquid in accordance with displacement of the piezoelectric element; and a diagnostic circuit configured to diagnose a power storage capability of the piezoelectric element, and stop supply of the drive signal to the piezoelectric element and limit discharging of liquid from the discharge section when a result of diagnosis is a predetermined result.

11. The head unit according to claim 10, wherein a first designation signal, a second designation signal, a third designation signal, and a diagnostic control signal are supplied, and the diagnostic circuit is configured to execute the diagnosis in accordance with the diagnostic control signal in a diagnostic period during which the first designation signal is high-level, the second designation signal is low-level, and the third designation signal is high-level.

12. The head unit according to claim 11, wherein the diagnostic circuit includes a first switch electrically connected between a first wiring to which the drive signal is supplied and the piezoelectric element, and a state of being turned to off after an end of the diagnostic period is maintained when the result of the diagnosis is the predetermined result.

13. The head unit according to claim 12, wherein the diagnostic circuit includes a second switch electrically connected between the piezoelectric element and a second wiring, and the piezoelectric element is diagnosed as having the predetermined power storage capability when a difference in potential between a potential of the first wiring and a potential of the second wiring is a predetermined difference in potential or below at a predetermined timing in a period during which the second switch is on within the diagnostic period.

14. The head unit according to claim 10, wherein both of the discharge section and the diagnostic circuit are disposed within an interior of the head unit.

* * * * *